US006115853A

United States Patent [19]

Shibata et al.

[11] Patent Number: 6,115,853

[45] Date of Patent: Sep. 12, 2000

[54] TOILET BOWL

[75] Inventors: Shinji Shibata; Takeshi Takaki; Yumiko Kataoka; Kiyoshi Fujino; Takenori Fukushima; Shingo Tanaka; Hiroshi Tsuboi; Hidetaka Miyahara, all of Kitakyushu, Japan

[73] Assignee: Toto Ltd., Kitakyushu, Japan

[21] Appl. No.: 09/214,355

[22] PCT Filed: Aug. 5, 1997

[86] PCT No.: PCT/JP97/02724

§ 371 Date: Dec. 31, 1998

§ 102(e) Date: Dec. 31, 1998

[87] PCT Pub. No.: WO98/05829

PCT Pub. Date: Feb. 12, 1998

[30] Foreign Application Priority Data

Aug. 6, 1996 [JP] Japan ..... 8-239650
Mar. 21, 1997 [JP] Japan ..... 9-087730

[51] Int. Cl.[7] ..... E03D 11/02

[52] U.S. Cl. ..... 4/425; 4/420

[58] Field of Search ..... 4/420, 421, 425

[56] References Cited

U.S. PATENT DOCUMENTS 4,142,262 3/1979 Hamilton .
5,204,999 4/1993 Makita et al. ..... 4/425 X

FOREIGN PATENT DOCUMENTS 60-203748 10/1985 Japan .
5-311719 11/1993 Japan .
WO 91/16508 10/1991 WIPO .

*Primary Examiner*—Robert M. Fetsuga
*Attorney, Agent, or Firm*—Beyer Weaver & Thomas LLP

[57] ABSTRACT

When a cleaning button for cleaning the toilet bowl is operated, by a manner as pressing, a switching valve 41 switches the flushing water supply destination to a position for cleaning the bowl part. The flushing water is then jetted out of a spout nozzle 35 disposed inside a Z water conduit 161 as a jet flow. The jet flow from the spout nozzle 35 causes water inside the Z water conduit 161 and water inside the flushing water reservoir 104 to flow through the Z water conduit 161 and to be spouted toward an inlet 121 of a waste trap 102, like a jet flow spouted by a jet pump. This supplies a heavy flow of flushing water amplified in the volume into the waste trap 102 all at once to flush out the filth in the bowl part 101.

45 Claims, 45 Drawing Sheets

Fig. 11

DATA ON EFFICIENCY OF JET PUMP

DIAMETER OF NOZZLE d: $\phi$ 7 DIAMETER OF WATER CONDUIT D: $\phi$ 15 d/D: 0.47

| JET FLOW RATE A L/min | JET FLOW VELOCITY B m/sec | Z FLOW RATE C L/min | Z FLOW VELOCITY D m/sec | RATIO OF INCREASING FLOW RATE | RATIO OF DAMPING FLOW VELOCITY |
|---|---|---|---|---|---|
| 3 | 1.3 | 4.1 | 0.38 | 1.37 | 0.29 |
| 6 | 2.6 | 10.81 | 1.02 | 1.80 | 0.39 |
| 9 | 3.9 | 17.06 | 1.61 | 1.90 | 0.41 |
| 12 | 5.2 | 24.46 | 2.31 | 2.04 | 0.44 |
| 14 | 6.07 | 28.98 | 2.74 | 2.07 | 0.45 |
| 16 | 6.93 | 32.32 | 3.05 | 2.02 | 0.44 |
| 18 | 7.8 | 36.54 | 3.45 | 2.03 | 0.44 |
| 20 | 8.67 | 40.02 | 3.79 | 2.00 | 0.44 |
| 30 | 13 | 57.3 | 5.41 | 1.91 | 0.42 |
| 35 | 15.17 | 67.2 | 6.34 | 1.92 | 0.42 |

TOILET BOWL

TECHNICAL FIELD

The present invention relates to a toilet wherein a toilet bowl is cleaned by using flushing water which conveys filth in a bowl part of the toilet bowl to the outside of the toilet bowl.

BACKGROUND ART

An ordinary toilet is arranged with a tank in which flushing water for cleaning the toilet bowl is stored and discharged into the toilet bowl. Filth present in the toilet bowl is flushed directly through a drain and conveyed to the outside of the toilet bowl by the flushing water under the pressure thereof. An alternative arrangement has a generally-known siphon flow conduit which is formed so as to curve upward above the toilet bowl and, when the flushing water is discharged, the flushing water fills the siphon flow conduit up to the curved part, generating a siphon effect. With the addition of the siphon effect, filth is drawn into the outlet and conveyed to the outside of the toilet bowl. In this case, the flushing water in the bowl part is conveyed together with the filth, thereby also cleaning the toilet bowl. Usually, for the flushing water in the tank to thus convey the filth and also clean the toilet bowl, ten or more liters of water needs to be stored at a height of around 30 cm to impart the necessary potential energy to the stored water.

However, in recent years the increasing population concentrations in major cities and global irregularities of climate and weather have made it difficult to provide stable supplies of water for everyday use. This has caused local authorities and governments to impose restrictions on the use of water in a number of areas, or call for less water to be consumed. Defecation toilet bowls have not been exempted. In the United States, for example, in 1994 the government changed the regulations to lower the volume of water used to flush a toilet bowl from 3.5 gallons (about 13 liters) to 1.6 gallons (about 6 liters), and measures aimed at consuming less water are also being imposed by Taiwan and Singapore. In Japan, also, ways are being studied to reduce water consumption, on a city, town and village basis.

A common method of economizing on water consumption is to place a brick in the flushing water tank to reduce the visible amount of water that is stored. However, this is not really an adequate answer, since the result is that there is not enough water to properly clean the toilet bowl.

A number of proposals have been made in response to the need to economize on water consumption, including JAPANESE PATENT LAYING-OPEN GAZETTE 54-18137 and JAPANESE PATENT PUBLICATION GAZETTE 6-99952. These disclosed techniques comprise a subtank which is to be installed inside an existing flushing water tank so as to store the flushing water applied with about the same degree of pressure as the water service supply pressure. When the toilet bowl is being flushed, the subtank water thus subjected to pressure giving it energy equivalent to the water service supply pressure, is discharged into the toilet bowl. Although this enables the amount of flushing water to be decreased, the size of the flushing water tank has to be increased by a volume enough to allow the subtank to be accommodated. So that, there have been some cases wherein such toilet as above cannot be installed in small toilet rooms. Also, in the case of low-silhouette type toilets wherein the water tank is positioned lower down to allow it to be integrated with the toilet bowl, design constraints mean that it is difficult to make the water tank large enough to accommodate a subtank. Moreover, when the flushing water under pressure in the subtank is just about enough to clean the toilet bowl, it can take quite a time for the flushing water to fill the subtank. As such, when the toilet is being consecutively used and flushed by a number of users, each user has to wait for the subtank to fill.

JAPANESE PATENT LAYING-OPEN GAZETTE 5-311719 discloses another technique. The technique comprises a horizontal waste trap, wherein the horizontal conduit has an upward bend before connecting with the drain outlet, to provide a water pool part in front of the drain outlet that serves as a seal. Air in the space between the sealing water in the toilet bowl and said water pool part is sucked by the negative pressure generated when the water in the sealed tank is discharged into the toilet bowl. This negative pressure is designed to drain out the air in the trap, generating a siphon effect that enhances the efficiency with which filth is drained out. The reason for providing an air space over the water pool part is that, were not for the air space, the suction of the negative pressure would cause not only the pooled water but also the water in the toilet bowl to drain out through the drain channel on generation of a negative pressure on the drain channel side, allowing foul odors to flow back into the toilet bowl from the drain channel.

However, this technique that utilizes negative pressure in the tank requires the tank to have a leak-tight structure. Even with the air passage provided as described above, since the downstream side of the sealing water and the tank are connected, foul odors may still flow back into the tank, so it is necessary to provide a separate structure to prevent that.

Moreover, in the midst of calls for water economy, the high-class image projected by the low-silhouette type toilet is increasing the popularity. The low positioning of the flushing water tank on such toilet bowls reduces the potential energy of the water in the tank. This has led to arrangements such as the one disclosed in JAPANESE PATENT LAYING-OPEN GAZETTE 60-203748 in which, to compensate the low potential energy, a vortex jet outlet is provided so as to produce a vortex in the toilet bowl. However, to adequately clean a low-silhouette type toilet still requires more flushing water than a conventional toilet.

The present invention has been conceived to solve the above-specified problems and has an object to economize on water consumption while maintaining cleaning performance.

Another object of the present invention is also to provide a toilet, particularly a low-silhouette type toilet, which economizes on water consumption while maintaining cleaning performance.

DISCLOSURE OF THE INVENTION

In order to achieve at least some of these objects, a toilet according to the present invention, wherein filth in a bowl part of a toilet bowl is conveyed to the outside of the toilet bowl by flushing water, the toilet comprises:

- a water spout member for spouting flushing water in order to convey the filth; and
- amplification means for amplifying a flow rate of flushing water utilized for conveyance of the filth and for leading the amplified flow rate of flushing water into the water spout member, in order to convey the filth in the toilet bowl when the flushing water is spouted.

In a toilet thus configured according to the present invention, filth conveyance with flushing water spouted from a water spout member is carried out by the flushing water of an amplified flow rate. Since the toilet bowl cleaning is carried out by conveying the filth in the bowl part to the outside of the toilet bowl with the flushing water of the amplified flow rate, the cleaning performance can be maintained. Moreover, water economy is served since water prior to the amplification is utilized as additional flushing water.

The toilet according to the present invention can adopt the following modes. In a first mode, the amplification means comprises a jet pump for jetting out a mixture of both a driving fluid which represents water being supplied from a water supply source and a driven fluid which represents flushing water provided for conveyance of the filth in the bowl part. This jet pump comprises an actuation nozzle for jetting out the water supplied from the water supply source and a throat which defines a flow path of both the fluids in response to the actuation nozzle and which leads both the fluids to the water spout member.

In this mode, the actuation nozzle jets out high-velocity and high-pressure water having energy approximately the same as the water supply source pressure (normally 1 to 2 $kgf/cm^2$). This high-velocity and high-pressure jet water causes an ejector effect when passing through the throat as the driving fluid and becomes a jet flow that involves the flushing water which has been provided beforehand as the driven fluid. Moreover, since the jet flow is spouted by the jet pump, the instantaneous flow rate thereof is increased. Therefore, even if the volume of water supplied from the water supply source may be small, the supplied water which involves flushing water that has been provided beforehand is led from the throat to the water spout member and spouted in a state of amplified flow rate and increased instantaneous flow rate. Consequently, the cleaning performance can be maintained since the conveyance of filth from the bowl part to the outside of the toilet bowl and the toilet bowl cleaning are carried out by the flushing water of the amplified flow rate and the increased instantaneous flow rate via the jet pump. Moreover, water economy is served since the additional flushing water is only the small amount of water actually jetted out through the actuation nozzle.

For convenience in the following description, the flushing water of the amplified flow rate and the increased instantaneous flow rate via the jet pump is referred to simply as flow-rate-amplified flushing water.

An ordinary water supply can serve as the water supply source; water from such a source is spouted from the actuation nozzle and it is not necessary to utilize negative pressure for maintenance of cleaning performance and realization of water economy. Therefore, the toilet bowl does not need to have a leak-tight structure or a pressure-resistant performance and it can be made of ordinary porcelain.

Moreover, any part jutting up above the toilet bowl, such as separate flushing unit can be eliminated. Therefore, a low-silhouette type toilet can be used, improving the degree of design freedom. Even if a sanitary cleansing apparatus mounted on the upper part of a toilet bowl to spout flushing water for cleansing the excretory parts, for example, there would be no constraints on the size or shape of such sanitary cleansing apparatus. The increased degree of freedom in overall designing of the toilet bowl and the peripheral, including the sanitary cleansing apparatus, enables provision of toilet bowls of a higher-class appearance.

In a second mode in accordance with the first mode, as for the actuation nozzle and the throat, a ratio of a diameter d of the actuation nozzle to a diameter D of the throat d/D ranges approximately from 0.3 to 0.7.

In a third mode in accordance with the first mode, the throat has a length L that is approximately two to six times a diameter D of the throat.

In these modes, the ejector effect that accompanies the water jetting out from the actuation nozzle is ensured and thus amplification of the flow rate and the increase in the instantaneous flow rate are ensured to be effected. Thus, water economy is ensured to be realized while the cleaning performance is maintained.

A fourth mode in accordance with the first further comprises:

water reservoir for storing water prior to a start of the filth conveyance and for utilizing the stored water as the provided flushing water; and a passage communicating member for making the water reservoir communicate with the throat.

In accordance with this mode, the water stored in the water reservoir is led to the throat via the passage communicating member and the jet water from the actuation nozzle involves the stored water to serve to the flow rate amplification and the instantaneous flow rate increment.

In a fifth mode in accordance with the fourth mode, the water reservoir is arranged below a toilet bowl rim surface.

In a sixth mode in accordance with the fifth mode, the water reservoir is formed so as to have a structure partly separated from the bowl part.

In a seventh mode in accordance with the sixth mode, the water reservoir has a structure that enables the pooled water pooled in the bowl part to be flown into the water reservoir.

In accordance with these modes, the flushing water spouted from the rim and the pooled water in the bowl part can be stored In the water reservoir and utilized as the driven fluid. This simplifies the construction by making it unnecessary to provide a special structure exclusively for storing water in the water reservoir.

In an eighth mode in accordance with the fourth mode, the water reservoir is detachably attached to the toilet bowl.

In accordance with this mode, replacement of the detachably attached water reservoir makes it possible to use water reservoirs of different capacities. Therefore, it is made possible to spout flushing water of a total flow rate that matches varied users of the toilets to the bowl part after the flow rate amplification and the instantaneous flow rate increment, and thus it is made possible with a smaller amount of flushing water to convey the filth efficiently and to clean the bowl part. For example, to compare the cases of a kindergarten and an office, young children who excrete small amounts of filth are the users of the toilets in the former case while adults who excrete large amounts of filth are the users in the latter case. Thus, the toilet in the former case may be fitted with a smaller capacity water reservoir so as to make a total flow rate of the flushing water at the time of spouting the flushing water smaller than the toilet in the latter case. Consequently, water consumption can be economized more effectively.

A ninth mode in accordance with the first mode further comprises a waste trap for draining the pooled water pooled in the bowl part to the outside. The jet pump is disposed at a rising point of an upstream tube of the waste trap and oriented toward a flow path of the upstream tube.

In this mode, the flow-rate-amplified flushing water is spouted from the rising point in the upstream tube of the waste trap along the flow path of the upstream tube. Moreover, as the bowl part and the upstream tube of the waste trap are connected, the pooled water in the bowl part becomes involved in and conveyed with the flow of the flow-rate-amplified flushing water. That is, the flow-rate-amplified flushing water flows into the upstream tube at the rising point thereof along the flow path. As the result, the flow-rate-amplified flushing water quickly fills the upstream tube and the flow path downstream thereof, positively generating siphon effect in the waste trap at an early stage.

Since the flow-rate-amplified flushing water is a jet flow which involves the flushing water, a broad flow centering by the jet water from the actuation nozzle. Thus, any filth existing even in the vicinity of the actuation nozzle of jet pump can be moved along the upstream tube together with the surrounding water. For this reason, the filth in the bowl part is ensured to be conveyed irrelevant to the amount thereof to clean the toilet bowl. In addition, water economy is naturally served by the fact of only the spout of the flushing water from the actuation nozzle is utilized for the filth conveyance and the toilet bowl cleaning.

In a tenth mode in accordance with the ninth mode, as for the throat and the upstream tube, a ratio of a diameter D of the throat to a diameter K of the upstream tube D/K ranges approximately from 0.3 to 0.6.

Flow rate amplification by involvement of the pooled water pooled in the bowl part can be regarded as being produced by a virtual jet pump in which the throat is assumed as the actuation nozzle and the upward tube assumed as the throat. As such, in accordance with this mode, since the ratio of the diameter of the throat to the diameter of the actuation nozzle in the virtual jet pump will be within a range approximately from 0.3 to 0.6, the flow rate amplification and the instantaneous flow rate increment are ensured to be effected efficiently. Consequently, the filth conveyance and the toilet bowl cleaning are carried out more reliably.

In an eleventh mode in accordance with the fourth mode, the passage communicating member comprises switching means for switching the communication state of the water reservoir and the throat between communicating and non-communicating.

In this mode, when the water reservoir and the throat are in the communicating state, the filth conveyance and the toilet bowl cleaning are carried out by the flushing water with involvement of water reservoir water for the flow rate amplification and the instantaneous flow rate increment. When the water reservoir and the throat are in the non-communicating state, the filth conveyance and the toilet bowl cleaning are carried out by the flushing water spouted to the bowl part without involvement of the flushing water for the flow rate amplification and the instantaneous flow rate increment. Thus, spouting manner of the flushing water is selectable through switching between the communication states of the water reservoir and the throat.

In a twelfth mode in accordance with the eleventh mode, the switching means comprises means for selectively switching between the communication states, communicating and non-communicating.

This mode enables selection of manners the flushing water is spouted; if only urine has to be flushed, the non-communicating state may be selected to cause only the flushing water from the actuation nozzle to be spouted to the bowl part while the communicating state may be selected at the time of defecation to cause the flow-rate-amplified flushing water to be spouted.

In a thirteenth mode in accordance with the eleventh mode, the switching means switches the passage communication state to a non-communicating state when no water exists in the water reservoir.

In this mode, no water is jetted out through the actuation nozzle in such a manner that jet water through the actuation nozzle involves air in the empty water reservoir. Therefore, the spouting of the flushing water with involvement of the flushing water inside the water reservoir cannot be changed into the spouting of the flushing water with involvement of the air in place of the flushing water. For this reason, the siphon effect that has been started by the spouting of flushing water with involvement of the flushing water cannot be interrupted by entrance of air mixture. Therefore, the siphon effect cannot be extinguished unexpectedly and thus the filth will not return to the bowl part.

In a fourteenth mode of the toilet in accordance with the present invention described above, the amplification means comprises a jet pump for jetting out a mixture of both a driving fluid which represents water being supplied from a water supply source and a driven fluid which represents the air. This jet pump comprises an actuation nozzle for jetting out the water supplied from the water supply source and a throat which defines a flow path of both the fluids in relation to the actuation nozzle and which leads both the fluids to the water spout member.

In this mode, a jet water from the actuation nozzle causes an ejector effect when passing through the throat as the driving fluid and forms a jet flow with involvement of air as the driven fluid. That is, the involvement of the air serves to the flow rate amplification and the instantaneous flow rate increment. Therefore, even when the water amount supplied from the water supply source is small, the supplied water is led from the throat to the water spout member so as to be spouted in the state of the flow rate amplification and the instantaneous flow rate increment with involvement of air. Consequently, the cleaning performance can be maintained since the conveyance of filth from the bowl part to the outside of the bowl part and the toilet bowl cleaning are carried out by the flow-rate-amplified flushing water. Moreover, water economy is served since the additional flushing water is only the small amount of water actually jetted out through the actuation nozzle. Water economy is also served since any flushing water is needed to be provided as the driven fluid.

In a fifteenth mode in accordance with the fourteenth mode, the throat comprises air intake shut-off means for allowing the air intake while the actuation nozzle is supplied with water and for shutting off the air intake while not supplied with water.

During no supply of water, the toilet is not being used and water is pooled in the bowl part. During this time, no air is led. For this reason, it is preferable that flushing water around the throat and thus water pooled in the bowl part do not flow out through the air intake part.

In a sixteenth mode in accordance with the first mode, the jet pump is arranged so as to allow a jet fluid mixture to flow into the bowl part.

This mode enables the bowl part itself, for example, the surface of the bowl part, to be cleaned by the flow-rate-amplified flushing water. The toilet bowl is thus cleaned when the flow-rate-amplified flushing water flows into the bowl part and conveys the filth in the bowl part to the outside.

In a seventeenth mode in accordance with the sixteenth mode, the jet pump is arranged so as to jet out the fluid mixture to a rim channel, which is disposed around an upper edge of the bowl part and flushes down the flushing water to the bowl part.

In accordance with this mode, the surface of the bowl part is cleaned by the flow-rate-amplified flushing water falling through the rim channel on the upper rim of the bowl part. On reaching the pooled water in the bowl part, the flow-rate-amplified flushing water conveys the filth and cleans the toilet bowl.

In an eighteenth mode in accordance with the seventeenth mode, the jet pump is arranged so as to jet out the fluid mixture in an oblique direction with respect to the rim channel.

In accordance with this mode, when the flow-rate-amplified flushing water is jetted out into the rim channel, since the jetting direction thereof is oblique, a loss of jetting pressure can be suppressed. For this reason, the flow-rate-amplified flushing water may be flushed downward through the rim channel with suppression of energy loss, the surface of the bowl part can be cleaned more effectively.

In this case, if the rim channel is provided with an outlet which is inclined obliquely to the bowl part, the flushing water reaches the pooled water while swirling on the surface of the bowl part, and the swirling movement is transmitted to the pooled water. So that, the pooled water is swirled to enhance the drainage efficiency and a siphon effect in the waste trap is generated efficiently at an early stage. Consequently, the filth is conveyed more efficiently.

In a nineteenth mode in accordance with the sixteenth mode, the jet pump is arranged so as to jet out the fluid mixture directly into the bowl part.

This mode serves to utilize the flow-rate-amplified flushing water for clean the bowl part itself. In addition, since the flow-rate-amplified flushing water flows directly into the pooled water in the bowl part, the filth in the bowl part is ensured to be conveyed to clean the toilet bowl by the flow-rate-amplified flushing water.

In a twentieth mode in accordance with the nineteenth mode, the jet pump is arranged so as to jet out the fluid mixture in a specific direction that causes a vortex flow of the pooled water pooled in the bowl part.

In this mode, since a vortex flow is effected efficiently in the pooled water by jetting out the flow-rate-amplified flushing water, the efficiency in the filth conveyance is enhanced.

In a twenty-first mode in accordance with the twentieth mode, the jet pump is arranged so as to jet out the fluid mixture from a place above a liquid surface of the pooled water to cause a vortex flow in the pooled water.

In this mode, the surface of the bowl part above the liquid surface can be cleaned efficiently by the flow-rate-amplified flushing water.

A twenty-second mode in accordance with the sixteenth mode comprises a waste trap for draining the pooled water in the bowl part to the outside. The jet pump is arranged so as to orient toward an inlet of the waste trap via the bowl part.

In accordance with this mode, the actuation nozzle of the jet pump jets out high-velocity and high-pressure water having energy approximately the same as the water supply source pressure (normally 1 to 2 kgf/cm$^2$). This high-velocity and high-pressure jet water causes an ejector effect, forming a jet flow that involves the flushing water which has been provided beforehand as the driven fluid, and flows directly toward the inlet of the waste trap via the bowl part. As the result, the flushing water flows into the inlet of the waste trap via the bowl part in a state of flow rate amplification and the instantaneous flow rate increment by the output of the jet flow from the jet pump. This mode also realizes maintenance of the cleaning performance and water economy since a total water consumption can be reduced. Other favorable effects include that it improves the degree of design freedom.

A twenty-third mode in accordance with the twenty-second mode comprises water reservoir which is formed so as to have a structure partly separated from the bowl part for storing water beforehand prior to a start of the filth conveyance and for utilizing such stored water as the provided flushing water. The water reservoir has a structure that enables the pooled water pooled in the bowl part to be flown into the water reservoir.

In accordance with this mode, the structure wherein the water reservoir is separated from the bowl part increases the bowl part design freedom, allowing a structure wherein these two of close resemblance may constitute a toilet bowl and thus adoption of the low-silhouette type has no structural obstructions. The pooled water in the bowl part can be stored in the water reservoir and utilized as a driven fluid. As the result, by eliminating the need for a special structure to store water in the water reservoir, it also simplifies the structure. In addition to the pooled water that flows in, water that drains normally from the rim to provide the pooled water may be designed so as to flow into the water reservoir.

A twenty-fourth mode in accordance with the twenty-second mode further comprises:

water reservoir which is formed so as to have a structure partly separated from the bowl part for storing water prior to a start of the filth conveyance and for utilizing the stored water as the provided flushing water; and a water conduit for making the bowl part communicating with the water reservoir, in order to allow a flow of the pooled water pooled in the bowl part, the water conduit comprising a spout that faces the inlet of the waste trap on the side of the bowl part, wherein the jet pump comprises the water conduit as the throat, and the actuation nozzle is disposed in the water conduit.

In this mode, pooled water in the bowl part may be stored in the water reservoir via the water conduit and utilized as a driven fluid. Inside this water conduit, the flushing water is jetted through the actuation nozzle under such a high pressure as described above. The jet water from the actuation nozzle causes an ejector effect with the water conduit, which functions as a throat. That is, the jet water from the actuation nozzle flows through the water conduit as a jet flow, involving a large volume of water inside the water reservoir through the water conduit and spouted from the outlet directly toward the inlet of the waste trap. As the result, the flow-rate-amplified flushing water flows into the waste trap with the jet flow by the jet pump. Therefore, a strong cleaning performance and high water economy are realized also in this mode. Since negative pressure is not utilized at this time, though it is a conventional way, the bowl part can be formed of ordinary porcelain, as described above.

In a twenty-fifth mode in accordance with the twenty-second mode the water reservoir comprises an opening which is formed so as to face the inlet of the waste trap in the bowl part and defines a flow path of a fluid. The actuation nozzle of the jet pump is arranged in the water reservoir so as to be oriented toward the inlet of the waste trap via the opening of the water reservoir.

In this mode, when the above-described high-velocity and high-pressure flushing water from the actuation nozzle passes the opening of the water reservoir, the above flushing water causes an ejector effect with the opening functioning as a throat. Therefore, the flushing water from the actuation nozzle involves a large volume of water in the water reservoir and forms a jet flow that is spouted directly through the opening toward the inlet of the waste trap. As the result, the flow-rate-amplified flushing water is supplied into the inlet of the waste trap by the jet pump also in this mode, so that strong cleaning performance and high water economy are realized. The toilet bowl can be formed of ordinary porcelain naturally.

In a twenty-sixth mode in accordance with the twenty-fifth mode, the water reservoir is arranged below the bowl part across a wall member which constitutes the bowl part.

In this mode, a closed space is formed with the wall member and the outer wall member of the pedestal, which supports the bowl part, and such closed space is readily utilized as the water reservoir of flushing water. Such the water reservoir can be formed even more readily by integrally forming the bowl part and the water reservoir.

In a twenty-seventh mode in accordance with the twenty-sixth mode, an inner wall surface of the water reservoir forms a slope inclined toward the actuation nozzle.

In this mode, any foreign matter entering the water reservoir, for example from the bowl part, moves down along the inside wall surface of the water reservoir toward the actuation nozzle. So that, when the flushing water is jetted from the actuation nozzle, foreign matter around the actuation nozzle flows out from the water reservoir together with water in the water reservoir. Therefore, the foreign matter is restrained from residing in and polluting the water reservoir.

A twenty-eighth mode in accordance with the twenty-fifth mode further comprising a tubular body arranged to open to the opening of the water reservoir and face the actuation nozzle, in order to enable the water jetted out of the actuation nozzle to flow in and pass through the tubular body. This tubular body has an opening that joins the flushing water existing in the water reservoir with the water jetted out of the actuation nozzle.

With this mode, the jet flow from the actuation nozzle through the tubular body ensures an ejector effect to be caused, and the ejector effect enables involvement of the flushing water inside the water reservoir to flow through the opening of the tubular body. For this reason, the flow of the flushing water running toward the inlet of the waste trap is ensured to be in the state of jetting of the jet flow by the jet pump and thus the cleaning performance maintenance and the water economy can be realized.

In a twenty-ninth mode in accordance with the twenty-eighth mode the actuation nozzle and the tubular body are integrated with each other and fixed to the water reservoir.

This mode simplifies the attachment of the actuation nozzle and the tubular body to the toilet bowl and also makes handling easier.

In a thirtieth mode in accordance with the twenty-second mode, a plurality of the jet pumps are arranged to be oriented toward the inlet of the waste trap.

In a thirty-first mode in accordance with the twenty-second mode, the jet pump comprises a water supply conduit for supplying water from the water supply source, a plurality of actuation nozzles branched out from such water supply conduit, and a plurality of throats respectively corresponding to the plurality of such actuation nozzles.

In these modes, the flushing water after flow the rate amplification and the instantaneous flow rate increment by the jet pump flows into the inlet of the waste trap from a plurality of points. This provides good coverage of the whole opening area of the inlet, producing a high cleaning performance.

In a thirty-second mode in accordance with the sixteenth mode, at least two of the jet pumps are arranged so as to enable a spout of the fluid mixture to be flown into the bowl part.

This mode enables the bowl part to be cleaned by jets of water respectively from the jet pumps.

In a thirty-third mode in accordance with the thirty-second mode, one of the jet pumps is arranged so as to jet out the fluid mixture to a rim channel, which is disposed around an upper edge of the bowl part and flushes down the flushing water to the bowl part. The other of the jet pumps is arranged so as to jet out the fluid mixture directly into the bowl part.

In this mode, jet water flow from one jet pump is used to clean the bowl part surface via the rim channel. Jet water flow from the other jet pump cleans the bowl part surface.

A thirty-fourth mode in accordance with the thirty-third mode further comprises:

a waste trap for draining the pooled water pooled in the bowl part to the outside, wherein the other jet pump is arranged so as to be oriented toward an inlet of the waste trap.

This mode allows the jet flow water from one jet pump to be used to clean the bowl part surface through jetting of fluid from the rim channel. The jet flow water jetted out by the other jet pump carries out the conveyance of filth in the bowl part and the toilet bowl cleaning.

A thirty-fifth mode in accordance with the thirty-fourth mode further comprises supply switching means for consecutively switching the destination of water supply from the water supply source, from the one jet pump to the other jet pump.

This mode allows consecutive switching from the bowl part surface cleaning by one jet pump to the filth conveyance from the bowl part and the toilet bowl cleaning by the other jet pump.

In a thirty-sixth mode in accordance with the thirty-fifth mode, the supply switching means comprises means for switching the destination of water supply from the water supply source, from the other jet pump to the one jet pump again, after having switched to the other jet pump.

In accordance with this mode, after the bowl part surface cleaning by one jet pump and the filth conveyance from the bowl part and the toilet bowl cleaning by the other jet pump are having been carried out consecutively, the bowl part surface cleaning by one jet pump can be carried out again, and the flushing water used at this time can be pooled as the pooled water in the bowl part.

In a thirty-seventh mode of the toilet in accordance with the present invention, the amplification means comprises multi-stage amplification means for amplifying the flow rate of the flushing water in a multi-stage manner.

In a thirty-eighth mode in accordance with the thirty-seventh mode, the multi-stage amplification means comprises a jet pump for jetting out a mixture of both a driving fluid which represents water being supplied from a water supply source and a driven fluid which represents flushing water provided for conveyance of the filth in the bowl part. This jet pump comprises an actuation nozzle for jetting out the water supplied from the water supply source, a first throat arranged so as to correspond to such actuation nozzle for defining a flow path of both the fluids, and a second throat arranged so as to face such first throat for leading the provided flushing water to the water spout member with involvement into the fluid mixture which has passed through the first throat.

With these modes, even if involvement loss may occur in the water jetted out by the actuation nozzle at respective stages of flow rate amplification, this loss can be compensated by flow rate amplification at the next stage. Thus, flushing water is jetted out after the flow rate amplification at the final stage in a state wherein the involvement loss has been reduced by the flow rate amplification at multiple stages. For this reason, the flushing water after more effective flow rate amplifications and thus a further improvement in the filth conveyance efficiency and improvement in the toilet bowl cleaning performance can be realized.

In a thirty-ninth mode of the toilet in accordance with the present invention, the amplification means comprises a jet pump for jetting out a mixture of both a driving fluid which represents the air being supplied from an air source and a driven fluid which represents flushing water provided for conveyance of the filth in the bowl part. This jet pump comprises an actuation nozzle for jetting out the air supplied from the air source and a throat which defines a flow path of both the fluids in response to the actuation nozzle and which leads both the fluids to the water spout member.

In this mode, the actuation nozzle jets out high-velocity and high-pressure air which has energy of air pressure (normally 1 to 2 kgf/cm$^2$) approximately the same as the air source. This high-velocity and high-pressure jet air causes an ejector effect when passing through the throat as the driving fluid and forms a jet flow which involves the flushing water provided beforehand. Moreover, spouting of the jet flow increases the instantaneous flow rate at that time. For this reason, the flushing water provided beforehand is led from the throat to the water spout member and spouted in the state of the flow rate amplification and the instantaneous flow rate increment with involvement in the jetted air. That is, since conveyance of filth in the bowl part to the outside of the toilet bowl and cleaning of the toilet bowl are realized by the air mixed with the flushing water after flow rate amplification and instantaneous flow rate increment, the cleaning performance can maintained. Moreover, water does not have to be used as the driving fluid, so the only flushing water needed for filth conveyance is a small amount of the flushing water provided beforehand. The further water economization can be thus realized.

Additionally, no water supply to the actuation nozzle is needed for realization of the flow rate amplification and instantaneous flow rate increment of the flushing water. Therefore, even where the available service water supply pressure is low, for example about 0.3 kgf/cm$^2$, either regularly or seasonally, high cleaning performance and water economy can still be realized with this mode. Consequently, expansion of the installation areas of low-silhouette type toilets can be realized.

This mode can also be implemented as a low-silhouette type toilet which has a high degree of design flexibility. The increased degree of freedom in overall designing of the toilet bowl and the peripheral, including the sanitary cleansing apparatus, enables provision of toilet bowls of a higher-class appearance.

A fortieth mode in accordance with the first mode further comprises:

pressurizing means for pressuring the water supplied from the water supply source, wherein the jet pump comprises an actuation nozzle for jetting out the water pressurized by the pressurizing means.

In this mode, water supplied from the water supply source is pressurized prior to being jetted out through the actuation nozzle. Therefore, a high-velocity and high-pressure water thus pressurized is jetted out through the actuation nozzle to realize the flow rate amplification and instantaneous flow rate increment through involvement of the flushing water provided beforehand into the jet water and then the flushing water is spouted in this state. For this reason, even where the available service water supply pressure or the available service water flow rate is low, regularly or seasonally, as described above, this mode can realize high cleaning performance and high water economy. Consequently, expansion of the installation areas of low-silhouette type toilets can be realized.

A forty-first mode in accordance with the first mode further comprises:

pressurizing means for pressuring the water supplied from the water supply source when the supply source has a low supply pressure, wherein the jet pump comprises:

a first actuation nozzle for directly jetting out the water supplied from the water supply source;

a second actuation nozzle for jetting out the water pressurized by the pressurizing means; and selection means for selecting one of the first and second actuation nozzles according to the supply pressure of the water supply source.

In accordance with this mode, when the water is jetted out through the actuation nozzle, the water supplied from the water supply source is pressurized prior to being jetted out in case of a low supplied water pressure and the first actuation nozzle jets out water of a high velocity and a high pressure through this pressurization. After the flow rate amplification and instantaneous flow rate increment through involvement of the flushing water provided beforehand into the jet water, the flushing water is spouted in this state. On the contrary, in case of a high supplied water pressure, the water from the supply source is jetted out through the second actuation nozzle as it is at that high supplied water pressure to realize the flow rate amplification and the instantaneous flow rate increment. Both of these actuation nozzles are utilized to be selected according to the supplied water pressures. For this reason, this mode realizes high cleaning performance and water economy regardless of occurrence of a low supplied water pressure. Since the water needs to be pressurized only when the supplied water pressure is low, reduction in the amount of energy needed for the pressurization can be realized. In practice, a pressurizing equipment may be used intermittently or temporarily when required and thus energy consumption can be saved.

A forty-second mode in accordance with the first mode further comprises:

mixing means for mixing the water supplied from the water supply source with pressurized air, wherein the jet pump comprises an actuation nozzle for jetting out water mixed with the pressurized air by the mixing means.

In this mode, the water from the water supply source is mixed with pressurized air prior to being jetted out through the actuation nozzle. Therefore, a high-velocity and high-pressure water thus mixed with pressurized air is jetted out through the actuation nozzle to realize the flow rate amplification and instantaneous flow rate increment through involvement of the flushing water provided beforehand into the jet water and then the flushing water is spouted in this state. For this reason, even where the available service water supply pressure or the available service water flow rate is low, regularly or seasonally, as described above, this mode can realize high cleaning performance and high water economy. Consequently, expansion of the installation areas of low-silhouette type toilets can be realized.

In a forty-third mode in accordance with the forty-second mode, the mixing means comprises means for mixing the supplied water with the pressurized air when the supply source has a low pressure.

In accordance with this mode, when the water is jetted out through the actuation nozzle, the water supplied from the water supply source is mixed with the pressurized air prior to being jetted out in a case of a low supplied water pressure. Therefore, the actuation nozzle jets out water of a high velocity and a high pressure through this pressurized air mixing in the case of a low supplied water pressure. After the flow rate amplification and instantaneous flow rate increment through involvement of the flushing water provided beforehand into the jet water, the flushing water is spouted in this state. On the contrary, in case of a high supplied water pressure, the water from the supply source is jetted out through the actuation nozzle as it is at that high supplied water pressure to realize the flow rate amplification and the instantaneous flow rate increment. For this reason, this mode also realizes high cleaning performance and water economy regardless of occurrence of a low supplied water pressure. Since the water needs to be mixed with pressurized air only when the supplied water pressure is low, reduction in the amount of energy needed for the air pressurization and the mixing thereof can be realized. In practice, a pressurizing equipment may be used intermittently or temporarily when required and thus energy consumption can be saved.

A forty-fourth mode in accordance with the first mode further comprises:

water reservoir for storing water prior to a start of the filth conveyance and for utilizing the stored water as the provided flushing water, wherein a ratio of an amount TW of water stored in the water reservoir to an amount BW of water existing in the bowl part TW/BW ranges approximately from 0.25 to 0.35.

The siphon effect generated in the waste trap extinguishes when water in the bowl part runs out after the bowl part water having drawn into the upstream tube of the waste trap. Immediately before extinguishment of the siphon effect, a blow effect is produced that draws floating filth of small specific gravity into the waste trap together with the flushing water. In this mode, through adjustment of the water storage amount of the water reservoir TW to be within the above range, the termination of jetting out of flushing water via the jet pump is made to coincide with the extinguishment of the siphon effect, so that flushing water in the water reservoir runs out at the same time the siphon effect extinguishes. Therefore, this mode ensures that the bowl part runs out of water when the siphon effect extinguishes, and thus the above-described blow effect can be actually enhanced.

BRIEF DESCRIPTION OF DRAWINGS

FIG. 11 is a table of results of experimental measurements relating to the jetting out manner of flushing water in the toilet 100.

BEST MODE FOR CARRYING OUT THE INVENTION

Figure 1:
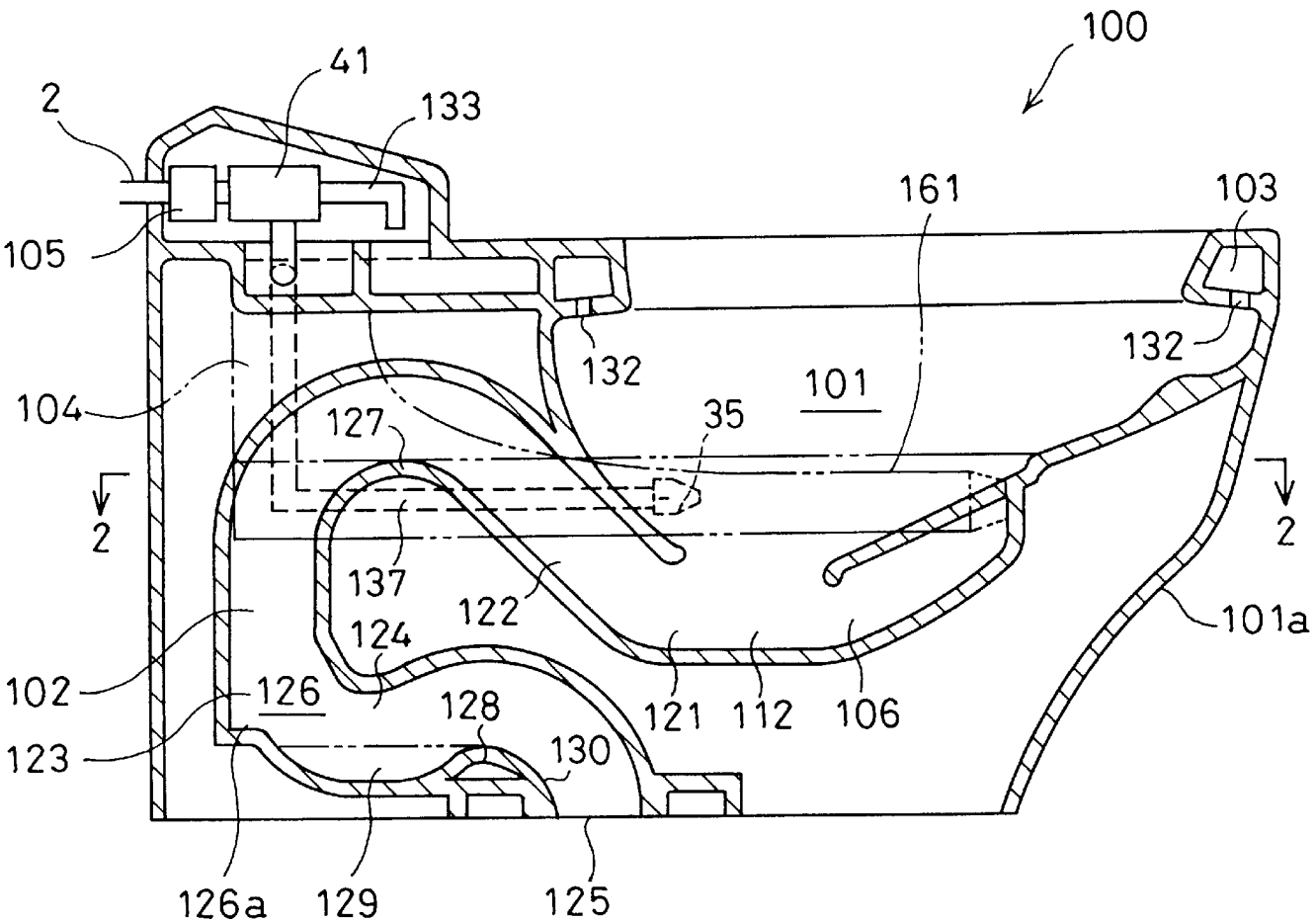
FIG. 1 is a simplified cross-sectional view of a toilet 100 according to a first embodiment of the present invention.

Modes of carrying out the present invention will now be described with reference to the embodiments. To start with, a first embodiment is described. The toilet of the first embodiment is a low-silhouette type toilet which does not have a separate flushing water tank. The toilet 100 has a bowl part 101 disposed slightly to the front of the bowl part main body 101*a*. An inlet 121 of a waste trap 102 opens in the back wall of a filth hopper part 112 at the bottom of the bowl part 101. A Z waterspout outlet(flushing water outlet) 106 opens in the front wall of the filth hopper part 112 so as to face the inlet 121 of the waste trap 102. When flushing water is spouted out of the Z waterspout outlet 106, a jet water cleaning is carried out, whereby filth in the bowl part 101 is conveyed out through the waste trap 102 with the flushing water and thus the toilet bowl is cleaned.

Provided around the upper rim of the bowl part 101 is a rim channel 103 for spouting flushing water along the inner wall surface of the bowl part 101. When flushing water is spouted out of the rim channel 103, a rim water cleaning is carried out, whereby the inner wall surface of the bowl part 101 is cleaned. A flushing water reservoir 104 is formed on the side of the back wall of the filth hopper part 112 arranged so as not to interfere with the waste trap 102. More specifically, the flushing water reservoir 104 is formed as an integral part of the bowl part main body 101*a*, set off from the bowl part 101 by the back wall thereof.

The flushing water reservoir 104 communicates with the bowl part 101 by a Z water conduit 161 (flushing water conduit) that extends to the Z waterspout outlet 106. Thus, if flushing water exists in the bowl part 101, the flushing water can also flow into the flushing water reservoir 104 via the Z waterspout outlet 106, allowing water to be stored in the flushing water reservoir 104 to the same height as the pooled water pooled in the bowl part 101. Therefore, although the flushing water reservoir 104 has a capacity of some 2 to 2.5 liters, in this case the volume of flushing water stored in the flushing water reservoir 104 is about 0.5 liters. That is, the volume of water stored in the flushing water reservoir 104 is about one-fourth the 2 liters normally existing in the bowl part 101.

A water supply valve 105, which is connected to a feed water pipe 2, and a switching valve 41 on the downstream side thereof are provided over the flushing water reservoir 104. The water supply valve 105 is a solenoid valve which has a structure wherein, when a cleaning button on a remotely located control panel which is not shown in the figure is pressed, the water duct is opened for a prescribed period of time on reception of an infrared beam. The water supply valve 105 normally closes the feed water pipe 2. On the other hand, the switching valve 41 is arranged so as to switch the destination of the flushing water supply from the feed water pipe 2 sequentially between a connection tube 137 that extends from the flushing water reservoir 104 to Z water conduit 161, and a water supply conduit 133 for jetting flushing water to the rim channel 103. This switching between the destinations of the flushing water supply allows the above-described rim water cleaning to be followed by a jet water cleaning which is to be followed by rim water cleaning again.

The structure used to clean the toilet 100 of this embodiment will now be described, together with the toilet bowl cleaning operation, and this will be followed by a detailed description of the structure and operation of the switching valve 41.

When the cleaning button for cleaning the bowl part is pressed, the switching valve 41 switches the flow of flushing water to the water supply conduit 133 connected to the rim channel 103. As the result, the flushing water coming through the water supply valve 105 is fed to the rim channel 103 via the water supply conduit 133, the cleaning operation using water falling from the rim starts. More specifically, from rim water outlets which are disposed on the underside of the rim channel 103 at appropriate intervals, flushing water is spouted along the inner wall surface of the bowl part and the inner wall surface of the bowl part is cleaned by such flushing water. After the rim water cleaning is carried out, the switching valve 41 switches the supply destination of flushing water to the connection tube 137. The flushing water coming through the water supply valve 105 is fed to the spout nozzle 35 via the connection tube 137 and then spouted through the spout nozzle 35. Therefore, the jet water cleaning is started after the rim water cleaning, and the filth is drained as described below.

Figure 2:
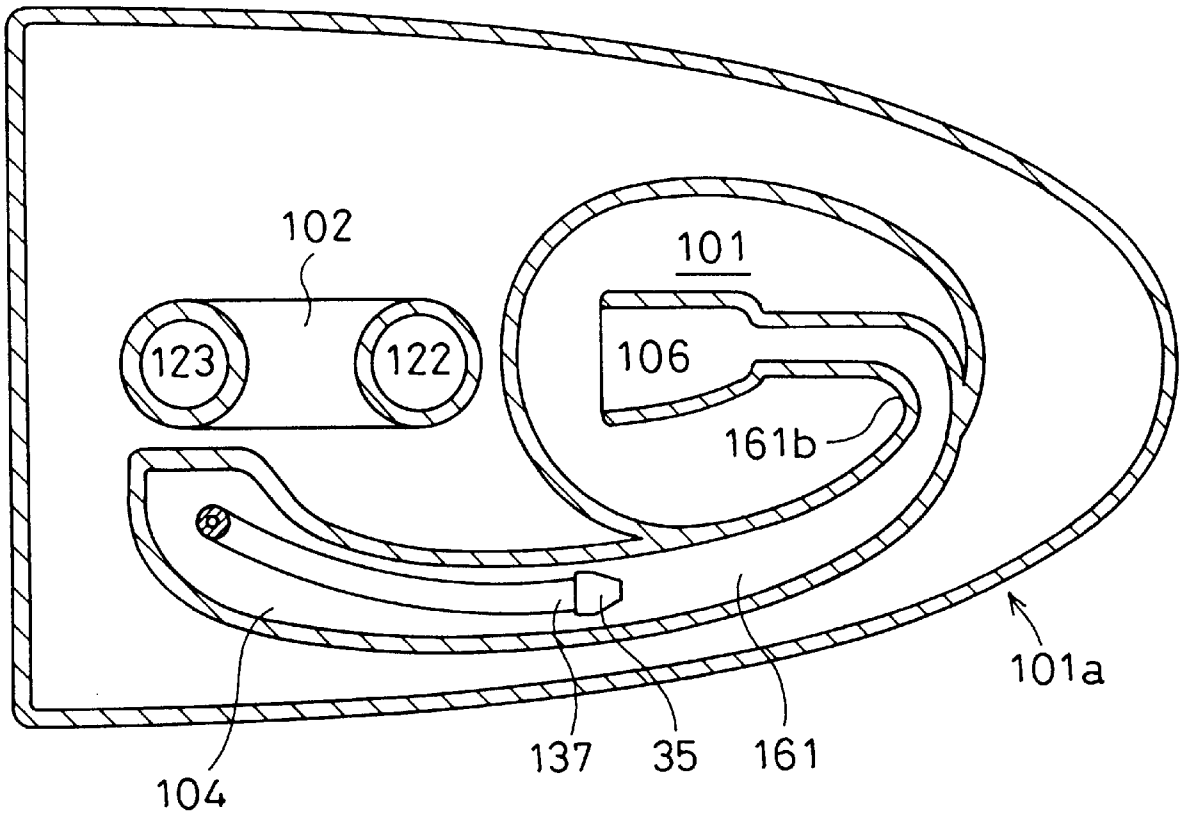
FIG. 2 is a simplified cross-sectional view along line 2—2 in FIG. 1.

As shown in FIG. 2, the spout nozzle 35 on the front end of the connection tube 137 is disposed inside the Z water conduit 161, where it is oriented in approximately the same direction as the Z water conduit 161. The Z water conduit 161 functions as a throat defining the flow path of water jetted out from the spout nozzle 35 and flushing water in the flushing water reservoir 104. Thus, when the switching valve 41 switches the water supply destination to the connection tube 137, flushing water flows out from the spout nozzle 35 at a high pressure (1 to 2 kgf/cm$^2$) approximately the same as the pressure on the primary side (the water service utility pressure). The spout nozzle 35 for jetting out the water supplied from the feed water pipe 2 and the Z water conduit 161 for defining the flow path of the flushing water and leading the flushing water to the Z waterspout outlet 106 together constitute a jet pump. A heavy flow is created consisting of water jetted out by the spout nozzle 35 mixed with water in the Z water conduit 161 and in the flushing water reservoir 104 connected to the Z water conduit 161. The mixture jetted out by the jet pump passes through the Z water conduit 161 and spouts from the Z waterspout outlet 106 toward the inlet 121 of the waste trap 102. Therefore, an enormous volume of flow-rate-amplified flushing water is supplied all at once to the waste trap 102. That is, the spout of flushing water for cleaning the bowl part 101 is water from the spout nozzle 35 that flows into the bowl part 101 as a flow-rate-amplified flushing water. The large volume of flushing water flushes any filth in the filth hopper part 112 out into the waste trap 102 and then, as described below, drained from the waste trap 102. Near the front of the bowl part main body 101*a* the Z water conduit 161 has a 180-degree Z bend 161*b* toward the Z waterspout outlet 106, and the Z bend 161*b* has a radius of curvature of about 20 to 30 mm. So there is little loss from the change in flow direction at the Z bend 161*b*.

The waste trap 102 is connected to the inlet 121 of the filth hopper part 112 and has an upstream tube 122, a downstream tube 123 and a horizontal draw channel 124, forming a continuous, curved flow path. From the inlet 121 the upstream tube 122 extends obliquely upward along the back surface of the bowl part 101 toward the rear of the bowl part main body 101*a*. The downstream tube 123 extends vertically down from the upper end of the upstream tube 122. From the end of the downstream tube 123, the horizontal draw channel 124 extends horizontally forward in the direction of the bowl part main body 101*a*, ending in a waste outlet 125 that opens in a vertical direction. If water is separated at a ridge part 127 which is a part connecting the upstream tube 122 and the downstream tube 123, the separated water dashing against the back wall of the downstream tube 123 (in FIG. 1, the wall on the left) becomes turbulent and involves air toward the back wall, preventing prompt drainage of the air. To minimize the possibility of such separation happening at the ridge part 127, the ridge part 127 has a radius of curvature of 35 to 75 mm (0.6 to 1.4 times the 55 mm diameter of the waste trap), preferably 55 to 65 mm (1.0 to 1.2 times the diameter of the waste trap).

The waste trap 102 has a double-seal construction wherein seals are formed at two points on the way thereof, and a siphon promotion part 126 is formed at the lower end of the downstream tube 123 for promoting generation of the siphon effect in the waste trap 102. The seals prevent the siphon effect from being broken.

The siphon promotion part 126 is designed so that water coming in beyond the ridge part 127 at the upper end of the upstream tube 122 may collide with the downstream tube 123 and so that as much of this water as possible will be held in the downstream tube 123. The siphon promotion part 126 promotes the siphon effect by thus keeping the waste trap 102 to be filled fully with water. As part of this, the siphon promotion part 126 has a flat stepped part 126*a* which extends horizontally inside the downstream tube 123 at the lower end thereof. The length of the flat stepped part 126*a* is 10 to 25 mm (0.18 to 0.45 times the 55 mm diameter of the waste trap).

The horizontal draw channel 124 curves upward, with the peak of the curve forming a second ridge part 128, and a water pool part 129 for holding water just before the peak. The horizontal draw channel 124 is formed so that when there is water in the water pool part 129, there is 25 to 35 mm of air space above the water (0.45 to 0.65 times the 55 mm diameter of the waste trap). Downstream of the second ridge part 128, the horizontal draw channel 124 curves immediately downward with the curved part 130 connecting to the waste outlet 125.

The downstream tube 123 is approximately cylindrical and 100 to 150 mm long (1.8 to 2.7 times the 55 mm diameter of the waste trap), measured from the ridge part 127. The water pool part 129 is directly beneath the downstream tube 123. The downstream tube 123 length of not more than 150 mm means that water coming over the ridge part 127 does not strike against the back wall of the downstream tube 123 before reaching the siphon promotion part 126, so air can be rapidly drained off. Making the length at least 100 mm ensures that the water falling into the siphon promotion part 126 has sufficient kinetic energy. This ensures that the siphon effect is generated, enhancing the filth drainage effect.

The siphon promotion part 126 at the flat stepped part 126*a* functions to compensate the direction of the flow. The positioning of the flat stepped part 126*a* is extremely important and which is, as shown in the drawing, positioned at the intersection of the downstream tube 123 and the horizontal draw channel 124. When a continuous transition is used from the downstream tube 123 to the horizontal draw channel 124 in the form of a curve, the velocity of the water is changed by the curve, resulting in a non-uniform flow velocity distribution along the path. The flat stepped part 126*a* controls this change in velocity and provides a correction to the disturbance in flow velocity distribution. The flat stepped part 126*a* accomplishes this most effectively and enables rapid drainage of air in the waste trap 102 when it is located at a point equivalent to two-thirds the height of the air space in the horizontal draw channel 124, or about 10 to 20 mm from the top of the horizontal draw channel 124.

It is disadvantageous to locate the flat stepped part 126*a* higher than the intersection between the downstream tube 123 and the horizontal draw channel 124. At the continuous transition from the downstream tube 123 to the horizontal draw channel 124 in the form of a curve, the uniformity of the flow velocity distribution is disturbed. Horizontal deflection of the water flow blocks the waste trap 102, impeding the growth of the siphon effect. On the contrary, lowering the position of the flat stepped part 126*a* reduces the flow compensation effect.

The curved part 130 is given a large radius of curvature of 40 to 65 mm (0.7 to 1.2 times the 55 mm diameter of the waste trap), preferably 45 to 55 mm (0.8 to 1.0 times the 55 mm diameter of the waste trap). The opening of the waste outlet 125 is at the same level as the bottom surface of the bowl part main body 101*a*, and the waste channel is extended as much as possible inside the bowl part main body 101*a*. In this embodiment, the radius of curvature of the curved part 130 is 55 mm (1.0 times the 55 mm diameter of the waste trap).

When the jet cleaning by the jet of flushing water that flushes filth through the waste trap 102 has been completed, the switching valve 41 switches the supply connection back to the water supply conduit 133. As the result, flashing water is fed to the rim channel 103, the rim water cleaning starts again. This flushing water from the rim water outlets 132 becomes the pooled water in the bowl part 101.

Figure 3:
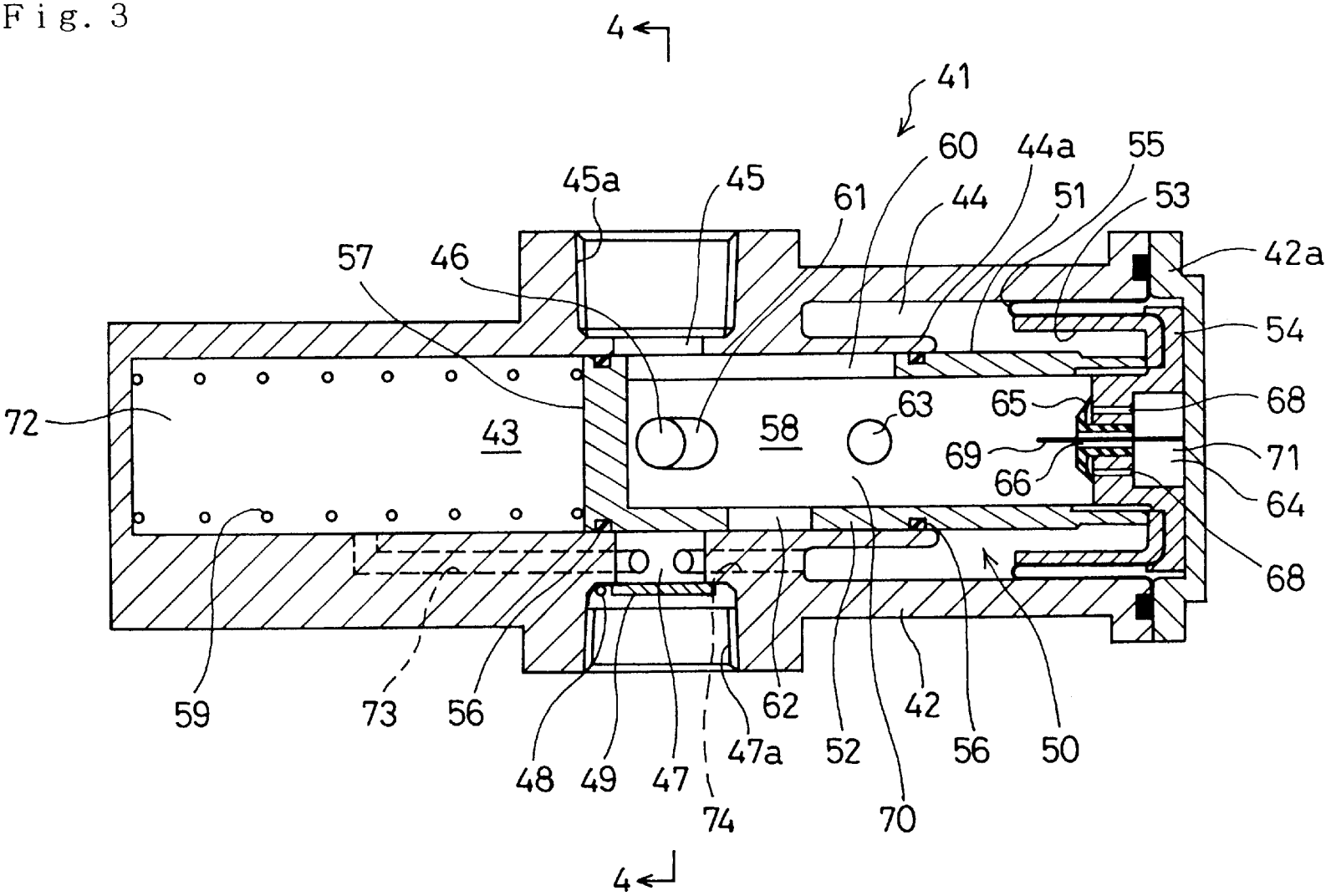
FIG. 3 is a simplified cross-sectional view of the switching valve 41 used in the toilet 100.

The switching valve 41 will now be described. With reference to FIG. 3 which shows the switching valve 41 in cross-section, the main component is a valve casing 42, in which there is a valve chamber 43 formed horizontally. The valve chamber 43 has an extended valve chamber 44, at the right end with reference to the drawing. The extended valve chamber 44 is set off from the valve chamber 43 by a bulkhead 44*a*. A cap 42*a* is fastened to the right end of the valve casing 42. The center part of the valve casing 42 has an inflow port 45 via which fluid flows in, a rim port 46 and a jet port 47 through which fluid flows out, each port being connected with the valve chamber 43. As shown by a cross-section drawing through line 4—4 in FIG. 3, the inflow port 45 and the jet port 47 are located in a straight line, rim port 46 is set at a right-angle to inflow port 45, and each port is orthogonal to the valve chamber 43. The water supply valve 105 flow channel is connected to the inflow port 45, the water supply conduit 133 is connected to the rim port 46, and the connection tube 137 is connected to the jet port 47 by means of respective tapered thread parts 45*a*, 46*a* and 47*a*. In this configuration, the rim port 46 is slightly smaller than the other ports. The jet port 47 has a valve cover 49 that is urged against the jet port 47 to keep the jet port 47 closed. The valve cover 49 thus functions as a simple non-return valve with respect to the flushing water from the connection tube 137 connected to the jet port 47.

The switching valve 41 has a valve element 50 that can freely move horizontally in the valve chamber 43. The main component of the valve element 50 is a hollow tubular cylindrical body 51 closed at one end (the left end, in FIG. 3) and open at the other end. The outer wall 52 of the cylindrical body 51 guides the cylindrical body 51 along the inside wall of the valve chamber 43. The open end of the cylindrical body 51 has an extension rim 53, with the part extending beyond the peripheral surface bent back toward the closed end of the cylindrical body 51. This extension rim 53 can move horizontally in the extended valve chamber 44. The extension rim 53 fixedly incorporates an valve element right end 54 that is used to generate a driving force to drive the valve element 50. An inner rim part of a bellophragm 55 is sandwiched between the valve element right end 54 and extension rim 53, and an outer rim part of the bellophragm 55 is sandwiched between the valve casing 42 and the cap 42*a*. By this arrangement, the valve element right end 54 is sealed by the bellophragm 55 and can also move freely inside the valve chamber 43, or more specifically the extended valve chamber 44.

Teflon rings 56 are disposed around the outside of the closed end and the center of the outer wall 52 of the cylindrical body 51, enabling the cylindrical body 51 to slide readily within the valve chamber 43 while also providing a watertight fit. The closed end of the cylindrical body 51 comprises valve element left end 57, which via the ring 56 is slidably and watertightly located within the valve chamber 43. The hollow part between the valve element left end 57 and valve element right end 54 forms a flushing water inflow chamber 58. A spring 59 is accommodated to the left of the valve element left end 57, which always applies force to attract the cylindrical body 51 and the valve element 50 toward the cap 42*a* end. The applied force of the spring 59 is described later.

The outer wall 52 is provided with first and second longitudinally elongated communicating holes 60 and 61, and round third and fourth communicating holes 62 and 63. The first communicating hole 60 is formed so that it always overlaps with the inflow port 45, whether the valve element 50 is at the position shown in FIG. 3 or during transition to the stroke end at the left. The second communicating hole 61 is formed so that it overlaps the rim port 46 while the valve element 50 is moved from the illustrated position to slightly the left of the illustrated position. In this embodiment, the initial position of the valve element 50 is that when the second communicating hole 61 and rim port 46 overlap. The third communicating hole 62 is formed so that when the valve element 50 is moved further to the left than its initial position to where the second communicating hole 61 is closed by the inside wall of the valve chamber 43, it overlaps the jet port 47. The fourth communicating hole 63 is formed so that when the valve element 50 is moved further to the left to where the second and third communicating holes 61 and 62 are closed by the wall of the valve chamber 43, it overlaps the rim port 46.

The position of the valve element 50 while the jet port 47 is overlapped by the third communicating hole 62 overlap is termed the first transition position, and the position of the valve element 50 while the rim port 46 is overlapped by the fourth communicating hole 63 is termed the second transition position. Thus, when the valve element 50 is moved to the left of the initial position thereof shown in FIG. 3, against the force applied by the spring 59, the first to fourth communicating holes are sequentially overlapped by the inflow port 45, the rim port 46 or the jet port 47. As these communicating holes communicate with the flushing water inflow chamber 58, the rim port 46 and the jet port 47 consecutively communicate with the inflow port 45 via the flushing water inflow chamber 58. Specifically, first the rim port 46 communicates with the inflow port 45 (FIG. 4); nextly the jet port 47 communicates with the inflow port 45; and then the rim port 46 communicates with the inflow port 45 again.

Figure 5:
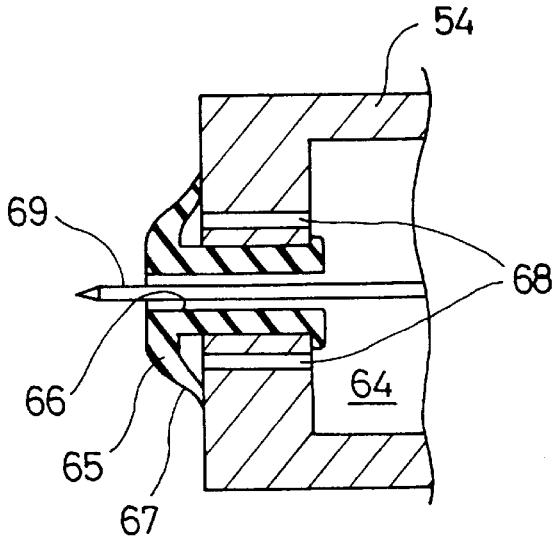
FIG. 5 is an enlarged view of the umbrella valve 65 provided in the valve element right end 54.

The valve element right end 54 has a depressed part 64 in the center of the right end thereof; the bottom wall of the recess is provided with an umbrella valve 65 formed of rubber. As can be seen in FIGS. 3 and 5 which shows a magnified view thereof, the umbrella valve 65 has a communicating hole 66 in the center, and the umbrella part 67 covers a communicating hole 68 in the bottom wall of the depressed part 64. Thus, as described below the umbrella valve 65 functions as a check valve with respect to the flow of flushing water through the bottom wall of the depressed part 64. When the flushing water flows from the left side of the bottom wall of the depressed part 64, which is the communicating hole 68 is closed by the umbrella part 67, flushing water from the flushing water inflow chamber 58 flowing to the depressed part 64 side can only pass through the communicating hole 66. However, flushing water flowing from the depressed part 64 side toward the flushing water inflow chamber 58 can pass through the communicating hole 66 and through communicating holes 68, pushing up the umbrella part 67. In this way, the umbrella valve 65 acts as a check valve, as described above. The cap 42*a* is provided with a cleaning pin 69 that, when the valve element 50 is in its initial position, is inserted into the communicating hole 66 to prevent the communicating hole 68 being blocked by foreign matter. There are from two to eight equally spaced communicating holes 68 formed in the bottom wall of the depressed part 64.

The valve element right end 54 and the valve element left end 57 of the valve element 50 serve to divide the valve chamber 43 into the following first to third valve chambers. The first valve chamber 70 is formed by the space between the element ends and communicate with the inflow port 45, the rim port 46 and the jet port 47. The second valve chamber 71 is the region to the right of the valve element right end 54, and the second valve chamber 71 includes the depressed part 64. The third valve chamber 72 is the region to the left of the valve element left end 57, and the third valve chamber 72 houses the spring 59. The flushing water inflow chamber 58 in the valve element 50 is located in the first valve chamber 70. The second valve chamber 71 is a sealed chamber formed by the cap 42*a* and the bellophragm 55. When the valve element 50 is moved from its initial position to the left, the volume of the second valve chamber 71 is expanded by the bellophragm 55. The third valve chamber 72 is an open-type valve chamber with communicating hole 73 which is formed so as to communicate with the jet port 47. The extended valve chamber 44 at the right side of the valve chamber 43 is open with communicating hole 74 which communicates with the jet port 47. This means that there is no impediment to the horizontal movement of the valve element right end 54 in the extended valve chamber 44 or to the horizontal movement of the cylindrical body 51 (valve element 50) in the valve chamber 43. Even if flushing water is present in the third valve chamber 72, when the valve element 50 is moved to the left, the flushing water present is forced out through the communicating hole 73 by the valve element left end 57, allowing unimpeded horizontal movement by the cylindrical body 51.

Figure 4:
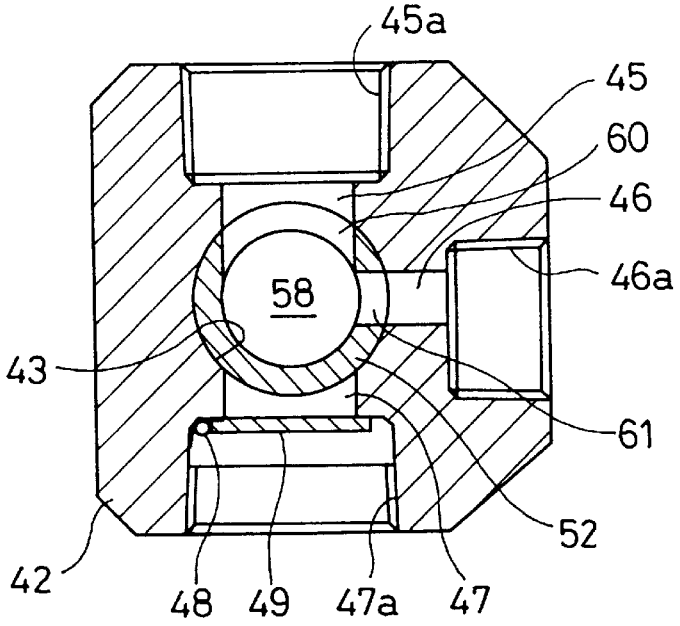
FIG. 4 is a simplified cross-sectional view along line 4—4 in FIG. 3.

The switching operation of the switching valve 41 will now be described. Before the cleaning button on the remote control panel is pressed, the water supply valve 105 (FIG. 1) which is upstream of the switching valve 41 is in the closed state so flushing water does not flow into the inflow port 45 of the switching valve 41. In this state the valve element 50 is subject only to the applied force of the spring 59, and is in the initial position shown in FIG. 3 and there is no inflow of flushing water, so flushing water is not being supplied from the switching valve 41. When the cleaning button is pressed, the water supply valve 105 opens and flushing water flows to the switching valve 41. This flushing water flows into the flushing water inflow chamber 58 under about the same pressure as the water service. Since at this time the valve element 50 is in the initial position, the rim port 46 communicates with the inflow port 45 via the flushing water inflow chamber 58 (FIG. 4). Thus, the flushing water flows out to the rim port 46 through the flushing water inflow chamber 58. As the rim port 46 is connected to the water supply conduit 133, the flushing water is led into the water supply conduit 133 and spouted through the rim channel 103 to start the rim water cleaning. The rim water cleaning is carried out as long as the valve element 50 is in the initial position, or, as long as the second communicating hole 61 and rim port 46 overlap.

When the flushing water flows into the flushing water inflow chamber 58, in the flushing water inflow chamber 58, the pressure of the flushing water, which is substantially equal to the water service supply pressure, is subjected to reversion between the valve element right end 54 and valve element left end 57. The area in the flushing water inflow chamber 58 for receiving the pressure from the flushing water is determined by the sectional area of the flushing water inflow chamber 58, which is the same at the valve element right end 54 and valve element left end 57. Thus, the flushing water pressure acting on the valve element 50 in the flushing water inflow chamber 58 is canceled out. Flushing water that flows into the flushing water inflow chamber 58 flows via the communicating hole 66 in the umbrella valve 65 in the valve element right end 54 into the second valve chamber 71. Therefore the valve element right end 54, and by extension the valve element 50, the force exerted by the flushing water that flows into the second valve chamber 71, as determined by the above-described flushing water pressure and the pressure receiving area of the valve element right end 54 in the second valve chamber 71, as a force driving the valve element toward the flushing water inflow chamber 58. As the extended valve chamber 44 wherein the valve element right end 54 is provided and the third valve chamber 72 on the valve element left end 57 side are left open by the communicating holes 73 and 74, the valve element 50 receives the above-described driving force generated by the inflow of water to the second valve chamber 71 against the applied force of the spring 59.

The force of the spring 59 is such that it can keep the valve element 50 in the initial position as long as flushing water does not flow in from the inflow port 45, that is, as long as there is no load on the valve element 50. Thus, as flushing water flows into the second valve chamber 71, the valve element 50 receives a driving force that exceeds the applied force of the spring 59, and therefore the valve element 50 is moved from the initial position to the left against the force of the spring 59. This transition of the valve element 50 continues while the flushing water flows into the second valve chamber 71. In this embodiment, the valve element right end 54 is fastened to the extension rim 53, so the pressure receiving area of the valve element right end 54 in the second valve chamber 71 is greater than the pressure receiving area in the flushing water inflow chamber 58. Together with the high pressure in the second valve chamber 71 (the same as the water service supply pressure) acting on the valve element right end 54, this enables a relatively large valve element driving force to be generated.

Figure 6:
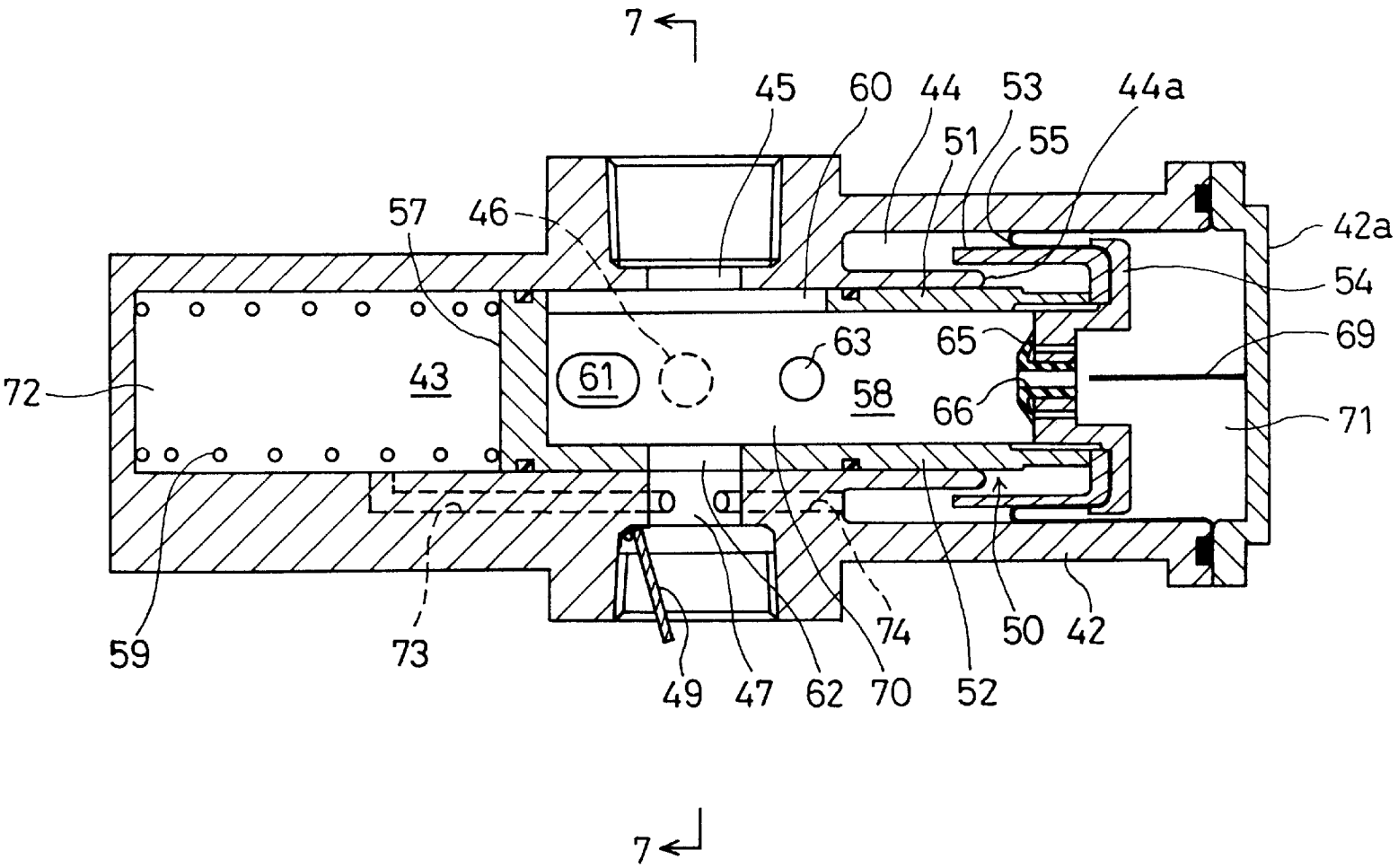
FIG. 6 illustrates the manner of flushing water switching by the switching valve 41.
Figure 7:
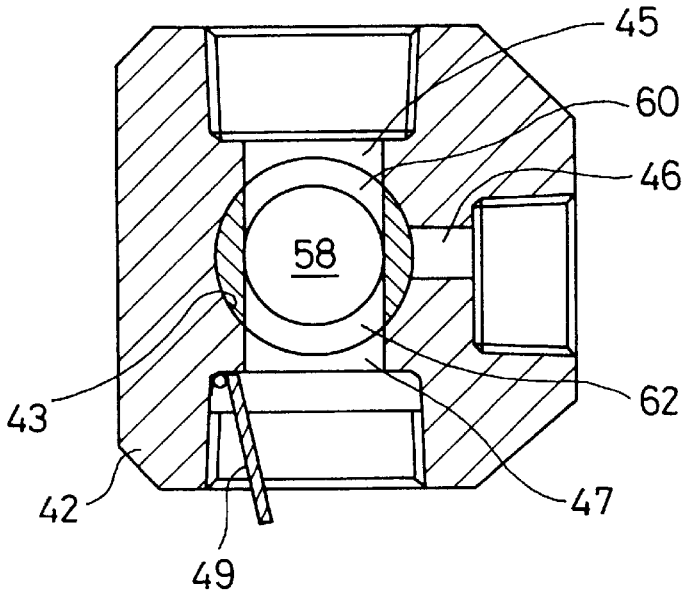
FIG. 7 is a simplified cross-sectional view along line 7—7 of FIG. 6.

When the valve element 50 is thus moved from its initial position to the left, the valve element 50 reaches the first movement transition position, shown in FIG. 6. As shown in FIG. 6 and FIG. 7 which is a cross-section view through line 7—7, the second communicating hole 61 that had been overlapping rim port 46 is blocked by the inner wall of the valve chamber 43, and third communicating hole 62 is overlapped by the jet port 47, whereby the jet port 47 communicates with the inflow port 45 via the flushing water inflow chamber 58. Flushing water thus flowing through the flushing water inflow chamber 58 into the jet port 47 is led by the connection tube 137 connected to the jet port 47 and spouted out from the spout nozzle 35 to start the jet water cleaning. That is, subsequent to the transition of the valve element 50 from its initial position to the first transition position, the rim port 46 and the jet port 47 consecutively communicate with the inflow port 45, causing a switch from the rim water cleaning to the jet water cleaning. The jet water cleaning continues for as long as the valve element 50 is at the first transition position, meaning while the third communicating hole 62 and jet port 47 overlap. The valve cover 49 opens easily under the pressure of the flushing water passing through the jet port 47.

Figure 9:
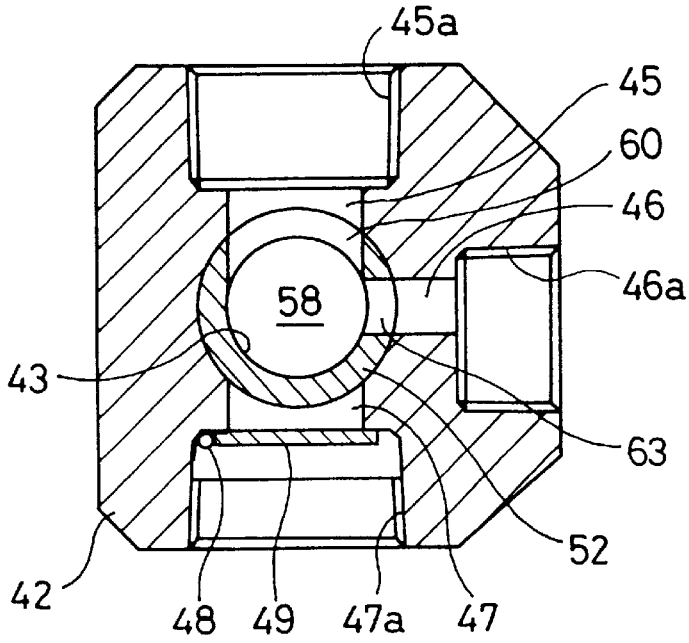
FIG. 9 is a simplified cross-sectional view along line 9—9 of FIG. 8.
Figure 8:
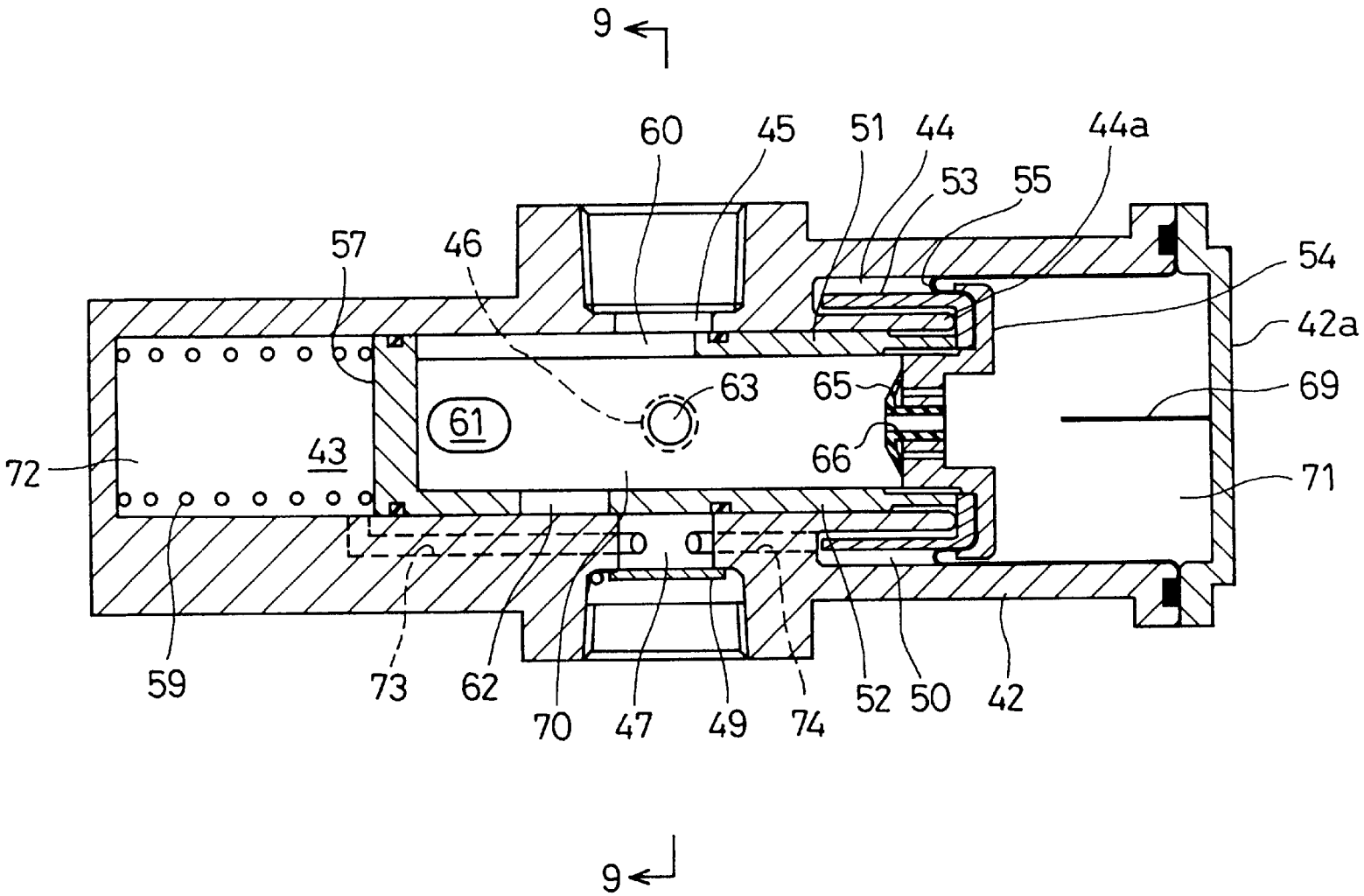
FIG. 8 illustrates the manner of flushing water switching by the switching valve 41.

Even after the valve element 50 has reached the first transition position shown in FIG. 6, since the water supply valve 105 remains open, the flushing water continues to flow into the second valve chamber 71 via the communicating hole 66. So that, the valve element 50 further moves to the left from the first transition position to the second transition position shown in FIG. 8. As shown in FIG. 8 and in FIG. 9 which is a simplified cross-sectional view along line 9—9, the third communicating hole 62 that had been overlapped by the jet port 47 is blocked by the inner wall of the valve chamber 43 and the fourth communicating hole 63 overlaps the rim port 46, so that the rim port 46 communicates with the inflow port 45 again via the flushing water inflow chamber 58. Therefore, flushing water flowing to the rim port 46 via the flushing water inflow chamber 58 is led into the water supply conduit 133 and spouted through the rim channel 103 to start the rim water cleaning again. The rim water cleaning continues as long as the valve element 50 is in the second transition position, meaning as long as the fourth communicating hole 63 overlaps the rim port 46. Thus, subsequent to the transition of the valve element 50 from the first transition position to the second transition position, the jet port 47 and the rim port 46 consecutively communicate with the inflow port 45 to switch from the jet water cleaning to the rim water cleansing. With this toilet 100 having the switching valve 41, from the start of the toilet bowl cleaning operation, after the rim water cleaning for cleaning the inner wall surface of the bowl part by water and the jet water cleaning for flushing out filth in the bowl part are carried out sequentially, the flushing water spouted from the rim channel 103 not only cleans the inner wall surface of the bowl part but can also be stored for cleaning the bowl part, thus enabling the rim-jet-rim water cleaning.

Figure 10:
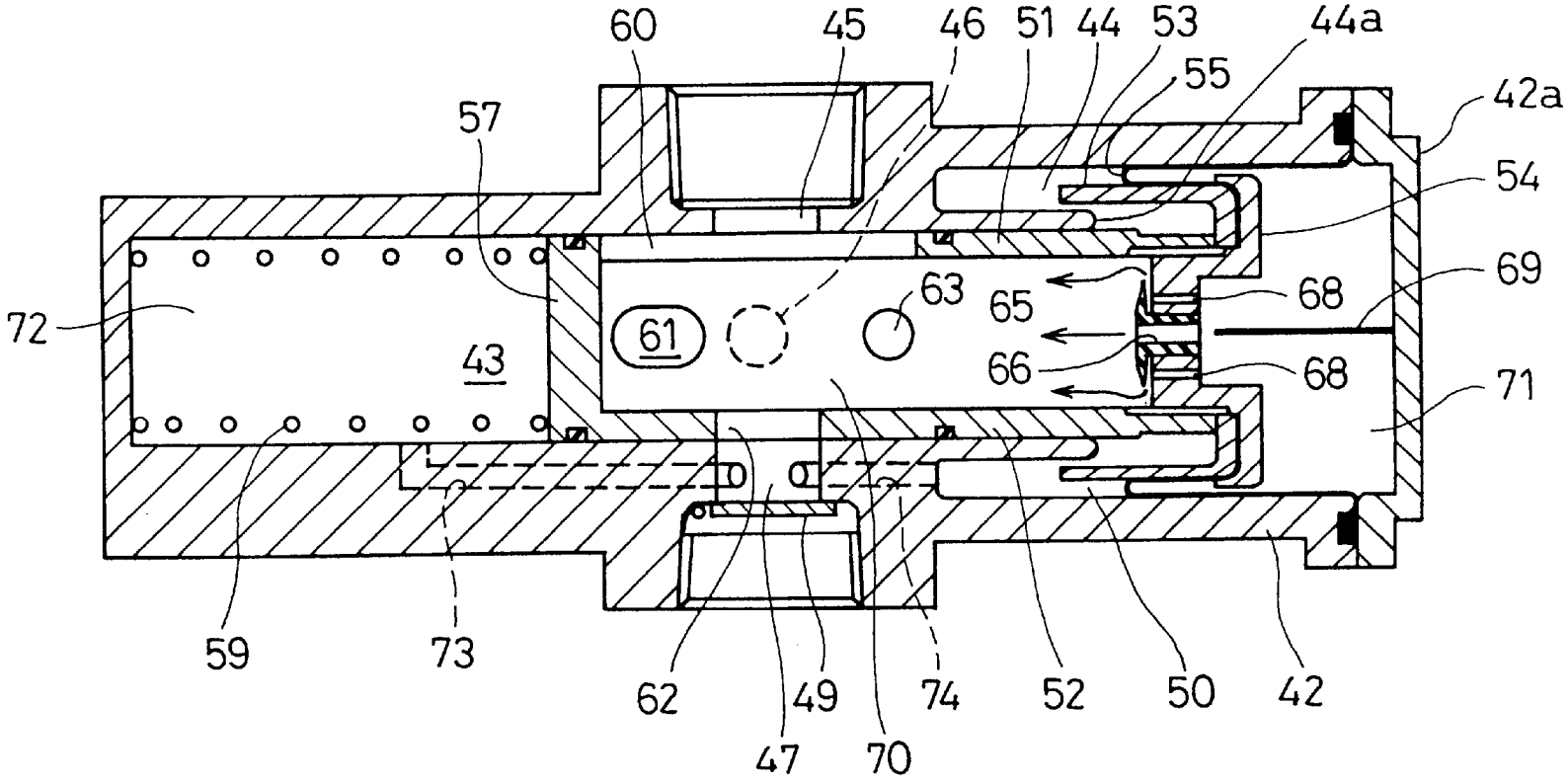
FIG. 10 illustrates the resetting manner of the valve element 50 in the switching valve 41.

After the final rim water cleaning for a prescribed time, or more specifically, after completion of the final rim water cleansing on closing of the feed valve after expiration of the prescribed amount of time since the above-described cleaning button has been operated, the valve element 50 is reset to the initial position as described below. With the water supply valve 105 closing off the supply of water to the switching valve 41, the above-described flow of flushing water into the second valve chamber 71 stops. As a result, the second valve chamber 71 loses the flushing water pressure which has caused the inflow of flushing water, reducing the valve element driving force to zero. Accordingly, the valve element 50 is reset from the second transition position (FIG. 8) back to the initial position, subject to the applied force of the spring 59 alone. Since the flushing water remaining in the second valve chamber 71 has lost the flushing water pressure thereof, the reset of the valve element 50 forces the water to flow from the second valve chamber 71 to the flushing water inflow chamber 58 side. With respect to FIG. 10, the water from the second valve chamber 71 flows back into the flushing water inflow chamber 58 via the communicating hole 66 and, pushing up the umbrella part 64 of the umbrella valve 65, flows through the communicating holes 68.

The flushing water flows through the communicating hole 66 into the second valve chamber 71 under the substantially constant flushing water pressure of the water service supply source. The above-described transitions of the valve element 50 caused by this inflow of flushing water occur consecutively during the inflow of the flushing water into the second valve chamber 71. Consequently, the valve element 50 moves at a constant speed from the initial position to the first transition position and then to the second transition position. Since this means that the time that expires while the destination of flushing water supply is switched from the rim channel 103 to the spout nozzle 35 or from the spout nozzle 35 to the rim channel 103 is constant, after the set volume of flushing water has been supplied to the rim channel, the supply destination is switched to the spout nozzle 35. In the case of the toilet 100, the switching to the jet water cleaning is carried out after completion of the rim water cleaning with a set volume of flushing water, and then the switching to the rim water cleaning again is carried out after completion of the jet water cleaning with a set volume of flushing water. Consequently, the switching valve 41 according to this embodiment enables the supply switching subject to the set volume, and the toilet 100 wherein this switching valve 41 is utilized enables the automatic switching subject to the set volume from the rim water cleaning to the jet water cleaning and then from the jet water cleaning to the rim water cleaning. This automatic switching is based on the supply pressure of the flushing water and therefore does not require any control devices, sensors or other electrical equipment, which helps to simplify the structure and reduce costs.

Figure 12:
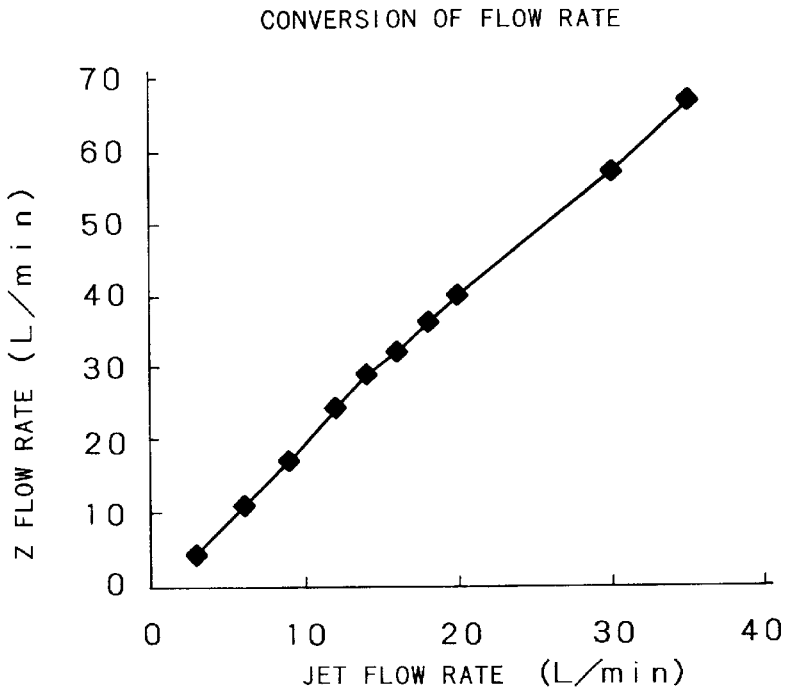
FIG. 12 is a graph showing the relationship between jet flow rate and Z flow rate based on the experiment results shown in FIG. 11.
Figure 13:
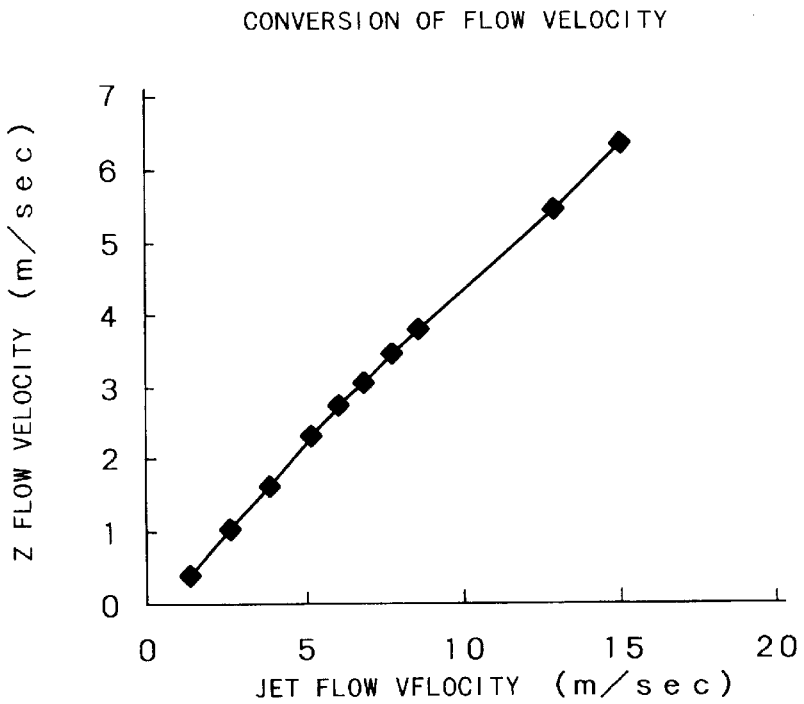
FIG. 13 is a graph also showing the relationship between jet flow velocity and Z flow velocity.

Experimental data based on the first embodiment are shown in FIGS. 11 to 13. For the experiments, the spout nozzle 35 with a diameter d of 7 mm and a Z waterspout outlet 106 with a diameter D of 15 mm were used. The jet flow rates A and flow velocities B listed in the table of FIG. 11 are values recorded respectively using a flow meter and flow velocity meter positioned immediately behind the spout nozzle 35. Z flow rates C and Z flow velocities D are the values recorded respectively using a flow meter and flow velocity meter positioned immediately downstream of the Z waterspout outlet 106. FIG. 12 is a graph showing the relationship between jet flow rate from the spout nozzle 35 and Z flow rate from the Z waterspout outlet 106, and FIG. 13 is a graph showing the relationship between jet flow velocity and Z flow velocity.

Based on these experiment data, a high flow velocity of flushing water in the Z water conduit 161 was realized by means of the high-velocity, high-pressure jet flow beneath the spout nozzle 35. However, at the Z waterspout outlet 106 the flow velocity had dropped to 30% to 40% of the flow velocity beneath the spout nozzle 35. On the other hand, it can be seen that the instantaneous flow rate of the flushing water in the Z water conduit 161 was amplified to nearly twice the flow rate below the spout nozzle 35. This can be considered as the result of the ejector effect produced by the jet flow from the spout nozzle 35 involving the flushing water around the spout nozzle 35 in the Z water conduit 161 and water from the flushing water reservoir 104 and being spouted out with the jet flow toward the Z waterspout outlet 106. In the vicinity of the Z waterspout outlet 106, the high-velocity, high-pressure jet flow from the spout nozzle 35 changes to a heavy flow with a uniform velocity distribution, and the heavy flow of the flushing water pushes filth in the filth hopper part 112 toward the inlet 121 of the waste trap 102. Moreover, the flow rate (in this embodiment a Z flow rate) needed to accomplish for pushing the filth in the filth hopper part 112 can be obtained with just a small spout flow from the spout nozzle 35. Therefore, the above first embodiment provides a toilet 100 that offers both high cleaning performance and high water economy performance and, since negative pressure does not need to be utilized, the toilet does not need to have a leak-tight structure or to be pressure-resistant.

In the toilet 100 according to the first embodiment, the flushing water reservoir 104 communicates with the bowl part 101 via the Z water conduit 161. Therefore, if the flushing water is switched to be supplied to the water supply conduit 133 and water from the rim channel 103 is pooled in the bowl part 101, this water also flows into the flushing water reservoir 104, completing storage of the flushing water in the flushing water reservoir 104. There is therefore no need for a special structure just for storing water in the flushing water reservoir 104, so the construction is simplified.

The flushing water reservoir 104, having a capacity of about 0.5 liters, or about one-fourth the 2 liters of water normally pooled in the bowl part 101, has the following advantages.

If the siphon effect produced in the waste trap 102 involves water in the bowl part 101 into the upstream tube 122 until there is no more water in the bowl part 101, the siphon effect extinguishes. Immediately before the siphon effect extinguishes, a blow effect is produced to involve floating filth into the waste trap 102 together with the flushing water. In this embodiment the flushing water reservoir 104 contains a volume of flushing water relative to the water normally existing in the bowl part 101 to produce this effect and ensure that the timing of the completion of the cleaning water spouting by the jet pump coincides with the period when the siphon effect extinguishes, and that the flushing water in the flushing water reservoir 104 runs out while there is no siphon effect. In the toilet 100 according to this embodiment, therefore, the bowl part 101 is emptied of water during the period when there is no siphon effect, enhancing the above blow effect.

Also in accordance with this first embodiment, the umbrella valve 65 which is mounted on the valve element right end 54 of the switching valve 41 functions as a check valve to open and close the communicating hole 68, and when the valve element 50 is being reset to the initial position thereof, the flushing water can pass through the communicating holes 68 as well as the communicating hole 66. For this reason, the switching valve 41 allow the flow rate from the second valve chamber 71 to the flushing water inflow chamber 58 to be increased during reset transition of the valve element 50, the valve element 50 can move back more quickly. Thus, through the enhancement of resetting velocity, the toilet 100 can be ready for the next user in a shorter time.

The switching valve 41 has the following advantageous effects.

A. The switching valve 41 has a cleaning pin 69 that runs through the communicating hole 66 when the valve element 50 is in the initial position. This cleaning pin 69 prevents the communicating hole 66 from being blocked by foreign matter, which enhances the reliability by ensuring that flushing water supplied to the switching valve 41 is switched to the path concerned.

B. The switching valve 41 has an extended valve chamber 44 at the right end of the valve chamber 43 which has an extension rim 53 and an valve element right end 54 that are enabled to be moved freely along the extended valve chamber 44. A driving force applied to the valve element 50 from the second valve chamber 71 side can therefore be generated by means of the valve element right end 54, which has a large pressure receiving area. As such, even in the region wherein the water service supply pressure is relatively low or even if the water service supply pressure may drop for some reason, it is ensured that a relatively large valve element driving force that is based on the large pressure receiving area can be generated to move the valve element 50 as described above. Therefore, the installation areas of the toilet 100 wherein the rim-jet-rim water cleaning is carried out with utilization of the switching valve 41 can be expanded and the reliability of the supply destination switching operation and the toilet bowl cleaning mode switching operation (switching in the rim-jet-rim water cleaning) can be enhanced.

C. In the switching valve 41, the extension rim 53 and the valve element right end 54 are moved to the right and left in the extended valve chamber 44 so that the folded-back part of the extension rim 53 will overlap the bulkhead 44*a* when the valve element 50 is moved to the first and second transition positions. The stroke of the valve element 50 is therefore ensured even if the longitudinal dimension of the switching valve 41 is reduced by the amount of the overlap. This means that the switching valve 41 can be made compact, which opens up more options with respect to fitting it to the toilet 100.

Figure 14:
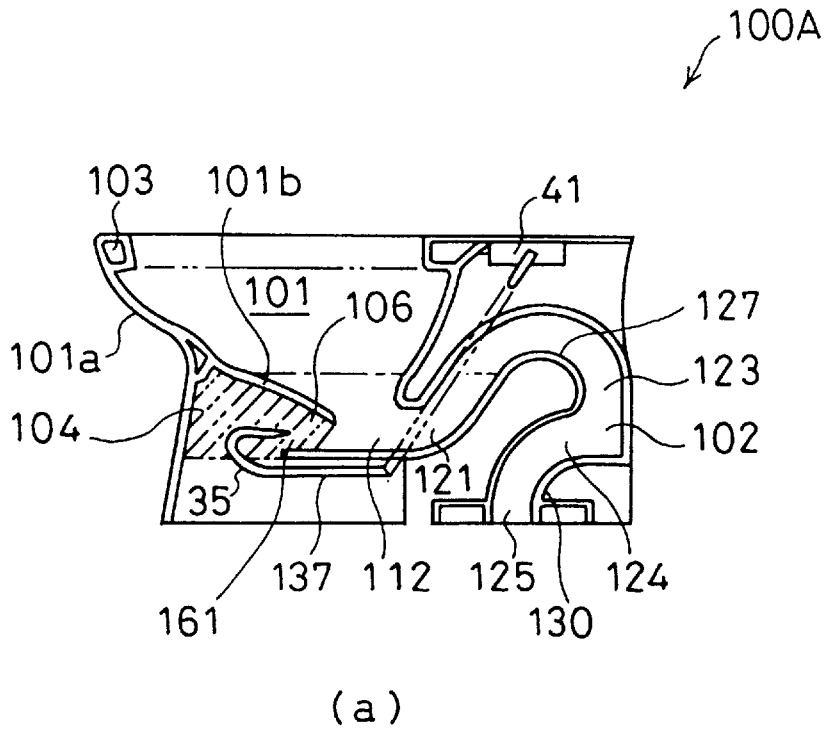
FIG. 14 shows a simplified cross-section and a plan view of a toilet 100A according to a second embodiment.
Figure 15:
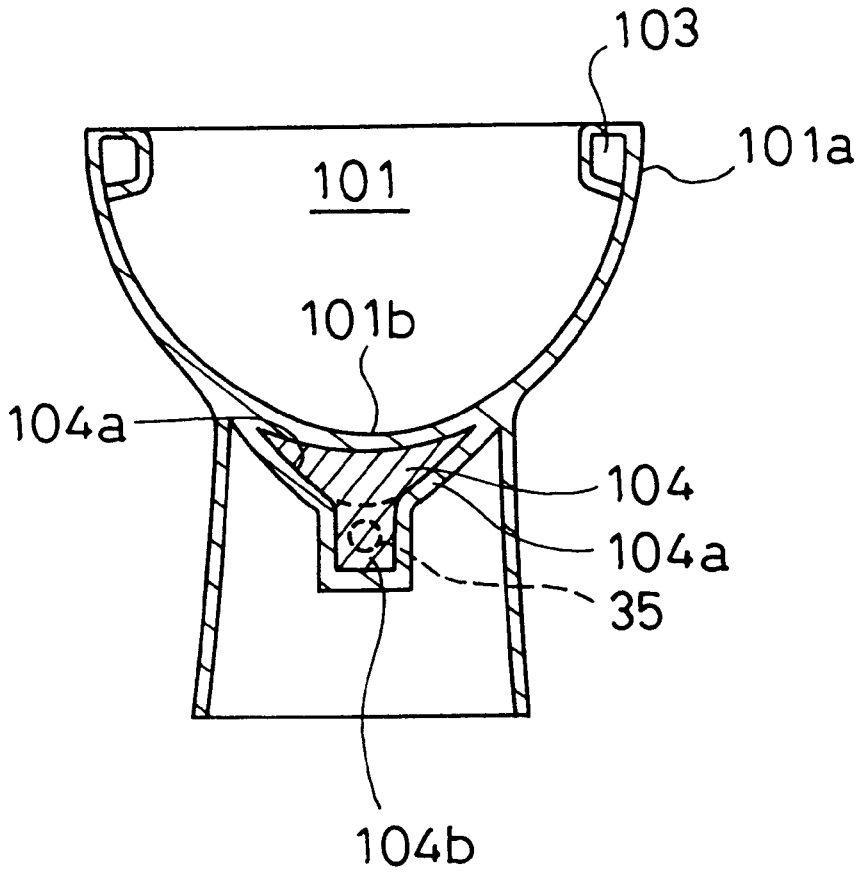
FIG. 15 is a simplified cross-sectional view along line 15—15 in FIG. 14.

A second embodiment of the invention will now be described. This second embodiment also relates to a low-silhouette type toilet and has a structure in common with that of the first embodiment. So description of elements having the same structure and function is omitted and only the different parts will be described. FIG. 14 shows a simplified cross -sectional view and a plan view of the toilet 100A of the second embodiment, and FIG. 15 shows a simplified cross-sectional view through line 15—15 of FIG. 14. As shown by these drawings, the toilet 100A comprises a bowl part 101 formed in a bowl part main body 101*a*, and a filth hopper part 112 at the bottom of the bowl part 101 from which filth is flushed into a waste trap 102.

The toilet 100A has a flushing water reservoir 104 located to the front of the bowl part main body 101*a* and separated from the bowl part 101 by a bulkhead 101*b*. The flushing water reservoir 104 is formed within the pedestal that supports the bowl part 101. In other words, as shown FIG. 15 the flushing water reservoir 104 is defined at the upper side thereof by the bulkhead 101*b* of the bowl part 101 and on the right and left the sides by curved bowl-shaped sidewalls 104*a*. As describe above, the flushing water reservoir 104 is a closed space defined by the bulkhead 101*b* and the curved sidewalls 104*a*, and the area of the flushing water reservoir 104 is indicated in FIG. 14 by double-dots-and-dashed lines.

The flushing water reservoir 104 has a Z waterspout outlet 106 that opens into the bowl part 101. The Z waterspout outlet 106 is disposed facing the inlet 121 of the waste trap 102 and forms a flushing water channel. If flushing water is pooled in the bowl part 101, the flushing water can therefore also run into the flushing water reservoir 104 via the Z waterspout outlet 106, until the water stored inside the flushing water reservoir 104 is at the same level as the pooled water. Via the Z waterspout outlet 106, flushing water can also be made to flow from the flushing water reservoir 104 side into the bowl part 101. In this second embodiment, the capacity of the flushing water reservoir 104 is around 0.5 liters, and this volume of flushing water is used to clean the toilet bowl. The top of the flushing water reservoir 104 has a small air hole to allow the water to run freely into the flushing water reservoir 104.

Behind the bowl part main body 101*a* is a switching valve 41 connected to the downstream side of a water supply valve 105 (not shown) which is the same as in the first embodiment. The switching valve 41 switches between the flushing water supply destinations, in a sequence that starts with the water supply conduit 133 (not shown) leading to the rim channel 103, nextly to the connection tube 137 leading to the flushing water reservoir 104, and then again to the water supply conduit 133, in the same manner as in the above first embodiment. Consequently, water is spouted to the bowl part 101 sequentially from rim/jet/rim.

A spout nozzle 35 is provided at the front end of the curved connection tube 137 that runs through the pedestal from the switching valve 41 to the flushing water reservoir 104. The spout nozzle 35 is oriented toward the Z waterspout outlet 106 in the flushing water reservoir 104, and faces the inlet 121 through the Z waterspout outlet 106. The bottom of the flushing water reservoir 104 is formed into a recess 104*b*, as shown in FIG. 15, and the Z waterspout outlet 106 is on the rear side in the drawing. The spout nozzle 35 is arranged in this recess 104*b*.

With the existence of the Z waterspout outlet 106 that defines the fluid flow passage in front of the spout nozzle 35, the spout nozzle 35 and Z waterspout outlet 106 constitute a jet pump. Thus, if the connection tube 137 is selected as the destination of the flushing water supplied from the feed water valve, as described above, the flushing water flows out from the spout nozzle 35 and into the inside of the flushing water reservoir 104, more specifically into the recess 104*b* flows at a high pressure of 1 to 2 kgf/cm$^2$ and a high velocity. In this case, since flushing water is stored in the flushing water reservoir 104, the spouted water from the spout nozzle 35 involves an enormous volume of water in the flushing water reservoir 104 to form a jet flow. The jet flow and the involved water in the flushing water reservoir 104 are from the Z waterspout outlet 106 directly toward the inlet 121 of the waste trap 102, like a jet flow by the jet pump. Filth in the filth hopper part 112 is flushed out by this flow-rate-amplified flushing water into the waste trap 102. In the toilet 100A, the area extending from the front end of the spout nozzle 35 to the Z waterspout outlet 106 is a Z water conduit to substitute for the Z water conduit 161 of the first embodiment, functioning as a throat. The toilet 100A also comprises a waste trap 102 in the same way as the first embodiment but the discussion thereon is omitted here.

Experimental data based on the second embodiment are shown in FIGS. 16 to 20. For the experiments the spout nozzle 35 with a diameter d of 7 mm and a Z waterspout outlet 106 with a diameter (opening diameter D) of 10 to 15 mm were used. The diameter of the Z waterspout outlet 106 is discussed below in the context of an analysis of the data. Measurements were performed in the same manner as in the first embodiment, to measure jet flow rate A and jet flow velocity B downstream of the spout nozzle 35, and jet flow rate C and jet flow velocity D downstream of the Z waterspout outlet 106, and flow rate ratios and flow velocity ratios were calculated.

Figure 16:
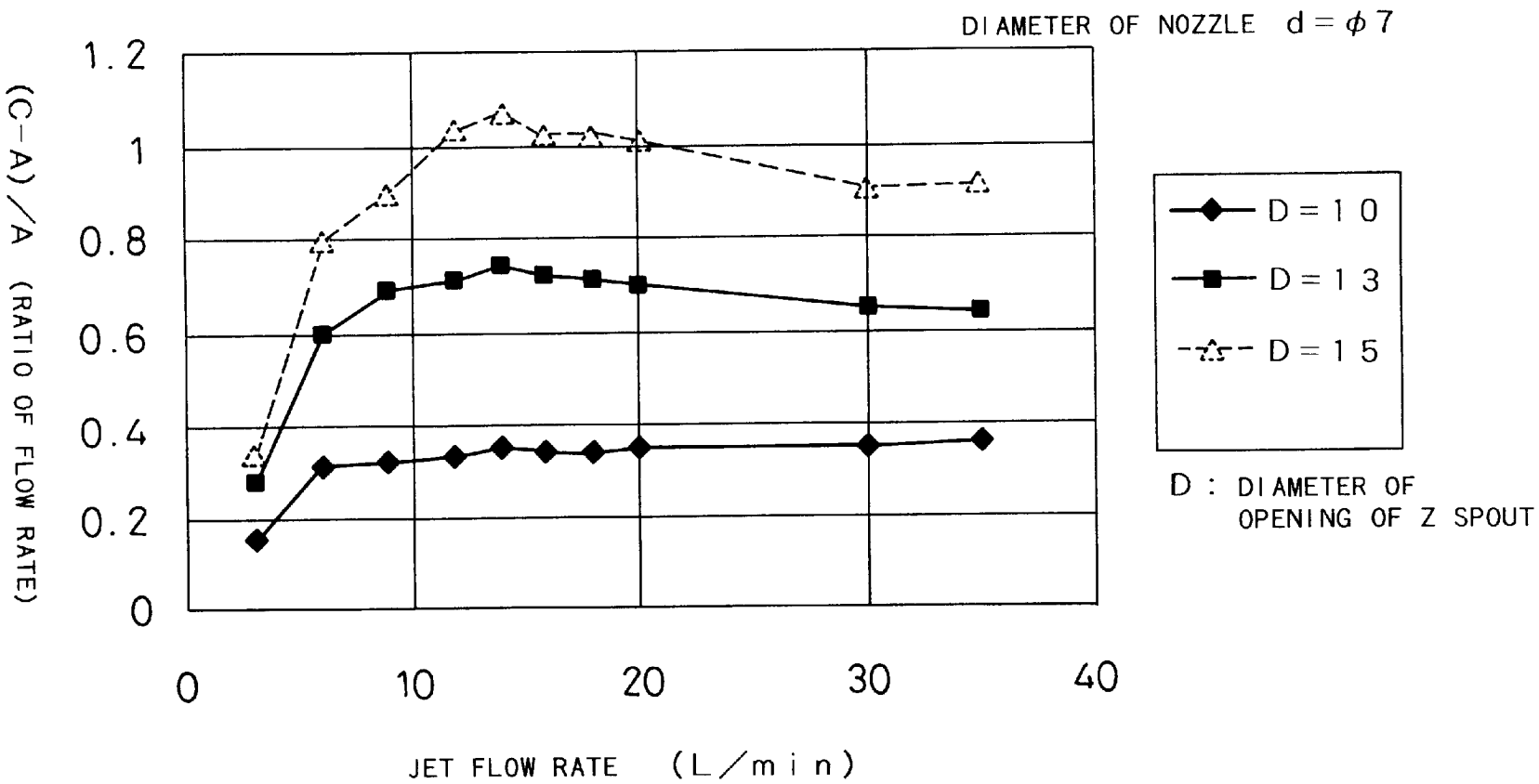
FIG. 16 is a graph showing the relationship between jet flow rate and flow rate ratio in the toilet 100A.

FIG. 16 represents the ratio of jet flow rate A with respect to the difference between jet flow rates C and A (C-A), and shows the flow rate ratios for various Z waterspout outlet 106 diameters D and a nozzle diameter d of 7 mm. From FIG. 16, it can be seen that increasing diameter D resulted in an increased flow rate ratio, with a maximum flow rate ratio being realized with a diameter D of 13 or 15 mm. Based on FIG. 16, it can be said that a virtually constant flow rate ratio can be obtained by using a jet flow rate A of not less than 10 liters/min and that the flow rate ratio, and Z flow rate C from the Z waterspout outlet 106 is defined by setting the Z waterspout outlet 106 diameter D.

Figure 17:
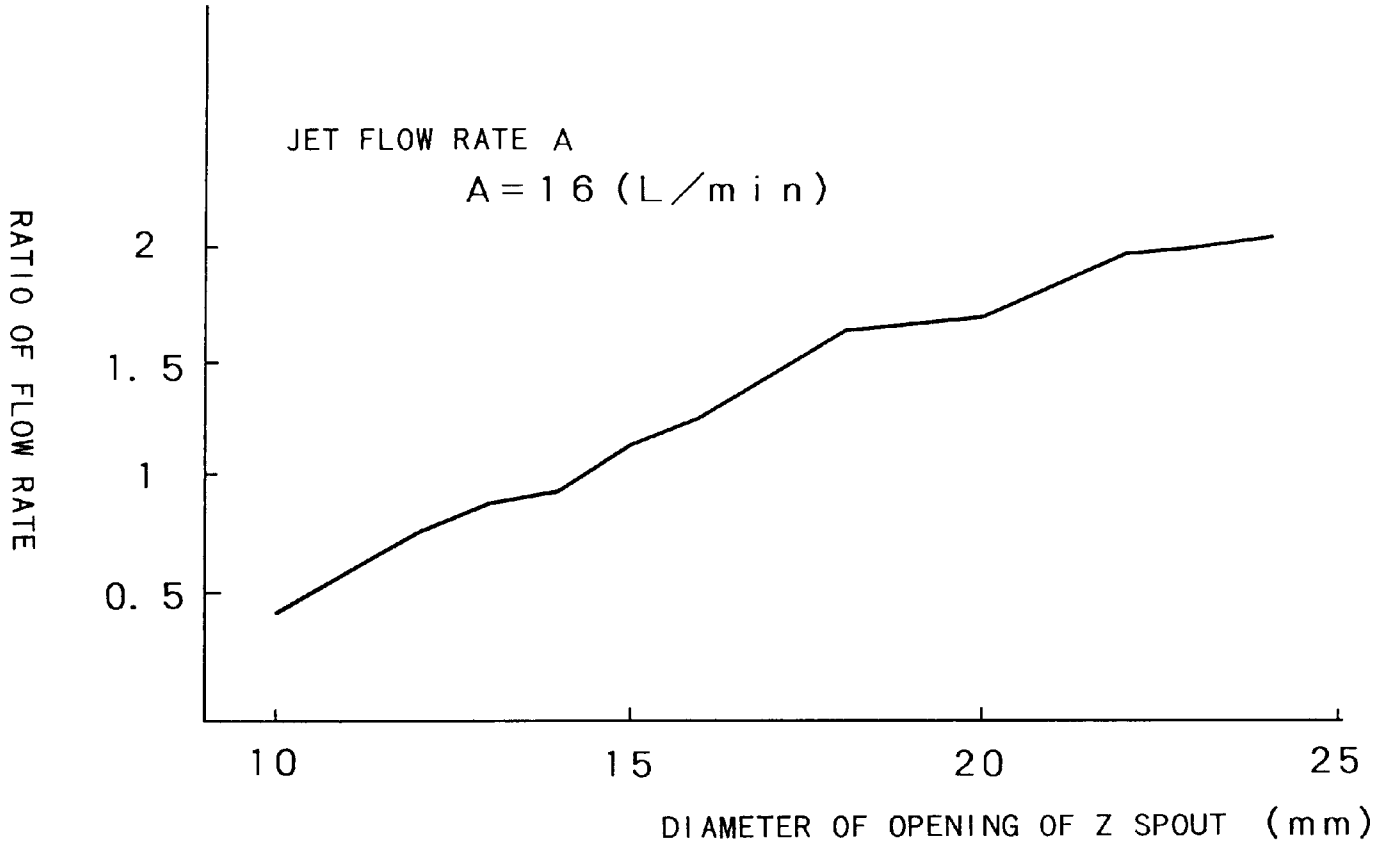
FIG. 17 is a graph showing the relationship between diameter D of Z waterspout outlet 106 and flow rate ratio in the toilet 100A.

FIG. 17 shows the relationship between flow rate ratio and opening diameter D of the Z waterspout outlet 106 when jet flow rate A is set at a constant 16 liters/min. Diameter d of the spout nozzle 35 was 7 mm. FIG. 17 also reveals that increasing diameter D increases the flow rate ratio.

Figure 18:
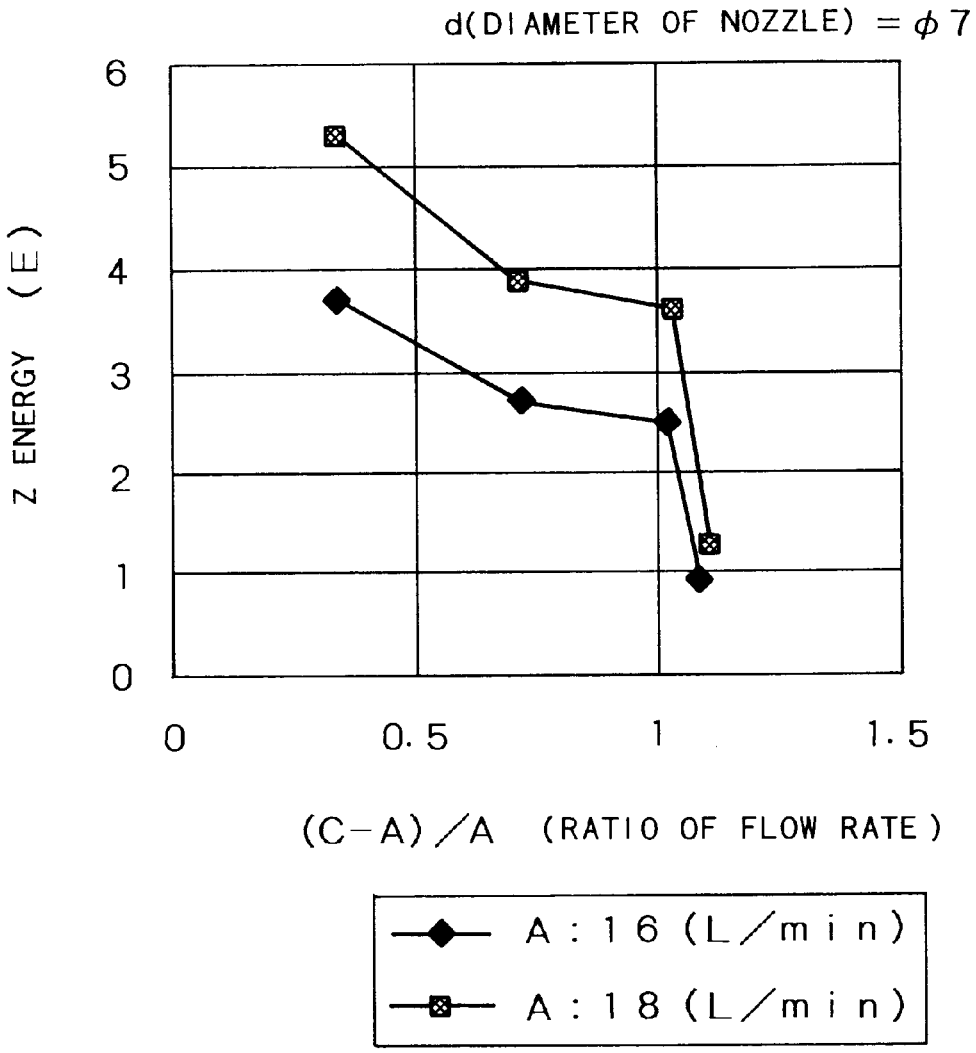
FIG. 18 is a graph showing the relationship between flow rate ratio and Z energy in the toilet 100A.

FIG. 18 shows the relationship between the flow energy of water flowing from the Z waterspout outlet 106 (Z energy E) and flow rate ratio. Z energy E was calculated by the following formula in which ρ is water density, S is the area of the opening of the Z waterspout outlet 106, and V is Z flow velocity.

$$E=(1/2)\rho\cdot S\cdot V^3$$

An investigation was also carried out with respect to jet flow rates A of 16 liters/min and 18 liters/min. FIG. 18 reveals that a high-energy flow could be obtained using a flow rate ratio lower than 0.5, that is, Z flow rate C is a half of jet flow rate A or less.

Figure 19:
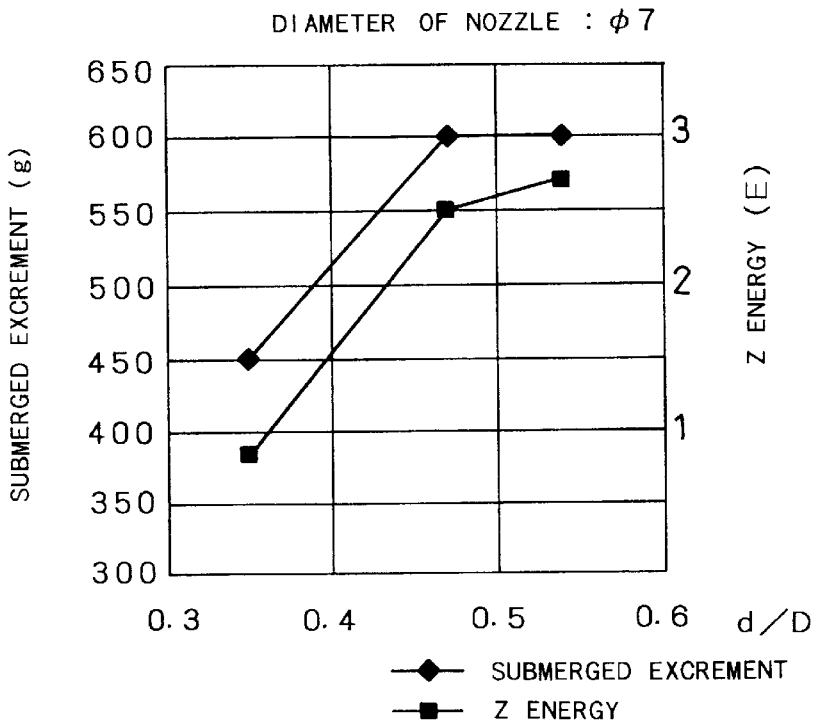
FIG. 19 is a graph simultaneously showing the submerged filth flushing out performance and the Z energy in the toilet 100A, with respect to a ratio of the diameter d of a spout nozzle 35 to the port diameter D of a Z waterspout outlet 106.

Next, drainage was investigated, using imitation filth submerged in the bowl part 101. FIG. 19 simultaneously shows the relationship between the amount of submerged filth in the pooled water in the bowl part 101 and the ratio of nozzle diameter d (=7 mm) to opening diameter D of Z waterspout outlet 106 (d/D), and the relationship between Z energy E and the ratio d/D. From FIG. 19 it can be seen that there is a correlation between Z energy E and the amount of submerged filth that is drained off, with the amount of filth drained off increasing with the rise in Z energy E. If the ratio of the nozzle diameter d to he opening diameter D is around 0.46 or more provides good drainage of filth submerged in the pooled water in the bowl part 101.

Figure 20:
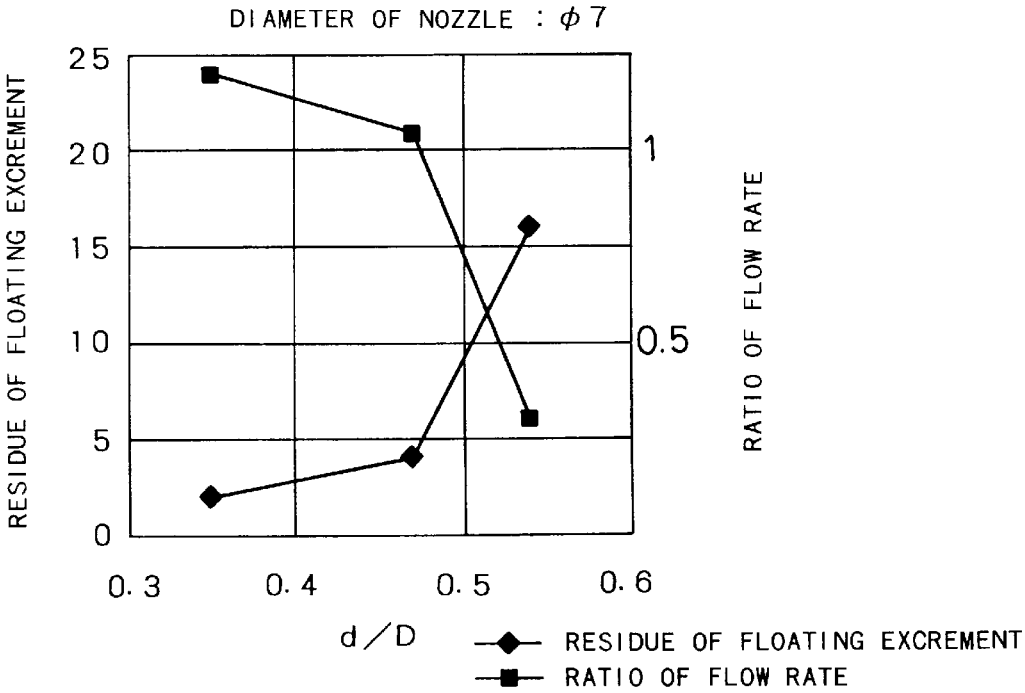
FIG. 20 is a graph simultaneously showing the floating filth flushing out performance and the flow rate ratio in the toilet 100A, with respect to the diameter d of the spout nozzle 35 and the diameter D of the Z waterspout outlet 106.

FIG. 20 simultaneously shows the relationship between the amount of floating filth in the pooled water in the bowl part 101 and the ratio d/D (d=7 mm). From FIG. 20, it can be seen that the ability to drain small particles of floating filth (imitation filth) in the pooled water in the bowl part 101 increases with an increase in the flow rate ratio, and that a ratio of the nozzle diameter d to the opening diameter D not more than 0.48 results in a high drainage performance. In the case of both submerged and floating filth, high drainage performance is obtained if a ratio of the nozzle diameter d to the opening diameter D is slightly under 0.5. Thus, if diameter d of the spout nozzle 35 is 7 mm, it is preferable to use a diameter D of 15 mm for the opening of the Z waterspout outlet 106.

In accordance with the toilet 100A of this second embodiment, flushing water supplied to the spout nozzle 35 of the flushing water reservoir 104, via the connection tube 137, and jetted out from the nozzle at a high pressure of 1 to 2 kgf/cm$^2$, involves flushing water in the flushing water reservoir 104 and is therefore amplified in the flow rate and increased in the instantaneous flow rate like a spout from a jet pump, in which state it spouts from the Z waterspout outlet 106. The result is high cleaning performance and water economy that allows filth in the bowl part 101 to be flushed out using just the 0.5 liters of flushing water in the flushing water reservoir 104.

In the toilet 100A of this second embodiment, the flushing water reservoir 104 communicates directly with the bowl part 101 via the Z waterspout outlet 106, and the length of the Z water conduit 161 between the front end of the spout nozzle 35 and the Z waterspout outlet 106 is shortened by making it a straight line. This suppresses loss of pressure in the flushing water spouting from the spout nozzle 35 inside the flushing water reservoir 104, resulting in more effective cleaning of the bowl part 101.

Additionally, the flushing water reservoir 104 of the toilet 100A of this second embodiment is formed so as to be closed by the bowl-like curved sidewalls 104*a*. Therefore, any foreign matter that might be carried into the flushing water reservoir 104 with the pooled water in the bowl part 101 is moved along the curved sidewalls 104*a* to the recess 104*b* side. As the spout nozzle 35 is located in the recess 104*b*, flushing water spouted from the spout nozzle 35 also carries off any foreign matter in the recess 104*b* out of the flushing water reservoir 104. Thus, pollution in the flushing water reservoir 104 by the foreign matter can be suppressed.

Figure 21:
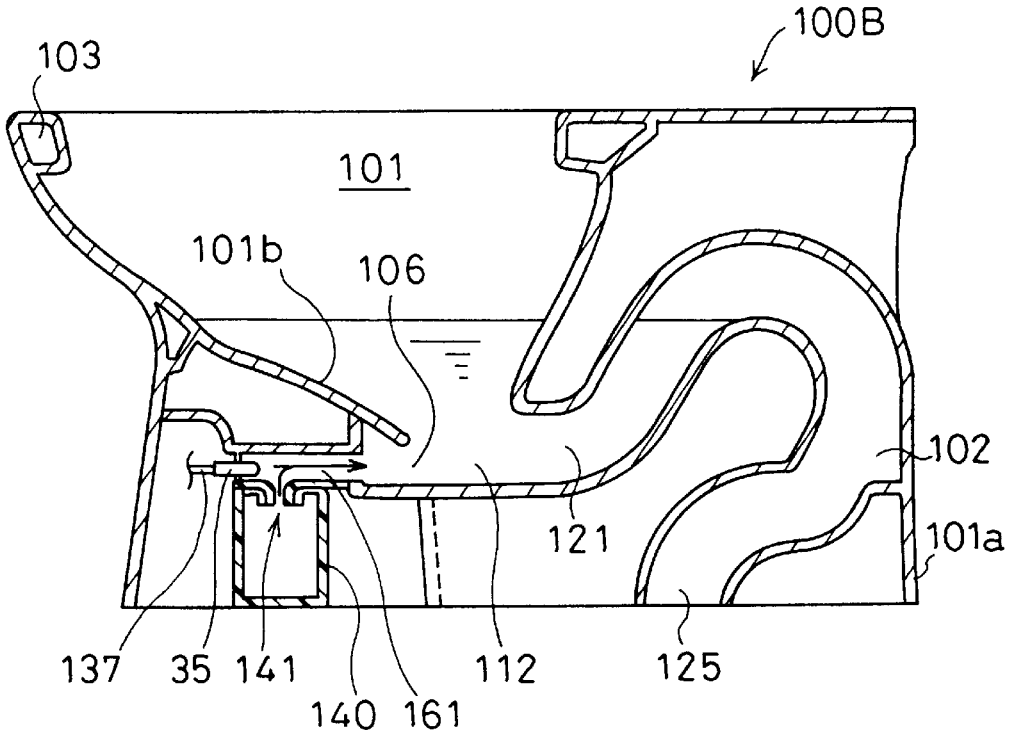
FIG. 21 is a simplified cross-sectional view of a first variation of a toilet 100B of a second embodiment.

A variation of the toilet 100A according to this second embodiment will now be described. As shown in the simplified cross-sectional view of FIG. 21, a first variation toilet 100B has a flushing water container 140 instead of a flushing water reservoir 104. The flushing water container 140 is attached by screwing it on to a thread formed around the communicating hole 141. In addition, via the communicating hole 141, the flushing water container 140 communicates with the Z water conduit 161 connected to the Z waterspout outlet 106. Thus, the flushing water container 140 is detachably attached, so different capacity flushing water containers 140 can be used to meet various water economy targets. If the target is to use 4 liters, for example, a 0.8 liters flushing water container 140 would be used.

Moreover, a 1.1 liters flushing water container 140 would be used for a 6 liters target, and a 2.0 liters flushing water container 140 would be used for an 8 liters target. A spout nozzle 35 connected to a connection tube 137 is disposed at the back of the Z water conduit 161 (the left side, with reference to the drawing). In this case, if flushing water is pooled in the bowl part 101, the flushing water can be flowed into the flushing water container 140 via the Z waterspout outlet 106, the Z water conduit 161 and the communicating hole 141 and stored in a full amount.

Thus, feeding flushing water to the connection tube 137 generates a 1 to 2 kgf/cm$^2$ high velocity flow of flushing water from the spout nozzle 35 to the Z water conduit 161. As the Z water conduit 161 communicates with the flushing water container 140 via the communicating hole 141, flushing water is stored in full in the flushing water container 140, so the spout of water from the spout nozzle 35 becomes a jet flow involving a large quantity of water from the flushing water container 140 via the communicating hole 141. For this reason, this jet flow with involvement of water from the flushing water container 140 is spouted through the Z waterspout outlet 106 directly toward an inlet 121 of waste trap 102, like a jet flow generated by a jet pump. Thus, an enormous volume of flushing water is supplied to the waste trap 102 all at once through the flow rate amplification and the instantaneous flow rate increment by the jet pump. Filth in the filth hopper part 112 is thereby forced into the waste trap 102 by this enormous volume of flushing water. Enhanced cleaning performance and high water economy are therefore also provided by the toilet 100B of the first variation. Water economy can also be enhanced further by the toilet 100B of the first variation wherein the flushing water container 140 can be changed so as to match different flushing water economy targets. Specifically, the amount of filth excreted by the users of a toilet in an institution for young children, such as a kindergarten or a nursery, is generally small. Therefore, a target amount of flushing water consumption in these institutions can be set at a level lower than ordinary family homes, and thus the actual effect of water economization can be enhanced by selecting a smaller flushing water container 140 that matches the water consumption target.

Figure 22:
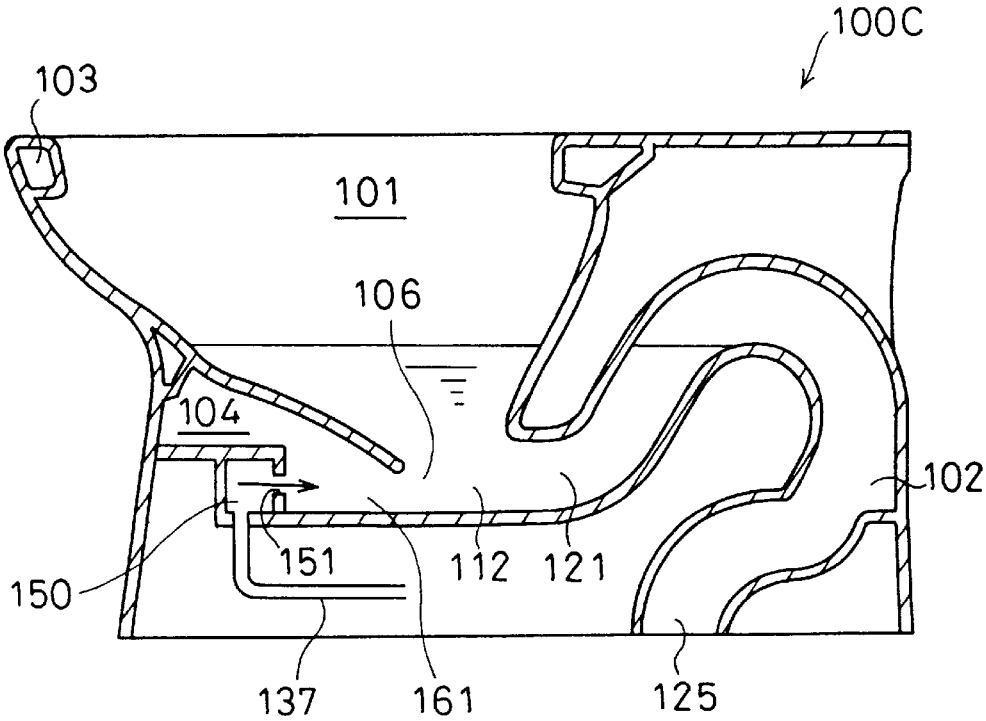
FIG. 22 is a simplified cross-sectional view of a second variation of a toilet 100C of the second embodiment.

A second variation of the toilet 100A according to the second embodiment will now be described. As shown In the simplified cross-sectional view of FIG. 22, the toilet 100C of this second variation has a pressure chamber 150 connected to the connection tube 137. The pressure chamber 150 is located below the flushing water reservoir 104 and is connected to the flushing water reservoir 104 and the Z water conduit 161 by an outlet 151 oriented toward the Z waterspout outlet 106. If flushing water is pooled in the bowl part 101, the flushing water can be flowed into the pressure chamber 150 via the Z waterspout outlet 106, the Z water conduit 161 and the outlet 151, and stored in full. The outlet 151 has a smaller diameter than the connection tube 137, so that when flushing water is being supplied from the connection tube 137, the outlet 151 functions like the spout nozzle 35 of the preceding embodiments.

Thus, when the supply of water is supplied to the connection tube 137, the water flows into the pressure chamber 150 at a high pressure of 1 to 2 kgf/cm$^2$, and flows out through the smaller-diameter outlet 151 into the Z water conduit 161 as a high velocity flow. The outlet 151 and the Z water conduit 161 that defines the fluid flow passage of the flushing water together comprise a jet pump. In the Z water conduit 161 a heavy flow is created consisting of the high velocity flow through the outlet 151 mixed with water in the Z water conduit 161 and in the flushing water reservoir 104 connected to the Z water conduit 161. The mixture jetted out by the jet pump spouts from the Z waterspout outlet 106 at the waste trap 102, subjecting the waste trap 102 to a heavy, flow-rate-amplified flushing water. The powerful force of this flushing water flushes filth in the filth hopper part 112 out through the waste trap 102. Enhanced cleaning performance and high water economy can therefore also be provided by this toilet 100C of this second variation. The spout of flushing water can be produced by using the pressure chamber 150 and the bowl part main body formed of porcelain connecting the connection tube 137 to the pressure chamber 150. Therefore, the toilet 100C as the second variation is thus a toilet that provides high cleaning performance and water economy and can be manufactured relatively easily.

A third variation of the toilet 100A according to the second embodiment will now be described. As shown in the simplified cross-sectional view in FIG. 23, a tubular body 170 that defines the fluid flow passage in front of the spout nozzle 35 is fastened to the front end of the spout nozzle 35, and the spout nozzle 35 and the tubular body 170 are integrally formed. The diameter of the spout nozzle 35 and the inside diameter of a through hole 171 in the tubular body 170 are set so that the ratio between the two diameters is in the range of 0.3 to 0.7. The tubular body 170 has a side hole 172 in the sidewall via which the spout of water from the spout nozzle 35 can involve flushing water from the flushing water reservoir 104. The tubular body 170 functions as a throat, and with the spout nozzle 35 constitutes a jet pump. The integrated device of the spout nozzle 35 and the tubular body 170 is fastened to a bowl part wall forming part of the flushing water reservoir 104 by a bushing 173, and the spout nozzle 35 is connected to the connection tube 137.

Thus, feeding flushing water to the connection tube 137, the flushing water spouted form the spout nozzle 35 flows through the through hole 171 of the tubular body 170 as a high velocity flow at a high pressure of 1 to 2 kgf/cm$^2$ as indicated by the white arrow. As the through hole 171 communicates with the flushing water reservoir 104 via the side hole 172, so the spout of water from the spout nozzle 35 becomes a jet flow involving a large quantity of water from the flushing water reservoir 104 into inside of the through hole 171 via the side hole 172 as indicated by the solid line arrow. For this reason, this jet flow with involvement of water from the flushing water reservoir 104 is spouted through the front end of the through hole 171, that is, the Z waterspout outlet 106 directly toward an inlet 121 of waste trap 102, like a jet flow generated by a jet pump. A part of the front end of the tubular body 170 is cut away to provide a connection between the flushing water reservoir 104 and the Z waterspout outlet 106, so when the flow of flushing water spouts out from the end of the tubular body 170 in the direction indicated by the solid black arrow, flushing water from the flushing water reservoir 104 is involved through the cutaway into the Z water conduit 161, as indicated by the dashed arrow. As a result, the waste trap 102 receives all at once a heavy flow of the flushing water after a first stage flow rate amplification generated by a jet pump comprised of the spout nozzle 35 and the tubular body 170 and a second stage flow rate amplification produced by the involvement of the flushing water at the front end of the tubular body 170. The powerful force of this flushing water flushes filth in the filth hopper part 112 into the waste trap 102. Therefore, this toilet according to the third variation also provides definitely enhanced cleaning performance and high water economy.

In the toilet of the third variation, the integrated structure of the spout nozzle 35 and the tubular body 170 helps to simplify handling at such a time as assembly and maintenance. The integrated structure of both also ensures the maintenance of the positional relationship between the spout nozzle 35 and the through hole 171 in the tubular body 170. Moreover, the spout nozzle 35 and the tubular body 170 are formed of such material as metal or resin having excellent dimensional precision. Therefore, the toilet of the third variation ensures spouting of the flushing water after the flow rate amplification and instantaneous flow rate increment, like the jet flow by the jet pump described above, and provides definitely high cleaning performance and enhanced economization of water consumption.

Figure 23:
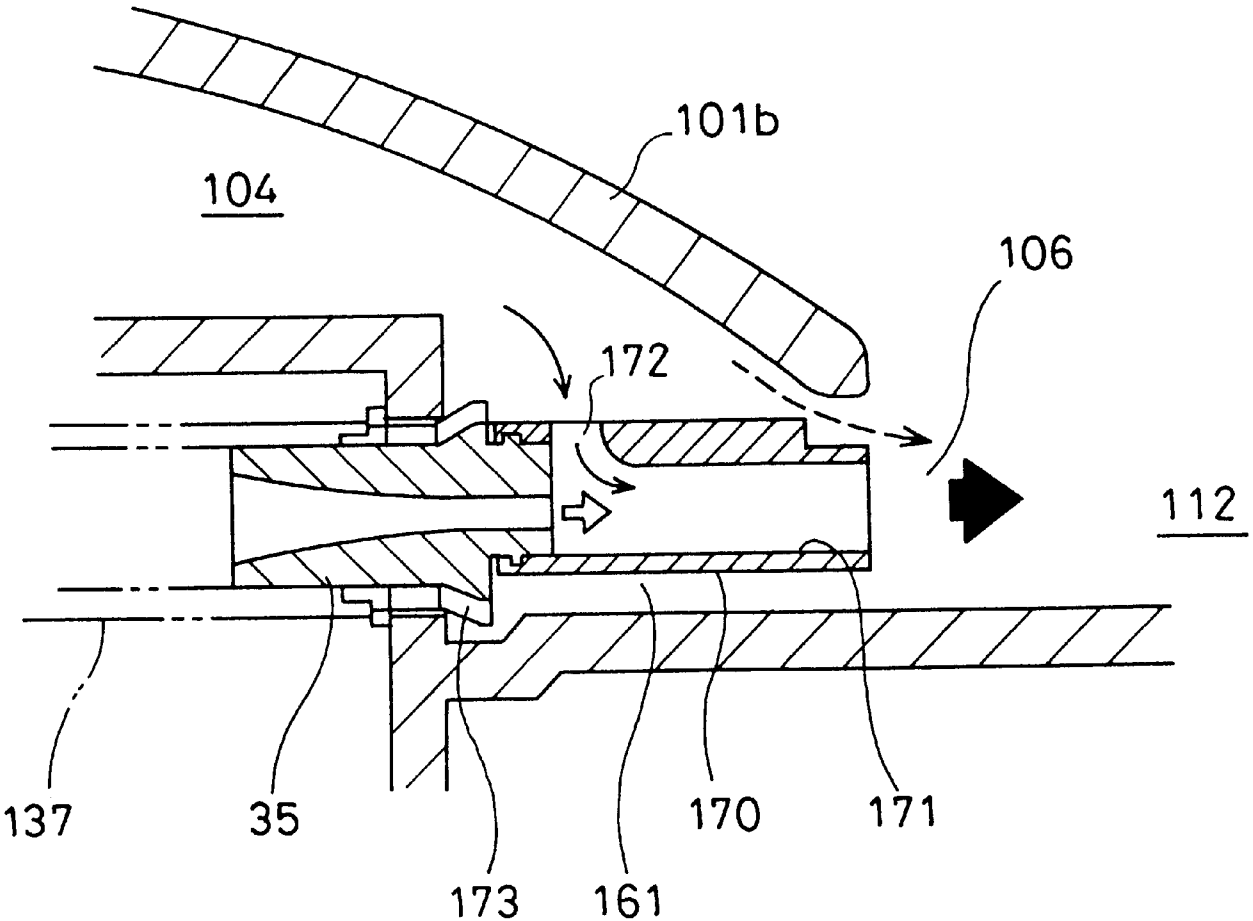
FIG. 23 is a magnified cross-sectional view of principal parts of a third variation of the second embodiment.

A further modification can be applied to this third variation, consisting of using a slightly truncated tubular body 170, indicated in FIG. 23 by the single-dot-and-dashed line. With that configuration, water spouted through the end surface of the tubular body 170 involves flushing water from the flushing water reservoir 104 as it passes through the Z waterspout outlet 106. With the truncated tubular body 170 and the spout nozzle 35 constituting a jet pump, this variation also uses multi-stage amplification that feeds a large volume of flushing water into the waste trap 102, all at once.

Figure 24:
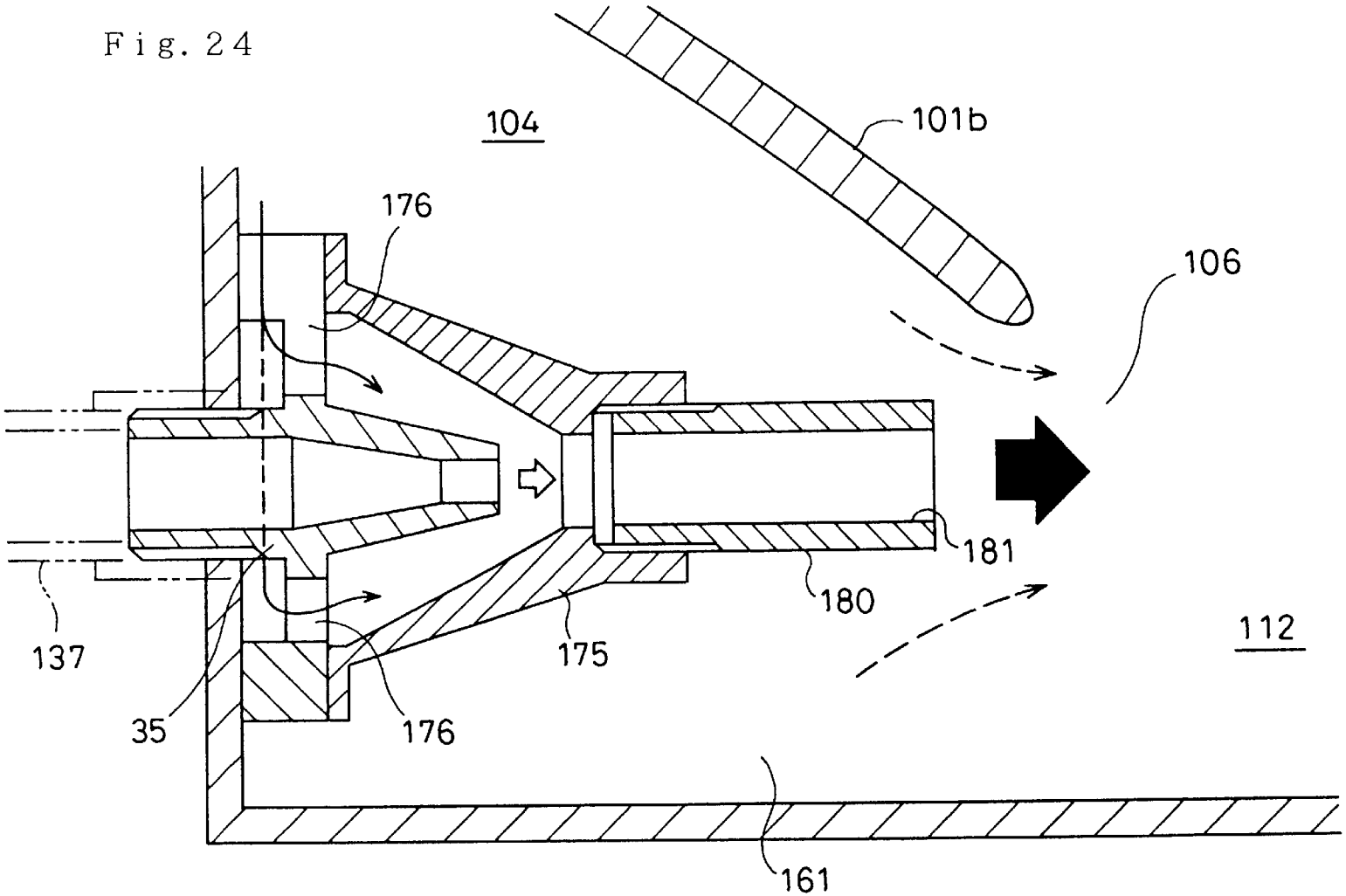
FIG. 24 is a magnified cross-sectional view of principal parts of a fourth variation of the second embodiment.

A fourth variation of the toilet 100A according to the second embodiment will now be described. The fourth variation also has a spout nozzle 35 and a tubular body. As shown in FIG. 24, which shows the principal parts in cross-section, a tubular body 180 is attached via leg member 175 facing the spout nozzle 35 connected to the connection tube 137. The spout nozzle 35, the leg member 175 and the tubular body 180 are integrally formed together. The diameter of the spout nozzle 35 and the inside diameter of a through hole (opening) 181 in the tubular body 180 are set so that the ratio between the two diameters is in the range of 0.3 to 0.7. The leg member 175 has a plurality of equidistantly spaced ports 176 in the tapered sidewall. Flushing water in the flushing water reservoir 104 can be led into the tubular body 180 via the ports 176 and a space between the tip of the spout nozzle 35 and the left end of the tubular body 180. The leg member 175 and the tubular body 180 form a throat that with the spout nozzle 35 constitute a jet pump. The integral device of the spout nozzle 35, the leg member 175 and the tubular body 180 is attached to the toilet by screwing the back end of the spout nozzle 35 into a fixing hole in a wall that is part of the flushing water reservoir 104, and the connection tube 137 is then connected to the spout nozzle 35.

Thus, feeding flushing water to the connection tube 137, the flushing water spouted form the spout nozzle 35 flows through the through hole 181 of the tubular body 180 as a high velocity flow at a high pressure of 1 to 2 kgf/cm$^2$ as indicated by the white arrow. When the flushing water from the spout nozzle 35 flows through the through hole 181, the spout of water from the spout nozzle 35 becomes a jet flow involving a large quantity of water from the flushing water reservoir 104 into inside of the through hole 181 via the ports 176 as indicated by the solid line arrow. For this reason, this jet flow with involvement of water from the flushing water reservoir 104 is spouted through the front end of the through hole 181, that is, the Z waterspout outlet 106 toward an inlet 121 of waste trap 102, like a jet flow generated by a jet pump. The tubular body 180 does not obstruct the flow of flushing water between the flushing water reservoir 104 and the Z waterspout outlet 106, so around the end of the tubular body 180 flushing water that spouts out toward the Z waterspout outlet 106 from the tubular body 180, as indicated by the solid black arrow, involves water from the flushing water reservoir 104, as indicated by the dashed arrows. As a result, the waste trap 102 receives all at once a heavy flow of the flushing water after a first stage flow rate amplification generated by a jet pump comprised of the spout nozzle 35 and the tubular body 180 and a second stage flow rate amplification produced by the involvement of the flushing water at the front end of the tubular body 180. The powerful force of this flushing water flushes filth in the filth hopper part 112 into the waste trap 102. Therefore, the toilet according to the fourth variation also provides definitely enhanced cleaning performance and high water economy. In the same way as in the third variation, simplification of handling can be realized.

Figure 25:
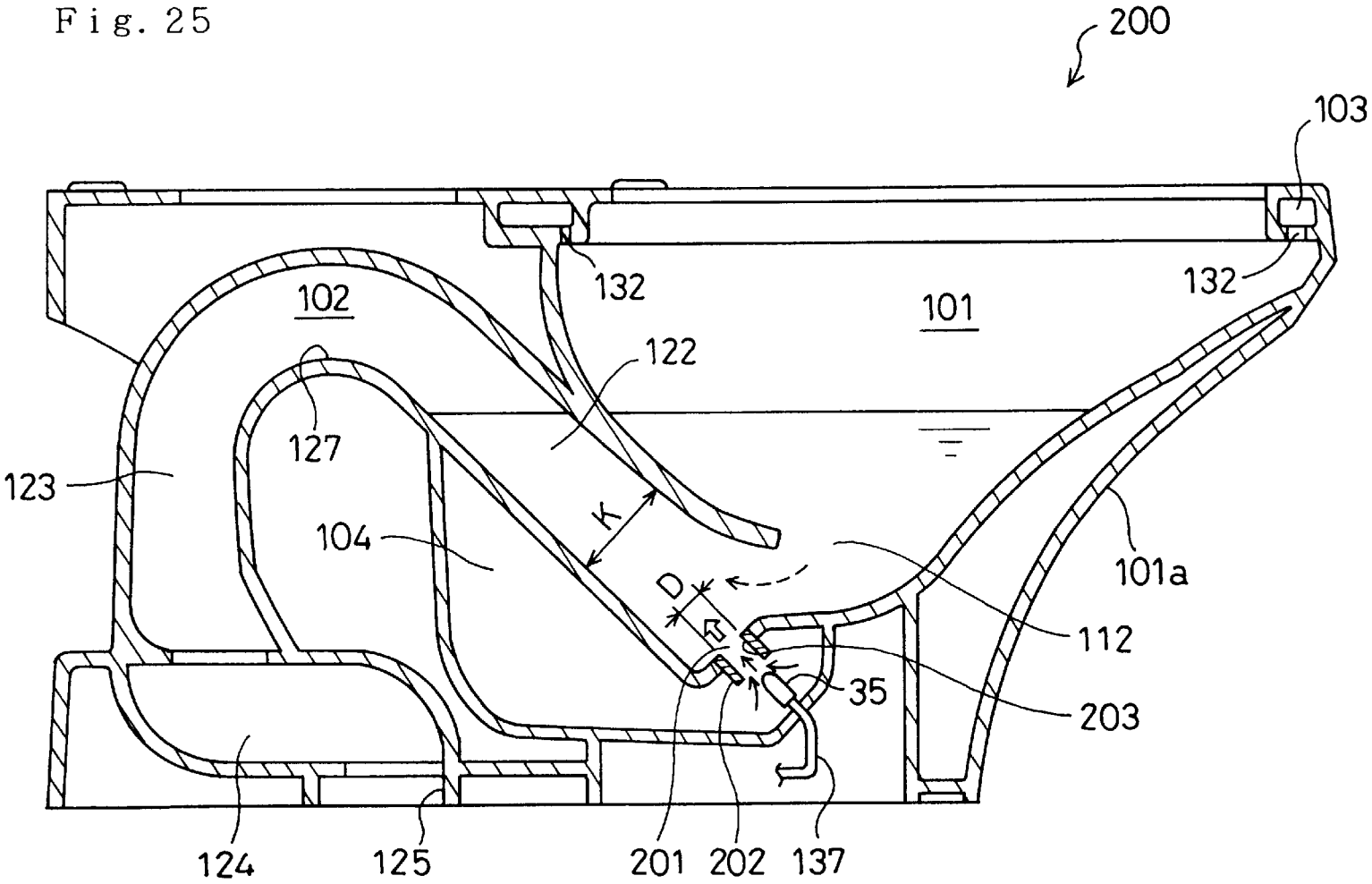
FIG. 25 is a simplified cross-sectional view of a toilet 200 according to a third embodiment.

A toilet according to a third embodiment will now be described, with reference to FIG. 25 showing the toilet 200 in cross-section. The toilet 200 according to the third embodiment has a waste trap 102 connected to the filth hopper part 112. The waste trap 102 has an upstream tube 122 that is connected to the filth hopper part 112 with a rise that starts from a point lower than the filth hopper part 112, and an inlet 121 beside the rise point of upstream tube. As in the preceding embodiments, the waste trap 102 has a downstream tube 123, a horizontal draw channel 124 and a waste outlet 125 from the upstream tube 122.

As in the other embodiments, the toilet 200 has a flushing water reservoir 104. The flushing water reservoir 104 comprises at a central part of the lowest end surface thereof a communicating hole 201 communicating with the upstream tube 122. A tubular body 202 is fixed to the communicating hole 201 in parallel with the flow path of the upstream tube 122. The tubular body 202 is fixed so that it reaches to the flushing water reservoir 104. Below the tubular body 202 is a spout nozzle 35, arranged oriented toward a through hole 203 in such tubular body. Thus, the spout nozzle 35 is oriented toward the upstream tube 122 via the tubular body 202. Thus, a jet pump constituted by the spout nozzle 35 and the tubular body 202 is oriented toward the flow path of the upstream tube 122. The through hole diameter D of the tubular body 202 and the flow path diameter K of the upstream tube 122 are set so that the ratio D/K ranges approximately from 0.3 to 0.6. A connection tube 137 is connected to the spout nozzle 35, as in the other embodiments.

As shown, the flushing water reservoir 104 communicates with the upstream tube 122 and the filth hopper part 112, via the hole 203 in the tubular body 202. Therefore, if flushing water is pooled in the bowl part 101, the flushing water also flows into the flushing water reservoir 104 via the hole 203 and the flushing water is stored inside the flushing water reservoir 104 at the same level as the pooled water in the bowl part 101. In this embodiment, the flushing water reservoir 104 has a capacity of about 0.5 liters, which constitutes the amount of flushing water used to clean the bowl part.

As in the first embodiment the toilet 200 has a water supply valve 105 (not shown) and a switching valve 41 connected to the downstream side of the water supply valve 105 to provide the flushing water for the toilet bowl cleaning sequence like as rim/jet/rim.

In the toilet 200 according to the third embodiment structured above, feeding flushing water to the connection tube 137 by the water supply valve 105, the flushing water spouted form the spout nozzle 35 flows through the through hole 203 of the tubular body as a high velocity flow at a high pressure of 1 to 2 kgf/cm$^2$. The spout of water from the spout nozzle 35 becomes a jet flow involving a large quantity of water from the flushing water reservoir 104. This jet flow and the involved water from the flushing water reservoir 104 form a flow that spouts out from the tubular body 202 into the upstream tube 122 like a spout generated by a jet pump. Based on the orientation of the spout nozzle 35, the flow of flushing water from the tubular body 202 flows along the flow path of the upstream tube 122, starting from the rising point of the upstream tube 122. The pooled water (flushing water) in the recess at the junction of the upstream tube 122 and the filth hopper part 112 is involved in this flow from the tubular body 202, as indicated by the dashed arrow. That is, flushing water flows along the flow path of the upstream tube 122 in a state after occurrence of the flow rate amplification by the jet pump comprising the spout nozzle 35 and the tubular body 202 and the flow rate amplification and instantaneous flow rate increment by the involvement of the pooled water.

Thus, an enormous volume of flushing water is supplied to the upstream tube 122 of the waste trap 102 all at once through the flow rate amplification and the instantaneous flow rate increment by the jet pump. Filth in the filth hopper part 112 is thrust up strongly into the flow path of the upstream tube 122 along with this heavy flow of flushing water. Moreover, along with the upstream tube 122 flow path elements downstream of the upstream tube 122 such as downstream tube 123 are rapidly filled by this flow-rate-amplified flushing water, quickly creating the siphon effect. The involvement of the pooled water by the flow of flushing water that jets from the tubular body 202 to the upstream tube 122 creates a broad flow, as indicated by the white arrow, that can move any filth at the rising point of the upstream tube 122 along the upstream tube 122 together with the surrounding water. This ensures that filth is reliably flushed into the waste trap 102, regardless of the amount of such filth in the bowl part. This also provides economical use of water, since only the spout of flushing water from the spout nozzle 35 is used for cleaning.

Figure 26:
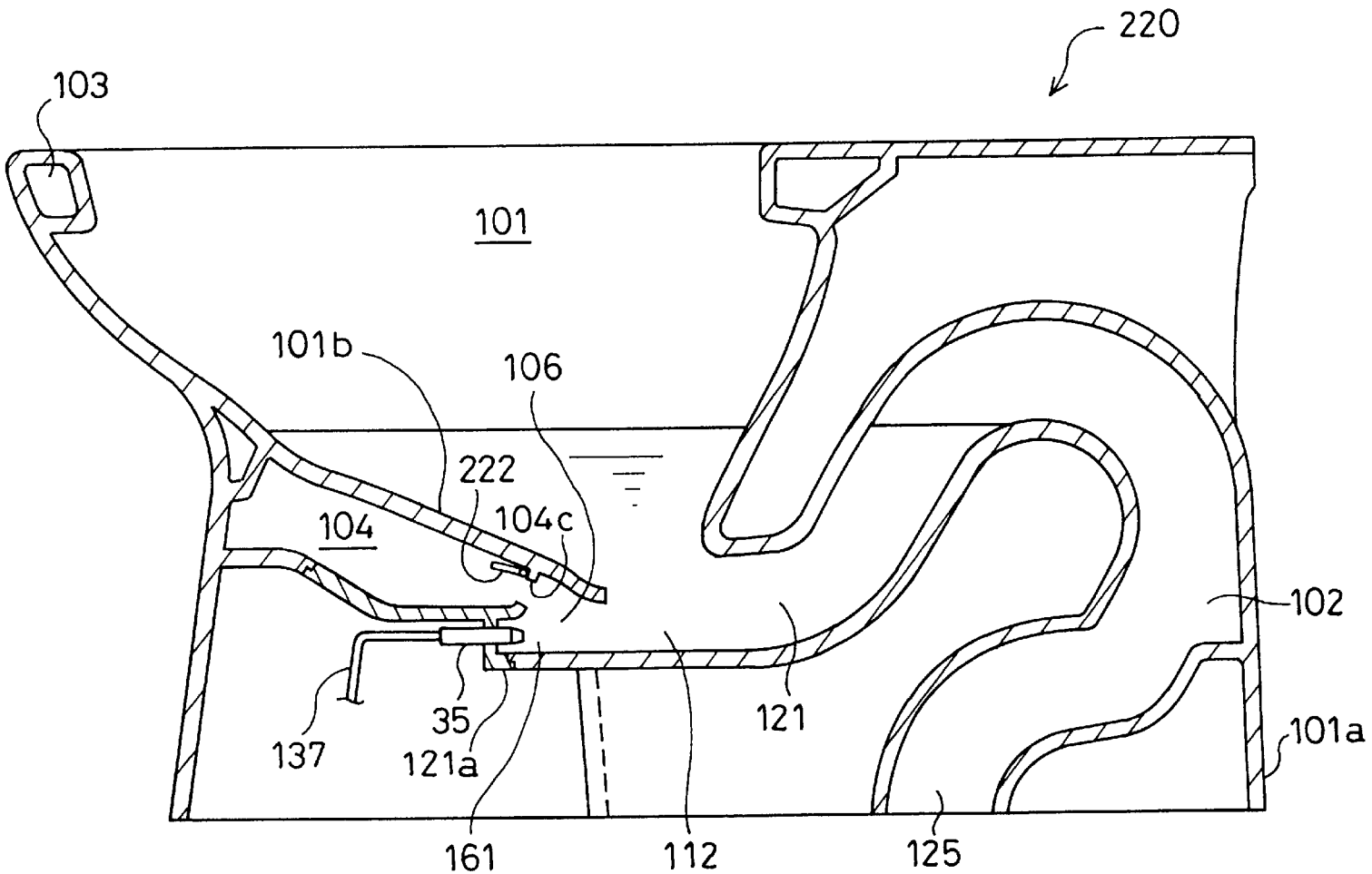
FIG. 26 is a simplified cross-sectional view of a toilet 220 according to a fourth embodiment.
Figure 27:
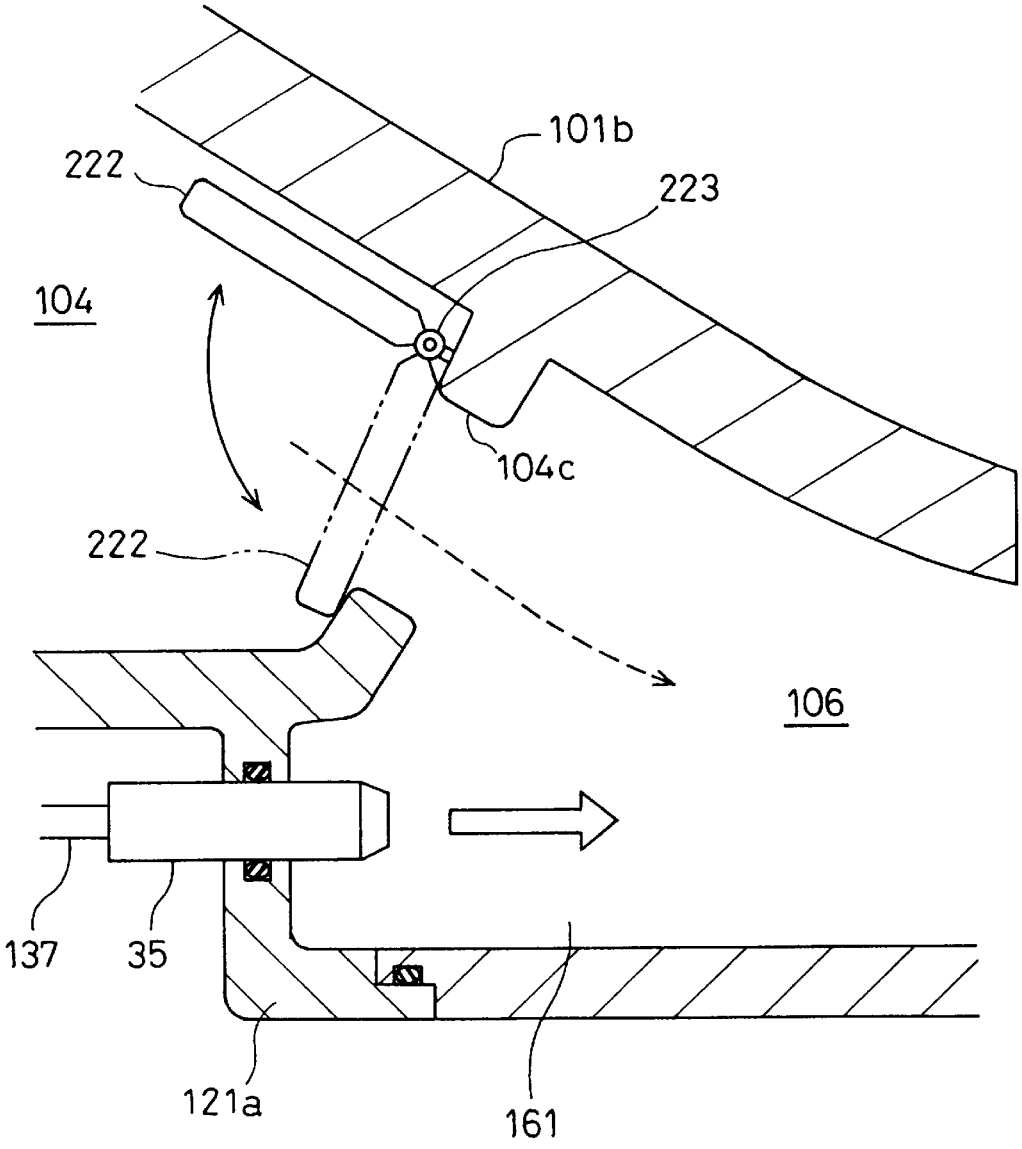
FIG. 27 is a magnified cross-sectional view of principal parts of toilet 220.

A fourth embodiment will now be described. FIG. 26 is a simplified cross-sectional view of a toilet 220 according to the fourth embodiment, and FIG. 27 is a magnified simplified cross-sectional view of the principal parts. The toilet 220 according to the fourth embodiment has a configuration that allows the communication between the flushing water reservoir 104 and the filth hopper part 112 to be switched between a communication state and a non-communication state. As shown in FIG. 26, the flushing water reservoir 104 formed separately from the bowl part 101 has a port 104*c* at the lower end of bulkhead 101*b*, and a open/close member 222 for closing and opening this port. The spout nozzle 35 is positioned more toward the front of the bowl part (the left side, in the drawing) than the port 104*c*, and the space between the spout nozzle 35 and the Z waterspout outlet 106 forms a Z water conduit 161, as in the toilet 100 described above. The spout nozzle 35 and the Z water conduit 161 constitute a jet pump.

As shown in FIG. 26, the open/close member 222 is formed of sheet material having high buoyancy attached to the edge of the port 104*c* by a support member 223. While there is water in the flushing water reservoir 104, the open/close member 222 floating on the water keeps the port 104*c* in a non-closed state. To ensure that there is no interference with the open/close member 222 and support member 223 assembly, the spout nozzle 35 is watertightly fastened to a wall 121*a* which is attached to the base wall of the inlet 121 below the bowl part. When water from the flushing water reservoir 104 is being involved by the flow of flushing water from the spout nozzle 35, a suction force work on the open/close member 222 in such direction as to close the port 104*c*. However, the buoyancy force of the open/close member 222 is greater than the suction force, so the port 104*c* remains in the non-closed state as long as there is water in the flushing water reservoir 104.

As in the first embodiment the toilet 220 has a water supply valve 105 (not shown) and a switching valve 41 connected to the downstream side of the water supply valve 105 to provide the flushing water for the toilet bowl cleaning sequence like as rim/jet/rim.

With this toilet 220 according to the fourth embodiment, when the supply of water from the water supply valve 105 is supplied to the connection tube 137, as described above flushing water flows into the Z water conduit 161 from the spout nozzle 35 as a high-velocity, high-pressure flow. As the port 104*c* of the flushing water reservoir 104 is in a non-closed state, the spout of water from the spout nozzle 35 becomes a jet flow involving a large quantity of water from the flushing water reservoir 104 via the port 104*c*. This jet flow and the involved water from the flushing water reservoir 104 form a flow that spouts from the Z waterspout outlet 106 directly toward the inlet 121 of the waste trap 102 like a spout generated by a jet pump. Thus, an enormous volume of flushing water is supplied to the waste trap 102 all at once through the flow rate amplification and the instantaneous flow rate increment by the jet pump. Filth in the filth hopper part 112 is thereby forced into the waste trap 102 by this enormous volume of flushing water. Enhanced cleaning performance and high water economy is therefore also provided by this toilet 220 of the fourth embodiment.

When all the flushing water in the flushing water reservoir 104 is thus involved in the flow from the spout nozzle 35, emptying the flushing water reservoir 104, the port 104*c* is closed by the open/close member 222. With this resulting in air in the flushing water reservoir 104 being involved, there is no jetting of flushing water from the spout nozzle 35. Thus, there is no change from jetting out flushing water drawing flushing water from the flushing water reservoir 104 involved, to jetting out water drawing air instead of the flushing water. This ensures that siphon effect that has started to be formed in the waste trap 102 by the flow with flushing water involved is not broken by the mixing-in of air. There is therefore no return of filth to the bowl part 101 as a result of siphon effect being inadvertently broken.

Even if all the flushing water in the flushing water reservoir 104 is used up, when flushing water is pooled in the bowl part 101, the pooled water can push up the open/close member 222 and flow into the flushing water reservoir 104. So that, flushing water is stored in the flushing water reservoir 104 at all times.

Figure 28:
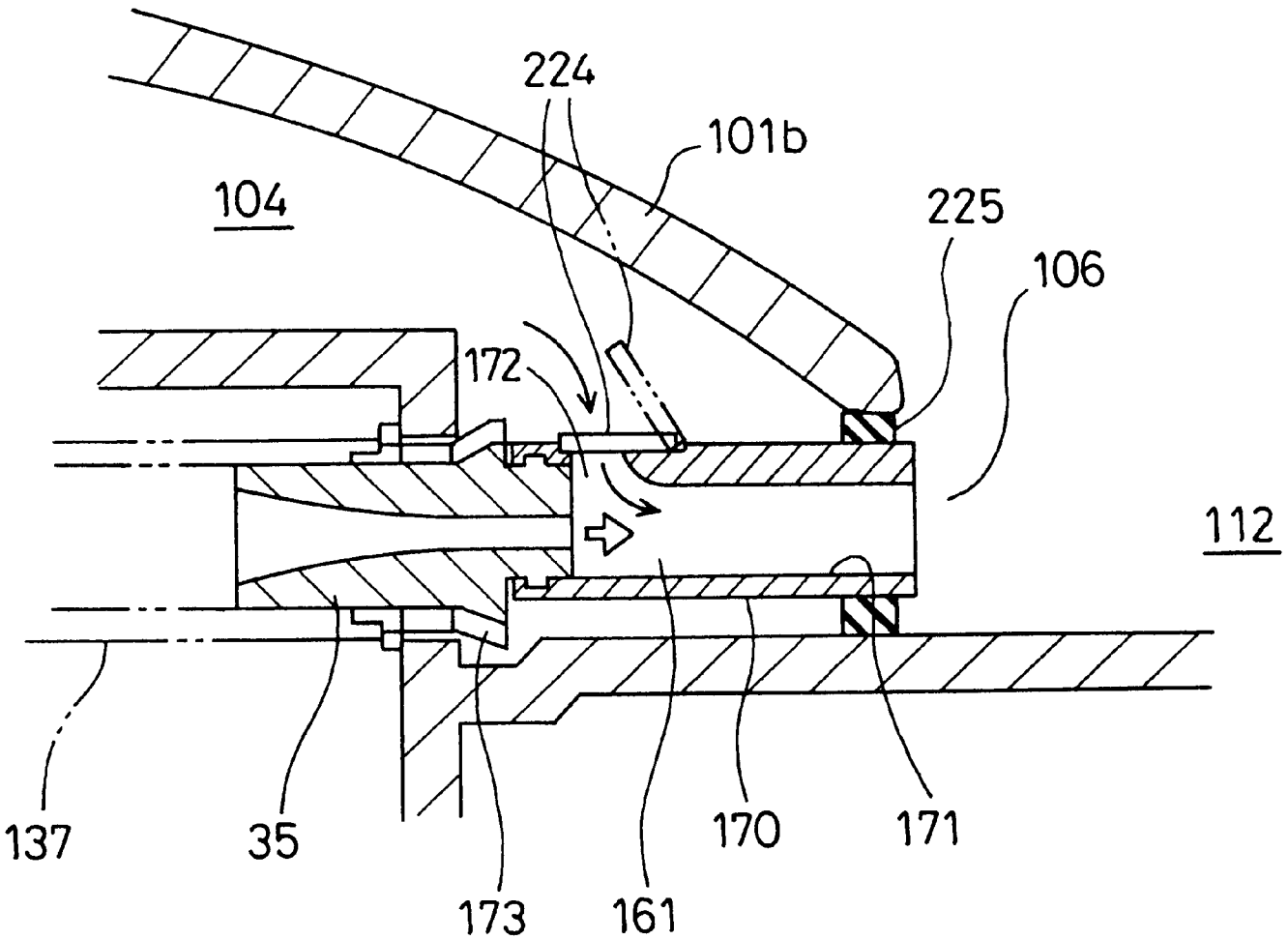
FIG. 28 is a magnified cross-sectional view of principal parts of a first variation of the fourth embodiment.

A variation of the toilet of the fourth embodiment will now be described. In a first variation, the difference is a configuration that does not allow air in the flushing water reservoir 104 to become involved in the water flow from the spout nozzle 35. FIG. 28 is a magnified simplified cross-sectional view of principal parts of the first variation. FIG. 28 shows that, as in the third variation of the toilet 100A of the second embodiment, the spout nozzle 35 is integrally formed with a tubular body 170 that defines the fluid flow passage in front of the spout nozzle 35. The tubular body 170 has a side hole 172 in the sidewall that communicates with through hole 171, and a cover 224 to open and close the side hole 172. Like the open/close member 222 of the fourth embodiment, the cover 224 has a buoyant force that exceeds the suction force generated by the jet of flushing water from the spout nozzle 35. Also in the case of this first variation, therefore, water in the flushing water reservoir 104 can be involved in the jet of water from the spout nozzle 35 as long as there is water in the flushing water reservoir 104. If the flushing water reservoir 104 runs out of water, air is not allowed to mix with the jet of water from the spout nozzle 35. Thus, as in the fourth embodiment, there is therefore no return of filth to the bowl part 101 as a result of siphon effect being inadvertently broken. The toilet of this variation also provides high cleaning performance and high water economy.

In this first variation, also, the front end of the tubular body 170 is sealed by sealant 225 between the tubular body 170 and the bulkhead 101*b* and between the tubular body 170 and the bottom wall of the filth hopper part 112, and the flushing water reservoir 104 communicates with the filth hopper part 112 by through hole 171. Therefore even if all the flushing water in the flushing water reservoir 104 is used up, when water is pooled in the bowl part, the pooled water in the bowl part 101 can flow, pushing up the cover 224, into the flushing water reservoir 104 via the through hole 171. So that, flushing water is stored in the flushing water reservoir 104 at all times.

Figure 29:
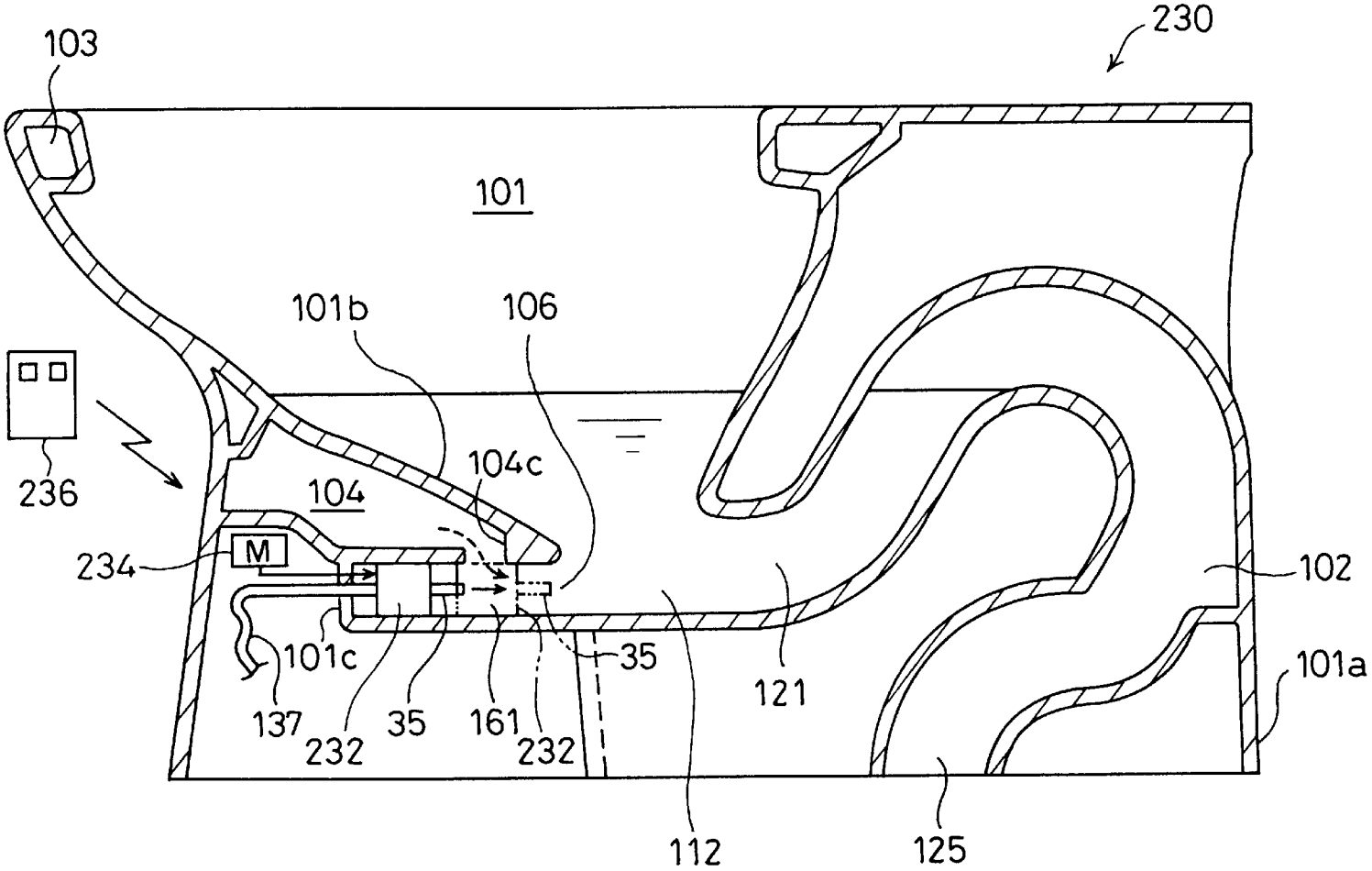
FIG. 29 is a simplified cross-sectional view of a toilet 230 according to a fifth embodiment.

A fifth embodiment will now be described. FIG. 29 is a simplified cross-sectional view of a toilet 230 according to the fifth embodiment. The toilet 230 also has a configuration that allows the connection between the flushing water reservoir 104 and the filth hopper part 112 to be switched between a communication state and a non-communication state. As shown in FIG. 29, the flushing water reservoir 104 formed separately from the bowl part 101 has a port 104*c* at the lower end of bulkhead 101*b*. A nozzle support member 232 is slidably disposed in a Z water conduit 161 below this port; the spout nozzle 35 is fixed to the nozzle support member 232.

The nozzle support member 232 is coupled to a motor 234 located in the bowl part main body 110*a*. The nozzle support member 232 moves watertightly within the Z water conduit 161 according to the rotation of the motor 234. For this, a transmission mechanism for communicating the rotation of the motor 234 to the nozzle support member 232 is provided in the Z water conduit 161 and watertightly through a toilet bowl wall 101*c*. The connection tube 137 is connected to the spout nozzle 35 in the nozzle support member 232 via a watertight passage through the wall 101*c*. The toilet 230 is also provided with a control panel 236 with a button for remotely operating the motor 234. The control panel 236 outputs a corresponding optical signal according to the pressed button; the motor 234 drives according to the optical signal. Thus, by pressing the button, the nozzle support member 232 moves forward and backward and takes a first jetting position, indicated by solid lines in the drawing, or a second jetting position, indicated by double-dots-and-dashed lines. An arrangement is used whereby in coming to the second jetting position the nozzle support member 232 closes the port 104*c* of the flushing water reservoir 104.

Therefore, by retracting the nozzle support member 232 to the first jetting position the flushing water reservoir 104 and the Z water conduit 161 are brought into communication via the port 104*c*, whereby the spout nozzle 35 and Z water conduit 161 form a jet pump. The large volume of involved water from the flushing water reservoir 104 into the flow of water spouting from the spout nozzle 35 serves to amplify the flow rate and to increase the instantaneous flow rate, forming a flow that jets from the Z waterspout outlet 106 toward the inlet 121. Thus, filth can be flushed into the waste trap 102 and the bowl part cleaned by this flow-rate-amplified flushing water when the nozzle support member 232 is moved to the first jetting position. When the communication state between the flushing water reservoir 104 and the Z water conduit 161 is put into a non-communication state by closing the port 104*c* by moving the nozzle support member 232 to the second jetting position, the filth conveyance and the toilet bowl cleaning are achieved by a non-amplified spout of flushing water from the spout nozzle 35.

Thus, cleaning modes can be selectively switched by using the control panel 236 to move the nozzle support piece 232 to the required position. For example, when not much cleaning energy is required for the filth conveyance and the toilet bowl cleaning, such as when only urine has to be flushed, the nozzle support member 232 can be moved to the second jetting position to effect cleaning of the bowl part 101 using just a jet of flushing water from the spout nozzle 35. The other hand, when much cleaning energy is required for the filth conveyance and the toilet bowl cleaning, such as when feces have to be flushed, the nozzle support member 232 can be moved to the first jetting position to effect high-energy flushing by the flow-rate-amplified flushing water.

The use of the motor 234 to move the nozzle support member 232 enables the following variation of the fifth embodiment to be used.

When a flow of flushing water from the spout nozzle 35 is effected with the nozzle support member 232 in the first jetting position, the amount of flushing water in the flushing water reservoir 104 decreases as flushing water is drawn into the flow. The volume of flushing water in the flushing water reservoir 104 is decided at the design stage, and the amount by which the water in the flushing water reservoir 104 is decreased by being involved in the flow is established through experiments and the like. Thus, the amount of time it takes for the water in the flushing water reservoir 104 to run out is also clarified, as measured from the start of the flow from the spout nozzle 35. As such, a configuration can be used whereby after that much time has elapsed, the control panel 236 outputs the optical signal to the motor 234; the motor 234 moves the nozzle support member 232 to the second jetting position. This structure in this variation of the fifth embodiment would close the port 104*c* so no air is mixed in with the flow of water from the spout nozzle 35 without the open/close member 222 and the cover 224. Therefore, in accordance with this variation of the fifth embodiment too, there would be no return of filth to the bowl part 101 as a result of siphon effect being inadvertently broken.

Figure 30:
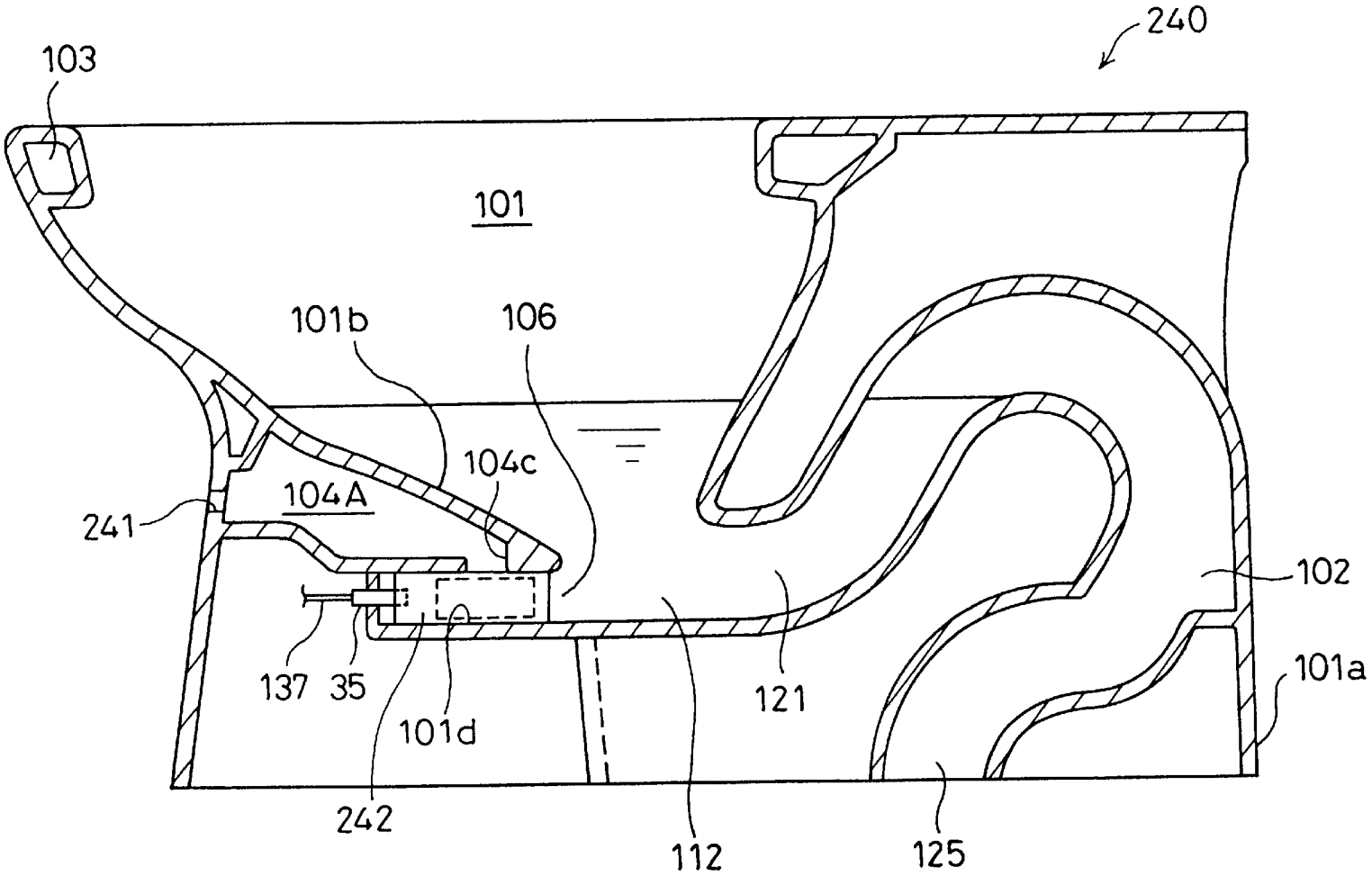
FIG. 30 is a simplified cross-sectional view of a toilet 240 according to a sixth embodiment.

A sixth embodiment will now be described. FIG. 30 is a simplified cross-sectional view of a toilet 240 according to the sixth embodiment. Instead of a flushing water reservoir 104, the toilet 240 has a water reservoir 104A. The water reservoir 104A is formed below the bulkhead 101*b* in communication with the atmosphere via an open hole 241. Thus, the water reservoir 104A is designed to have air, not flushing water. Although for illustration purposes the hole 241 is shown as being below the liquid surface of the pooled water in the bowl part 101, it is actually above the liquid surface.

The water reservoir 104A has a port 104*c* at the lower end of the bulkhead 101*b* like as the above fifth embodiment. A Z water conduit forming mechanism 242 is watertightly fastened to a lower area 110*d* below the port 104*c*. A spout nozzle 35 is fixed to the bowl part main body 101*a* with the tip of the spout nozzle 35 in the Z water conduit forming mechanism 242.

Figure 31:
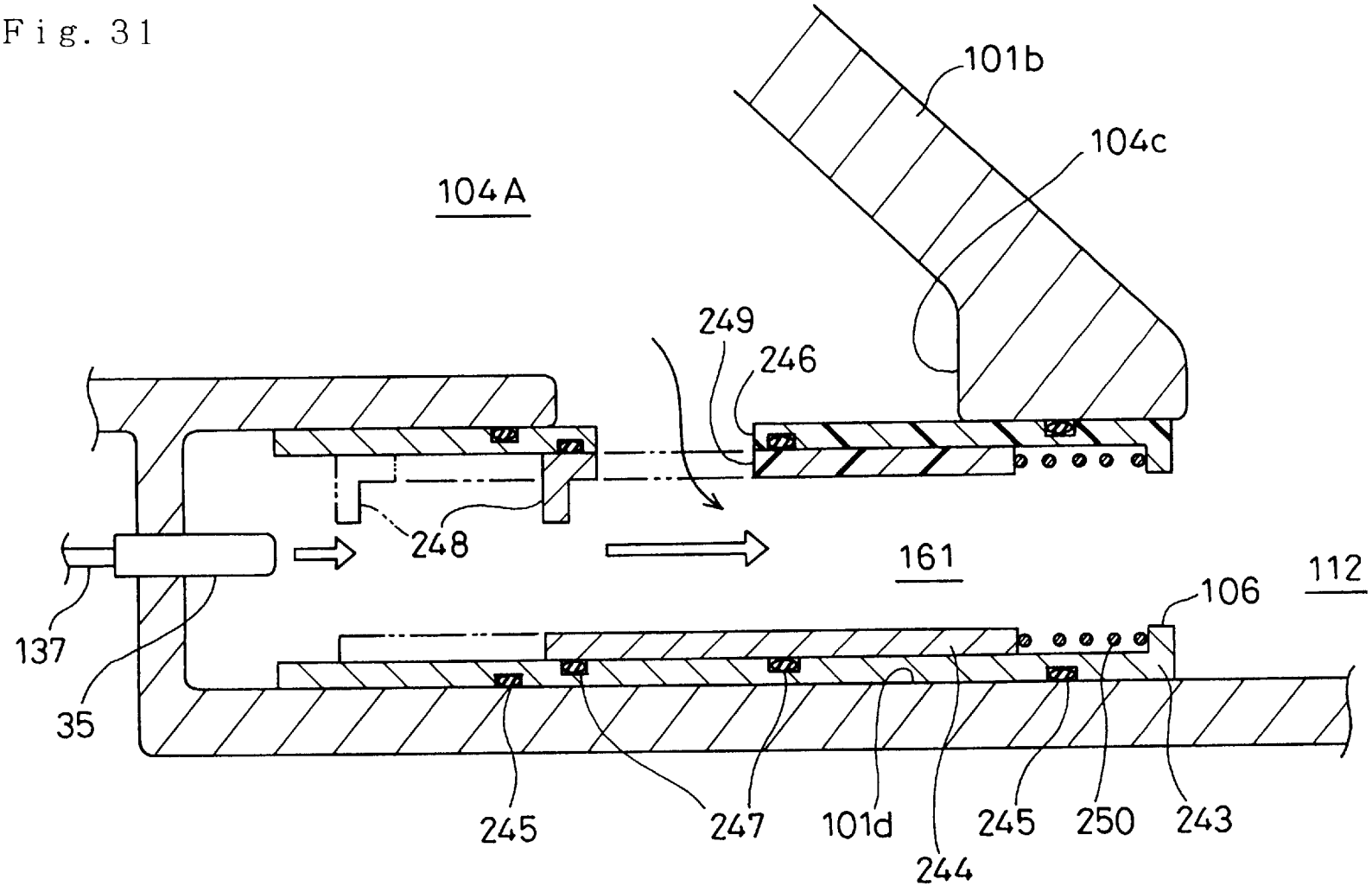
FIG. 31 is a magnified end view of the principal parts showing the peripherals of the Z water conduit forming mechanism 242 of the toilet 240.

The Z water conduit forming mechanism 242 defines the Z water conduit for the spout of flushing water jetted from the spout nozzle 35, and opens and closes the port 104*c* in step with the spout of flushing water jetted from the spout nozzle 35. As shown by FIG. 31, which is a magnified view of the part with the Z water conduit forming mechanism 242, the Z water conduit forming mechanism 242 has an outer tubular body 243 located on the lower area 110*d*, and inside, an inner tubular body 244.

The outer tubular body 243 is fitted and fastened watertightly to the lower area 101*d* by seal rings 245, and an end port on the side of the filth hopper part 112 is a Z waterspout outlet 106. The outer tubular body 243 leads the spouted flushing water from the spout nozzle 35 through the end port on the other side thereof. A port 246 is formed in the sidewall of the outer tubular body 243, overlapping the port 104*c*.

The inner tubular body 244 can slide along the inside wall of the outer tubular body 243. Seal rings 247 provide a watertight seal between the inner tubular body 244 and outer tubular body 243. The inner tubular body 244 has a tongue 248 extending down on the side with the spout nozzle 35. When the spout nozzle 35 spouts flushing water, the tongue 248 receives resistance from the jet of water flowing from the spout nozzle 35. The inner tubular body 244 has a side port 249 formed in the side wall that overlaps the port 246 when the inner tubular body 244 is at the position indicated by the solid lines (hereinafter referred to as the nozzle spouting position). The inner tubular body 244 is provided with whirl-stoppers, which are not shown in the drawing, to prevent it from rotating on its axis.

A spring 250 is provided between the right end (with respect to the drawing) of the inner tubular body 244 and the rim of the Z waterspout outlet 106, urging the inner tubular body 244 toward the end with the spout nozzle 35. When there is not jet of water issuing from the spout nozzle 35 and the tongues 248 are not therefore receiving the resistance therefrom, the inner tubular body 244 receives the applied force of the spring 250 and are in the position indicated by the double-dots-and-dashed lines (hereinafter referred to as the initial position). When flushing water is spouted from the spout nozzle 35, the tongues 248 receive the discharge resistance, the inner tubular body 244 is moved to the nozzle spouting position, at which the side port 246 is overlapped by the side port 249. The applied force of the spring 250 is adjusted so that during discharge of flushing water the inner tubular body 244 and outer tubular body 243 are in this positional relationship.

As shown in the drawing, with the spout nozzle 35 being oriented along the center axis of the inner and outer tubular bodies 244 and 243, the through holes in the tubular bodies form a Z water conduit 161.

The spouting of flushing water in the toilet 240 will now be described. When flushing water from a water supply source is supplied to the connection tube 137, as described above the flushing water flows into the Z water conduit 161 from the spout nozzle 35 as a high-velocity, high-pressure flow. With the start of this flow of flushing water, receiving the resistance of the flow, the inner tubular body 244 starts to move rightward from its initial position to the nozzle spouting position. In this position, the side ports 246 and 249 of both the tubular bodies overlap and these ports are overlapped by the port 104*c*. Thus the water reservoir 104A comes to communicate with the Z water conduit 161 and thus the fluid in the water reservoir 104A (air in this case) is allowed to flow into the Z water conduit 161. Thus, when the two tubular bodies are in this positional relationship, the spout nozzle 35 and Z water conduit 161 constitute a jet pump.

With flushing water flowing from the spout nozzle 35, large quantities of air from the water reservoir 104A are involved through the openings 104*c*, 246 and 249 and into the flow from the spout nozzle 35, forming the flow into a jet flow. This jet flow with the involved air forms a flow that spouts from the Z waterspout outlet 106 toward the inlet 121 of the waste trap 102 as a spout generated by a jet pump. Although it is air that is involved, in terms of flow rate amplification and the instantaneous flow rate increment, the effect is the same as when it is water that is involved. Thus, an enormous volume of flushing water is supplied to the waste trap 102 all at once through the flow rate amplification and the instantaneous flow rate increment by the jet pump. Filth in the filth hopper part 112 is thereby forced strongly into the waste trap 102 by this enormous volume of flushing water. Enhanced cleaning performance and high water economy is therefore also provided by this toilet 240 of the sixth embodiment.

When the flow of flushing water from the spout nozzle 35 stops, the inner tubular body 244 is returned to the initial position by the applied force of the spring 250. Consequently, the side ports of both the cylindrical bodies are blocked by the side walls of both the tubular bodies, removing the communication between the water reservoir 104A and the Z water conduit 161. Therefore, the pooled water in the filth hopper part 112 will not flow into the water reservoir 104A inadvertently. The pooled water can flow into the water reservoir 104A until openings 246 and 249 are completely blocked, but the amount involved is very small and does not constitute a problem, since it is involved in the next flow from the spout nozzle 35 along with the air.

In this toilet 240 of the sixth embodiment, the involvement of air is used instead of water for flow rate amplification, and thus water economy is enhanced by the amount of water not used.

Figure 32:
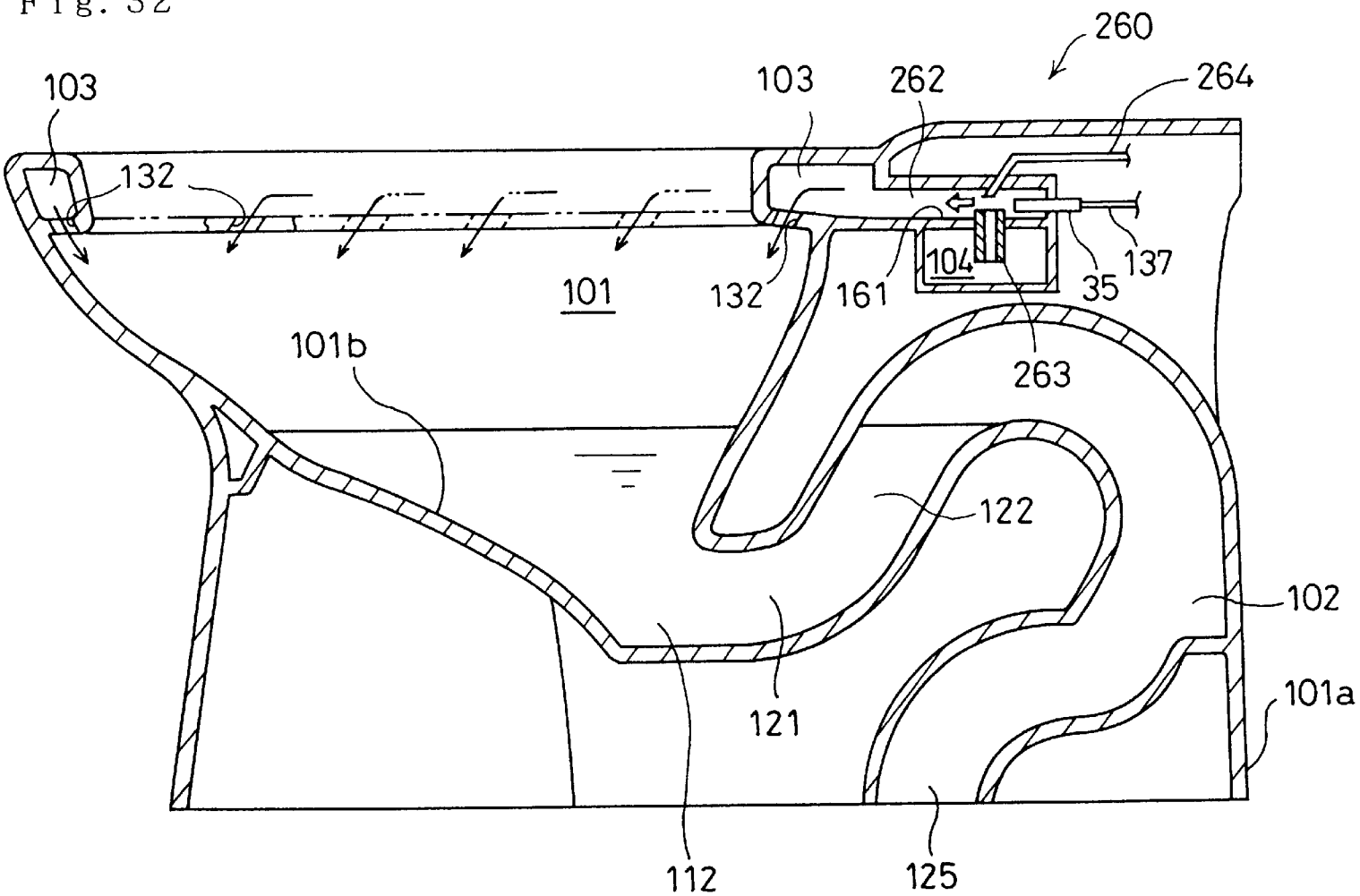
FIG. 32 is a simplified cross-sectional view of a toilet 260 according to a seventh embodiment.
Figure 33:
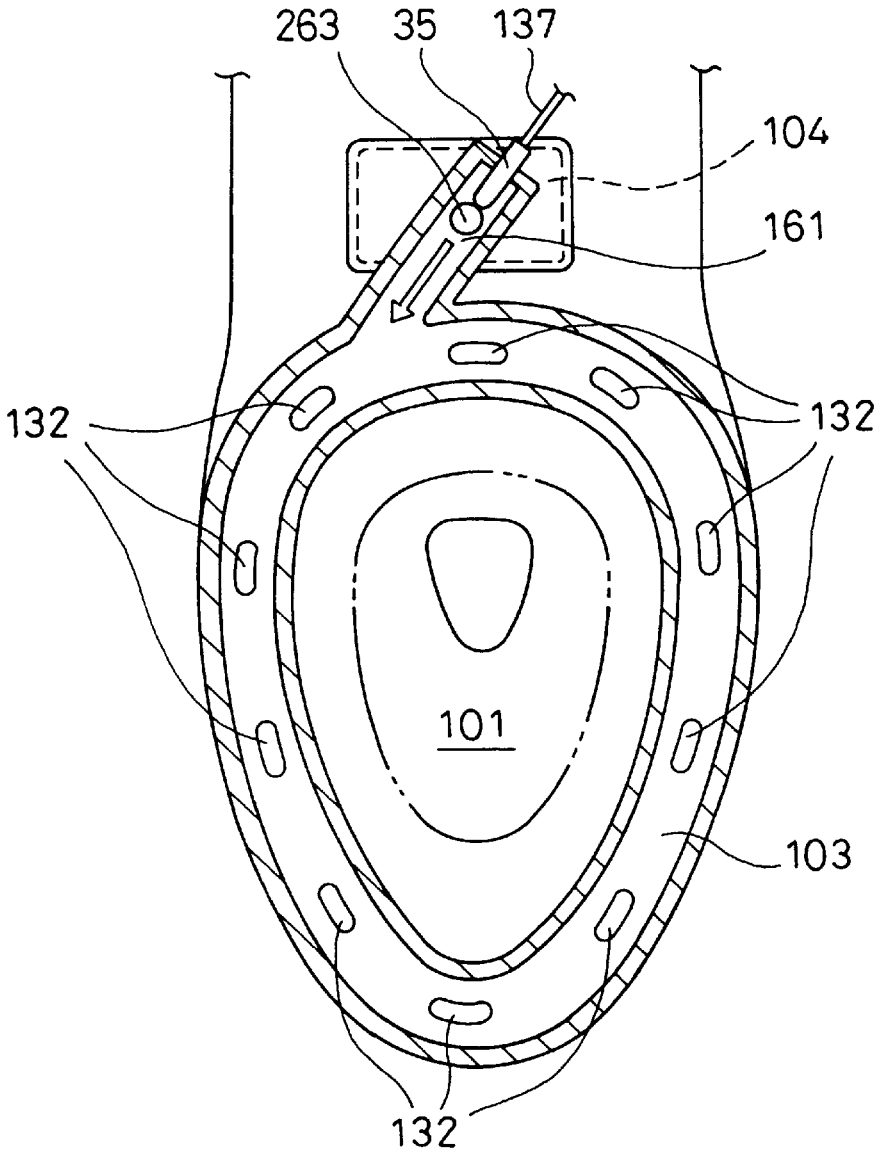
FIG. 33 is a simplified cross-sectional view of the rim part of the toilet 260.

A seventh embodiment will now be described. FIG. 32 is a simplified cross-sectional view of a toilet 260 according to the seventh embodiment, and FIG. 33 is a simplified cross-sectional view of the rim part of the toilet. The difference between toilet 260 and the toilets of the other embodiments is that toilet 260 uses only rim-based cleaning. In common with the other embodiments, toilet 260 has a waste trap 102 via which filth and flushing water in the filth hopper part 112 are drained away.

The toilet 260 has a channel part 262 disposed to the rear of the bowl part to lead flushing water to rim channel 103. The channel part 262 has a Z water conduit 161 that is connected to the rim channel 103, and a flushing water reservoir 104 connected to the conduit by a supply throat 263. As shown in FIG. 33, the Z water conduit 161 is arranged so as to lead flushing water in an oblique direction with respect to the rim channel 103. The rim channel 103 has outlets 132 spaced at suitable intervals, each outlet 132 being formed obliquely with respect to the bowl part 101. As a result, flushing water led from the Z water conduit 161 to the rim channel 103 flowing out from the rim water outlets 132 sets up a vortex flow of water existing in the bowl part 101. This flushing water reaching the pooled water in the bowl part 101 sets up siphon effect in the waste trap 102 in flushing filth in the filth hopper part 112 and cleaning the bowl part. This siphon effect is described later.

The toilet 260 has a spout nozzle 35 fastened to the rear part of the Z water conduit 161, the spout nozzle 35 orients in the direction in which water is led into the Z water conduit 161. Thus, the spout nozzle 35 and the Z water conduit 161 constitute a jet pump. The toilet 260 also has a supplementary feed pipe 264 the tip of which is directed toward the supply throat 263. The supplementary feed pipe 264 is used to replenish flushing water to the flushing water reservoir 104.

In the toilet 260 according to the seventh embodiment, water needs to be supplied once for the rim water cleaning, and once for replenishing the flushing water in the flushing water reservoir 104. This is effected by a switching valve 341 that switches between feeding the water supply to the connection tube 137 and feeding the water supply to the supplementary feed pipe 264.

Figure 34:
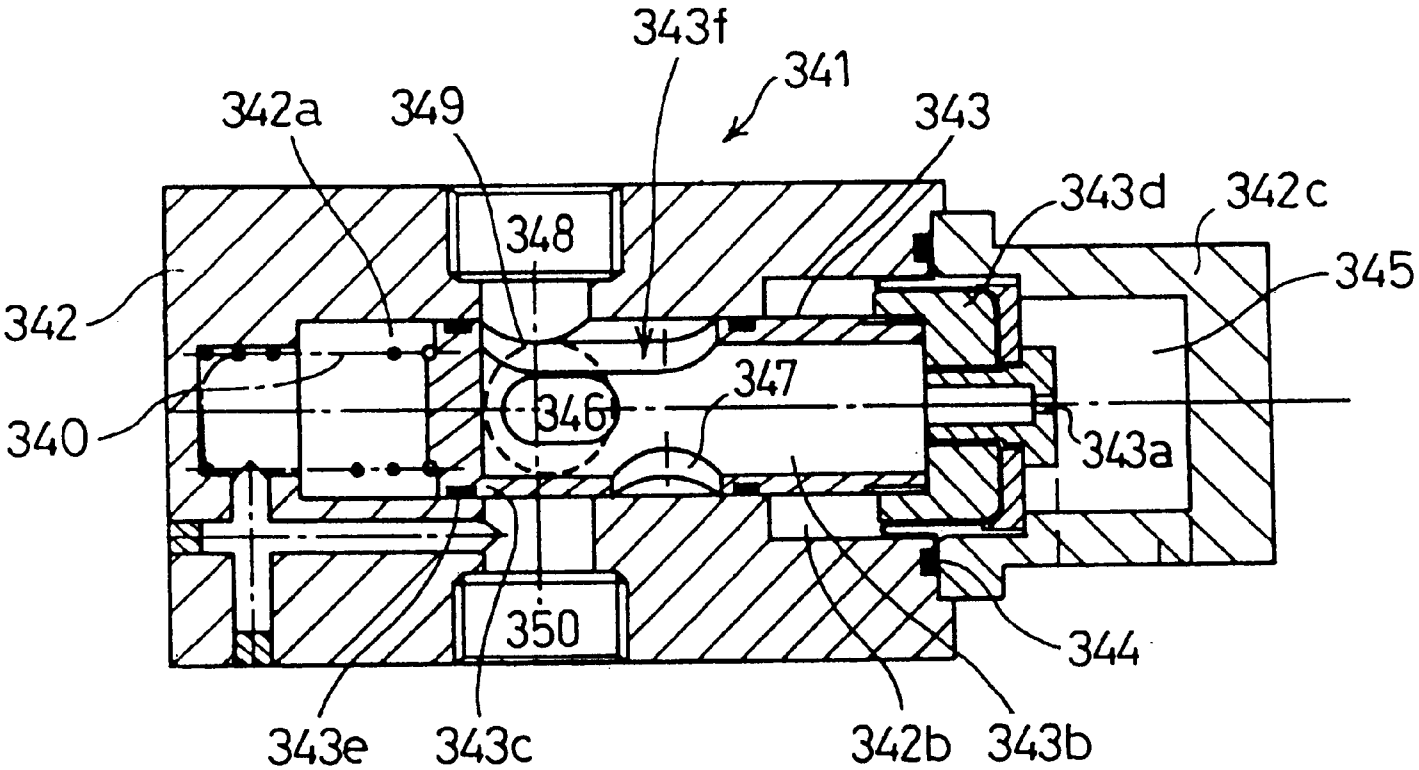
FIG. 34 is a simplified cross-sectional view of the switching valve 341 used in the toilet 260.

As shown by the simplified cross-sectional view of FIG. 34, the switching valve 341 has a valve casing 342 as the main component, in which a switching element 343 for switching the water supply feed is slidably arranged in a switching valve guide hole 342*a*. The valve casing 342 has an inflow port 348, a rim-side discharge port 349 and a supplementary-feed-pipe-side outlet 350, each extending to the switching valve guide hole 342*a*. In this arrangement, the inflow port 348 and the supplementary-feed-pipe-side outlet 350 are disposed in a straight line, the rim-side discharge port 349 is orthogonal to the inflow port 348, and the switching valve guide hole 342*a* is orthogonal to the inflow port 348, the rim-side discharge port 349 and supplementary-feed-pipe-side outlet 350. The channel from the water supply valve 105 is connected to the inflow port 348, the connection tube 137 is connected to the rim-side discharge port 349 and the supplementary feed pipe 264 is connected to the supplementary-feed-pipe-side outlet 350. The inflow port 348 is slightly larger than the rim-side discharge port 349 and the supplementary-feed-pipe-side outlet 350.

The main component of the switching element 343 is a hollow cylindrical body 343*b*, closed at one end (the left end, in FIG. 34) and open at the other end, the outer wall of which constitutes a guide part 343*c* that is guided by the switching valve guide hole 342*a*. Silicon rings 343*c* disposed between the inside wall of the switching valve guide hole 342*a* and the guide part 343*c* ensure slidability and watertightness. A retraction spring 340 accommodated on the left (in the drawing) guide part 343*c* urges the switching element 343 to the right.

A pressure receiver 343*d* is fastened to the open end of the cylindrical body 343*b*, and a cap 342*c* is attached to the valve casing 342, around the pressure receiver 343*d*. A bellophragm 344 is disposed around the pressure receiver 343*d*, between the valve casing 342 and the cap 342*c*, to thereby form a pressure chamber 345 inside the cap 342*c*. The pressure chamber 345 communicates with the cylindrical body 343*b* of the switching element 343 via a small hole 343*a* provided in the pressure receiver 343*d*.

A rim communication port 346 and the supplementary feed pipe communication port 347 for the rim-side discharge port 349 and the supplementary-feed-pipe-side outlet 350, respectively, are provided in the peripheral surface of the cylindrical body 343*b*. When the switching element 343 is at a first position, the position shown in the drawing, rim communication port 346 and rim-side discharge port 349 overlap and supplementary feed pipe communication port 347 is blocked by the inside wall of the switching valve guide hole 342*a*. When the switching element 343 is moved to a second position, on the left, supplementary feed pipe communication port 347 and the supplementary-feed-pipe-side outlet 350 overlap, and rim communication port 346 is blocked by the inside wall of the guide hole 342*a*. The cylindrical body 343*b* has an elongated inflow communication port 343*f*. This inflow communication port 343*f* overlaps the inflow port 348 whether the switching element 343 is at the first position or the second position. The inflow port 348 therefore can be selectively connected to the rim-side discharge port 349 or the supplementary-feed-pipe-side outlet 350 by moving the switching element 343 to the first or second position.

The switching of the water supply feed by the switching valve 341 will now be explained. When a cleaning button (on a control panel) is pressed for cleaning the bowl part, since the switching element 343 is at the first position; flushing water passing through the water supply valve 105 reaches the inflow port 348 of the switching valve 341 and flows from the rim communication port 346 to the rim-side discharge port 349. The rim-side discharge port 349 is connected to the connection tube 137, so the water flows via the connection tube 137 to the spout nozzle 35, from which the water is jetted out to the rim channel 103 to start the rim water cleaning.

As shown in FIGS. 32 and 33, the spout nozzle 35 is disposed inside the Z water conduit 161 so as to be oriented in the same direction as the Z water conduit 161. When the switching valve 341 is used to switch water supplied from the water supply valve 105 (not shown) to the connection tube 137, a high-speed flow of flushing water is jetted out into the Z water conduit 161 from the spout nozzle 35 under a high pressure of 1 to 2 kgf/cm$^2$. This flow from the spout nozzle 35 becomes a jet flow, involving large quantities of water from the flushing water reservoir 104 connected to the Z water conduit 161. This jet flow together with the water involved from the flushing water reservoir 104 is spouted out as if by a jet pump, directly toward the rim channel 103.

Thus, an enormous volume of flushing water is supplied to the rim channel 103 all at once through the flow rate amplification and the instantaneous flow rate increment by the jet pump. The flushing water flows out through the rim water outlets 132 and runs down across the surface of the bowl part 101. More specifically, the flow-rate-amplified flushing water emerges obliquely from the rim water outlets 132 and flows down as a high-energy, swirling flow that also imparts a vortex flow to the pooled water in the bowl part 101 while increasing the amount of water in the bowl. This powerful vortex flow enhances the drainage efficiency of the upstream tube 122, resulting in the rapid formation of siphon effect in the waste trap 102 that enables filth in the filth hopper part 112 to be flushed away and the toilet cleaned with high efficiency. In addition, water economy is obtained while at the same time maintaining cleaning performance through the flow rate amplification and the instantaneous flow rate increment by the jet pump, like as in above-mentioned embodiments.

From the Z water conduit 161, the flushing water jets out in an oblique direction with respect to the rim channel 103. This enables pressure loss to be contained. As the result, the flow-rate-amplified flushing water flows from the rim water outlets 132 into the bowl part 101 with no reduction in the energy of the amplified flow. The surface of the bowl part is cleaned more effectively.

While the flushing water is feeding through the connection tube 137 and spouting from the spout nozzle 35 to the Z water conduit 161, some of this water is being supplied to the pressure chamber 345 via the small hole 343*a*. The pressure in the pressure chamber 345 thus increases according to the supply of the flushing water, and as the force of the pressure becomes greater than the applied force of the return spring 340, the switching element 343 is moved to the left. When the pressure chamber 345 is full of water, the switching element 343 is at the second position and the supplementary feed pipe communication port 347 and the supplementary-feed-pipe-side outlet 350 are in mutual alignment, allowing flushing water to flow into the flushing water reservoir 104 via the supplementary feed pipe 264 connected to the supplementary-feed-pipe-side outlet 350. After the button has been pressed for a specific time, the water supply valve 105 closes, cutting off the supply flow to the switching valve 341. This enables the switching element 343 to be moved back to the first position by the force of the return spring 340, forcing the water in the pressure chamber 345 back through the small hole 343*a*.

In the rim water cleaning which is carried out in the manner as described above, water pooling in the bowl part 101 follows the filth conveyance described before. The replenishment of flushing water in the flushing water reservoir 104 by the supplementary feed pipe 264 is designed to terminate when the flushing water reservoir 104 is full. This is done by adjusting such a part as diameter of the small hole 343*a* to switch the rim water cleaning to the replenishment of flushing water in above manner.

Figure 35:
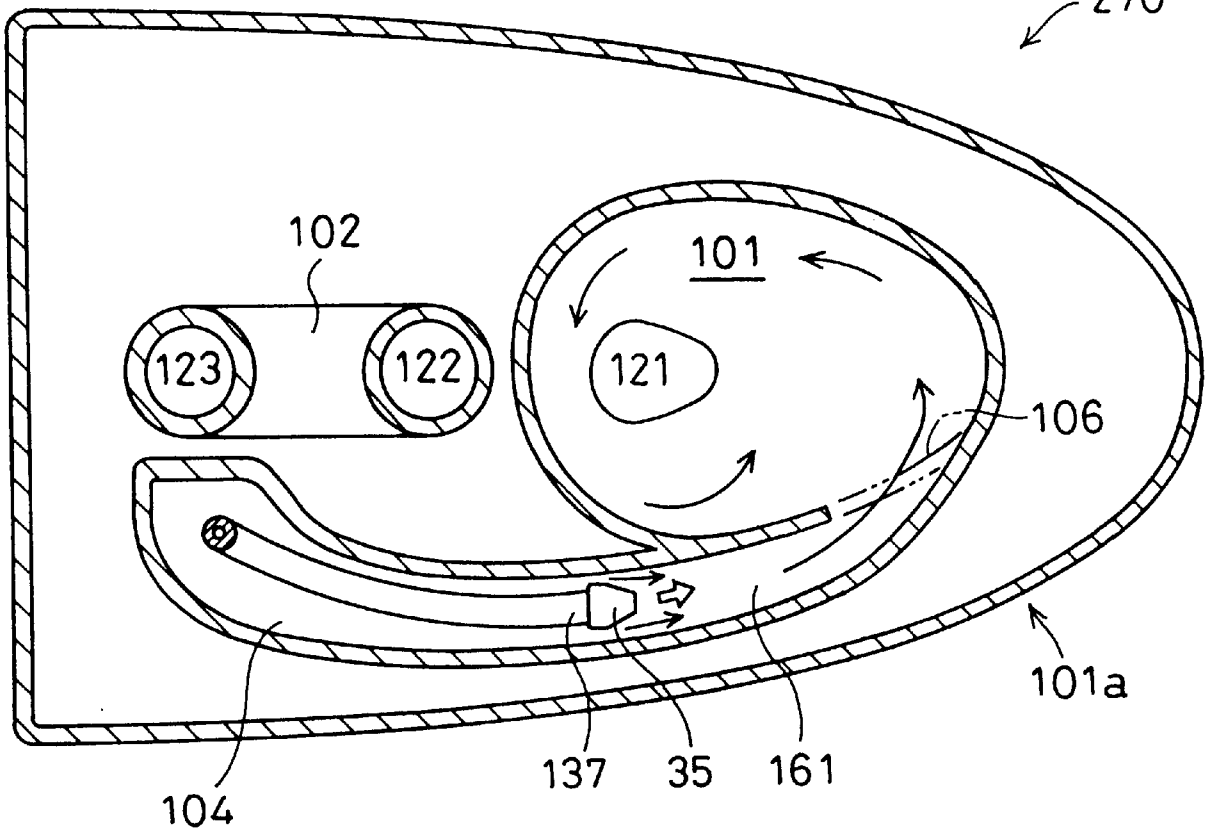
FIG. 35 is a simplified cross-sectional view of a toilet 270 according to an eighth embodiment.

An eighth embodiment will now be described. FIG. 35 is a simplified cross-sectional view of a toilet 270 according to the eighth embodiment. The toilet 270 is the same as the first embodiment shown in FIGS. 1 and 2 with respect to the spout nozzle 35, flushing water reservoir 104 and the waste trap 102 and the like. What is different about this toilet 270 is that, as shown in FIG. 35, the Z waterspout outlet 106, which is the flushing water outlet form the Z water conduit 161, opens obliquely into the bowl part 101. The Z waterspout outlet 106 is lower than the water surface of the pooled water in the bowl part 101, and outputs a jet of flushing water that imparts a vortex flow to the pooled water as indicated by the arrows in the drawing. As in the toilet of the seventh embodiment, the flushing water, which is outputted to the bowl part 101 with the vortex flow, creates siphon effect in the waste trap 102 that is used to the filth conveyance and the toilet bowl cleaning.

As in the first embodiment, the toilet 270 has a spout nozzle 35 arranged in a Z water conduit 161. The jet of flushing water that imparts the vortex flow to the pooled water is subjected to the flow rate amplification and the instantaneous flow rate increment by a jet pump constituted by the spout nozzle 35 and Z water conduit 161. The flow-rate-amplified flushing water directly flows in the pooled water at the under the water surface of the pooled water. So that, a powerful vortex flow is generated and an instantaneous increase in the amount of water in the bowl part 101 through the flow rate amplification and the instantaneous flow rate increment, causing rapid formation of siphon effect in the waste trap 102. Consequently, filth in the filth hopper part 112 is flushed and the bowl part cleaned with high efficiency. Through the flow rate amplification and the instantaneous flow rate increment by jet pump, water economy can be realized while maintaining the cleaning performance.

Figure 36:
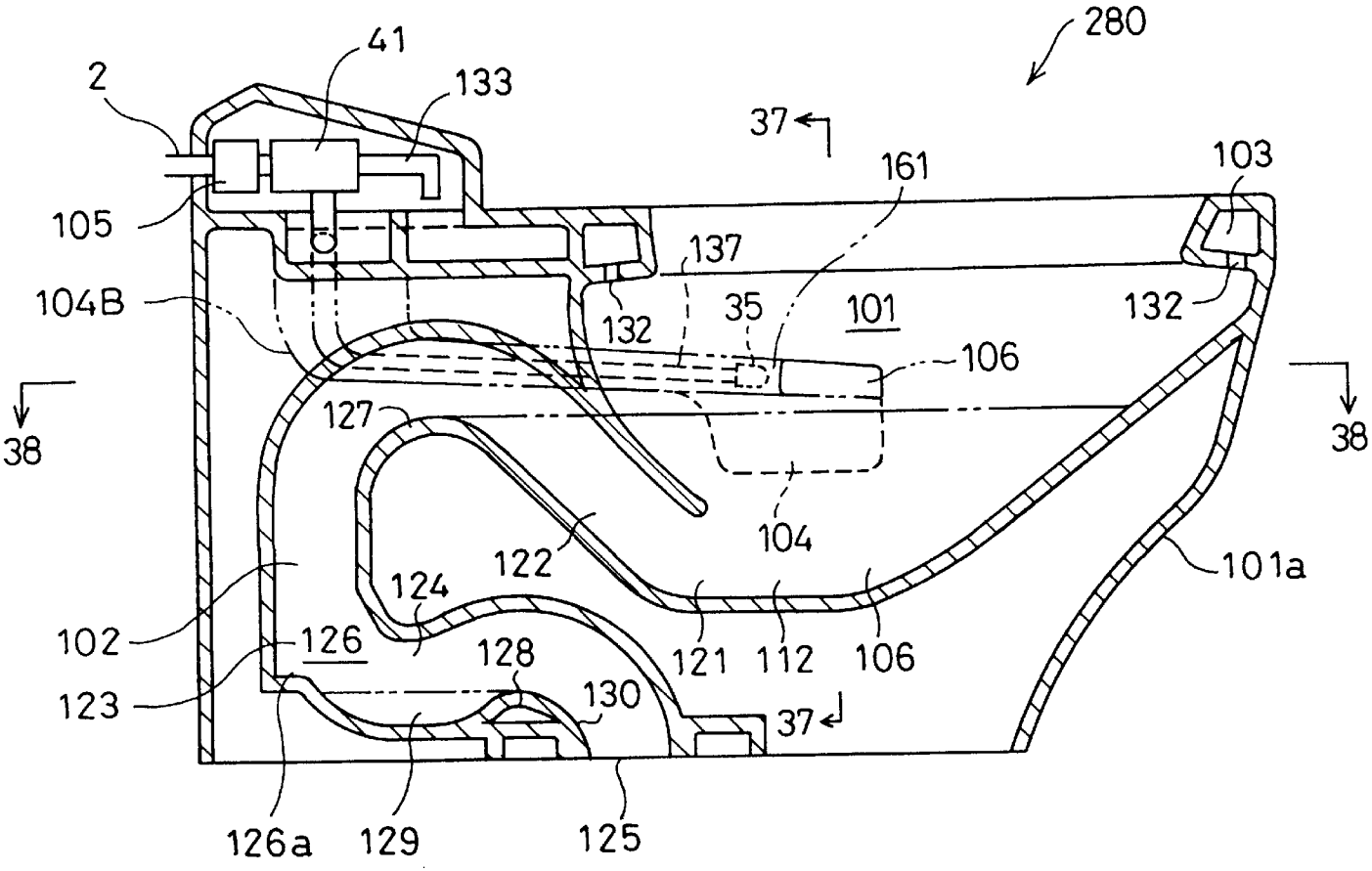
FIG. 36 is a simplified cross-sectional view of a toilet 280 according to a ninth embodiment.
Figure 37:
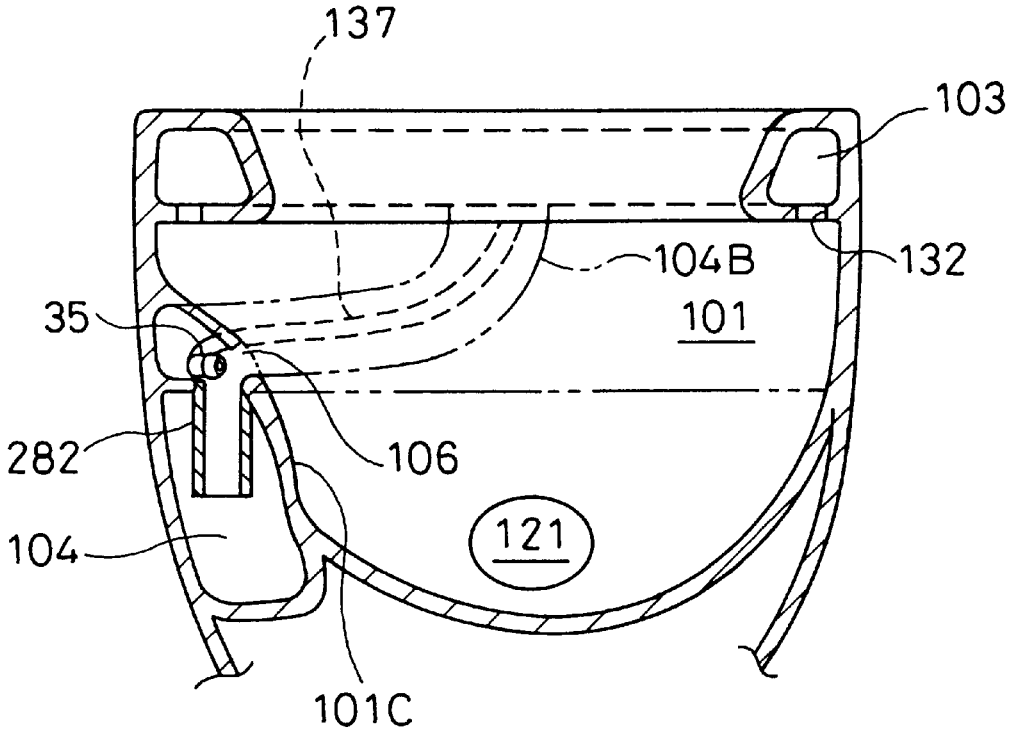
FIG. 37 is a simplified cross-sectional view along line 37—37 in FIG. 36.
Figure 38:
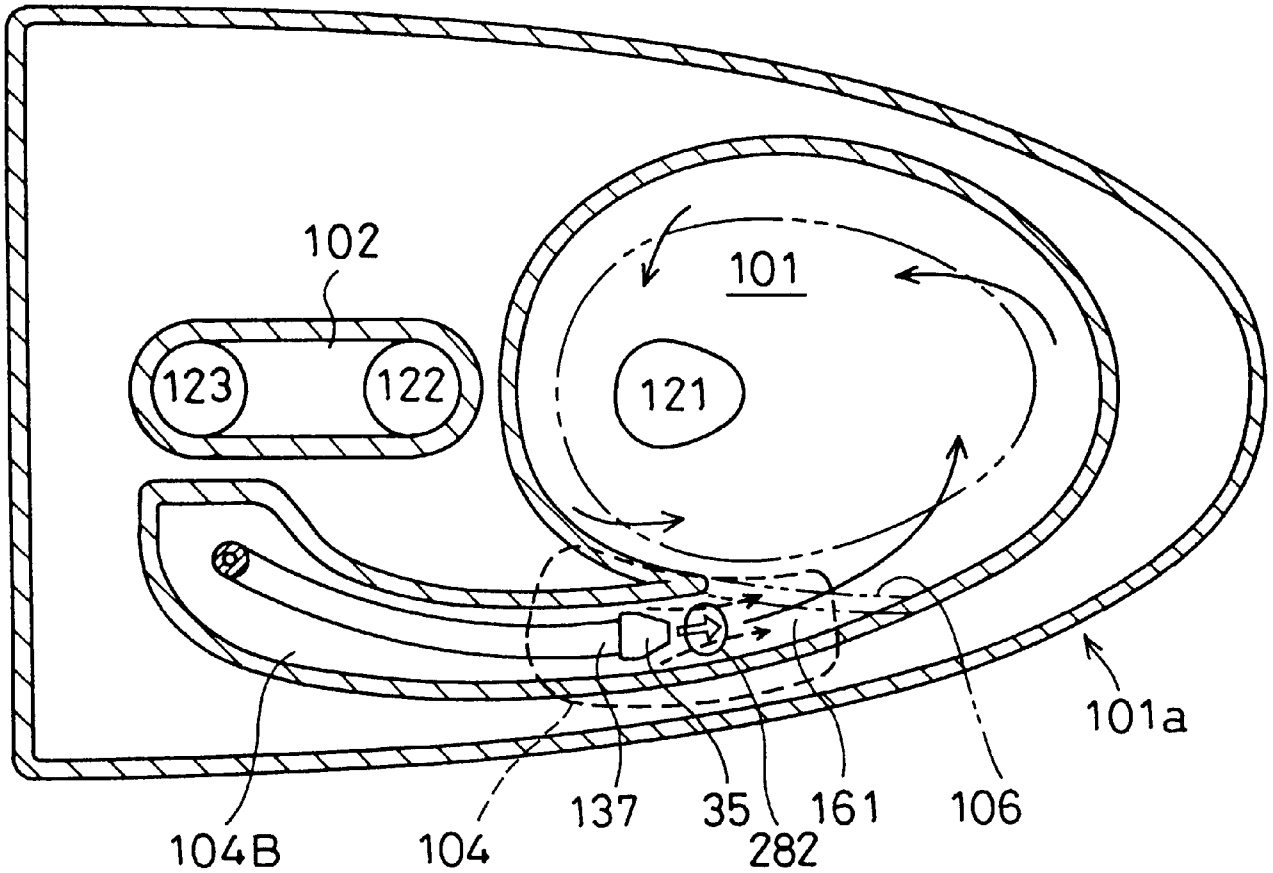
FIG. 38 is a simplified cross-sectional view along line 38—38 in the same.

A ninth embodiment will now be described. A toilet 280 according to the ninth embodiment has in common with the toilet of the seventh embodiment that the Z waterspout outlet 106 opens obliquely into the bowl part 101. It differs in that the Z waterspout outlet 106 is above the level of the pooled water in the bowl part 101. FIG. 36 is a simplified cross-sectional view of the toilet 280 according to this ninth embodiment, FIG. 37 is a simplified cross-sectional view along line 37—37 of FIG. 36, and FIG. 38 is a simplified cross-sectional view along line 38—38. The toilet 280 is the same as the first embodiment shown in FIGS. 1 and 2 with respect to the spout nozzle 35 and waste trap 102 and the like.

As shown in the drawings, the toilet 280 has a flushing water reservoir 104 disposed on the outer side of a sidewall 101*e* of the bowl part 101. The flushing water reservoir 104 opens toward the bowl part 101 to form the Z waterspout outlet 106. The flushing water reservoir 104 has a supplementary feed pipeline 104B that runs from the rear of the bowl part; the spout nozzle 35 is located inside this supplementary feed pipeline 104B. The flushing water reservoir 104 is joined to the supplementary feed pipeline 104B by a port 282 in the vicinity of Z waterspout outlet 106.

The supplementary feed pipeline 104B is connected at its upper end to rim channel 103 in an arrangement whereby when water from a water supply source is supplied to the water supply conduit 133 for the rim water cleaning, some of the water is fed into the flushing water reservoir 104. Thus, at every rim water cleaning is effected, the flushing water reservoir 104 is filled with flushing water. The port 282 is provided to the front of the spout nozzle 35; flushing water jetted out by the spout nozzle 35 passes through the supplementary feed pipeline 104B. Thus, part from the spout nozzle 35 to the Z waterspout outlet 106 comprises a Z water conduit 161, and the Z water conduit 161 and the spout nozzle 35 comprise a jet pump.

In this toilet 280 too, the jet of water from the Z waterspout outlet 106 flows into the bowl part 101 in a vortex motion and is subjected to the flow rate amplification and the instantaneous flow rate increment by the jet pump. This causes rapid formation of siphon effect in the waste trap 102, resulting in efficient the filth conveyance and the toilet bowl cleaning as well as high water economy and maintenance of cleaning performance.

Furthermore, in the toilet 280 the Z waterspout outlet 106 is higher than the liquid surface of the existing water, so that the jet of water swirls around the surface of the bowl part before reaching the liquid surface of the pooled water, efficiently cleaning the surface of the bowl part 101 above said liquid surface of the existing water.

Figure 39:
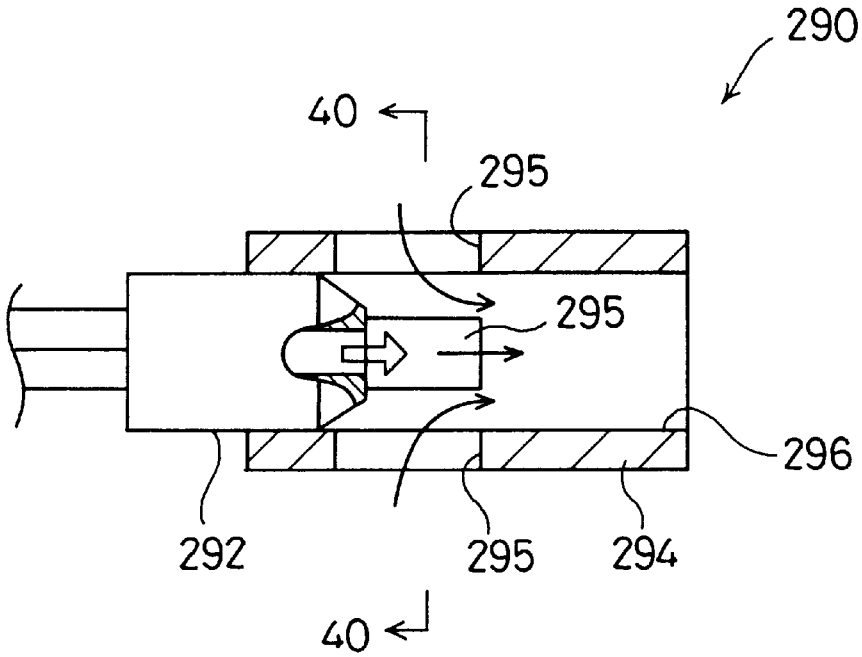
FIG. 39 illustrates the principal parts of a jet pump of a tenth embodiment.
Figure 40:
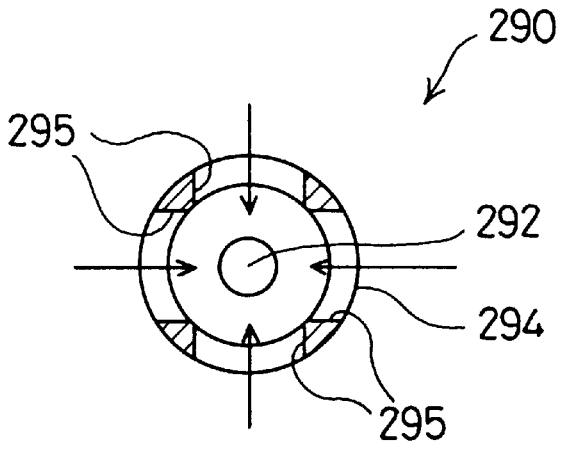
FIG. 40 is a cross-sectional view along line 40—40 in FIG. 39.

A tenth embodiment will now be described. While each of the preceding embodiments has a single jet pump, this embodiment is characterized in that it has a plurality of jet pumps. A plurality of jet pumps is arranged so as to be oriented toward the inlet 121 of a waste trap 102, this arrangement enables the size of the jet pumps to be decreased. FIG. 39 is a drawing showing the principal parts of a jet pump according to the tenth embodiment, and FIG. 40 is a cross-sectional view along line 40—40 of FIG. 39.

With reference to the drawings, each jet pump 290 has a spout nozzle 292 having a smaller outside diameter than that of the above-described the spout nozzle 35, and a tubular body 294 fastened to the tip of the spout nozzle 292 inside. Toward the end with the spout nozzle 292, the tubular body 294 has side ports 295 formed at equal intervals around the peripheral surface thereof. Water jetted out of the spout nozzle 292 flows through a through hole 296 and involves water through the side ports 295. That is, the through hole 296 is the Z water conduit 161 of the preceding embodiments, serving to amplification the flow rate and increment the instantaneous flow rate of the flushing water passing therethrough.

Figure 41:
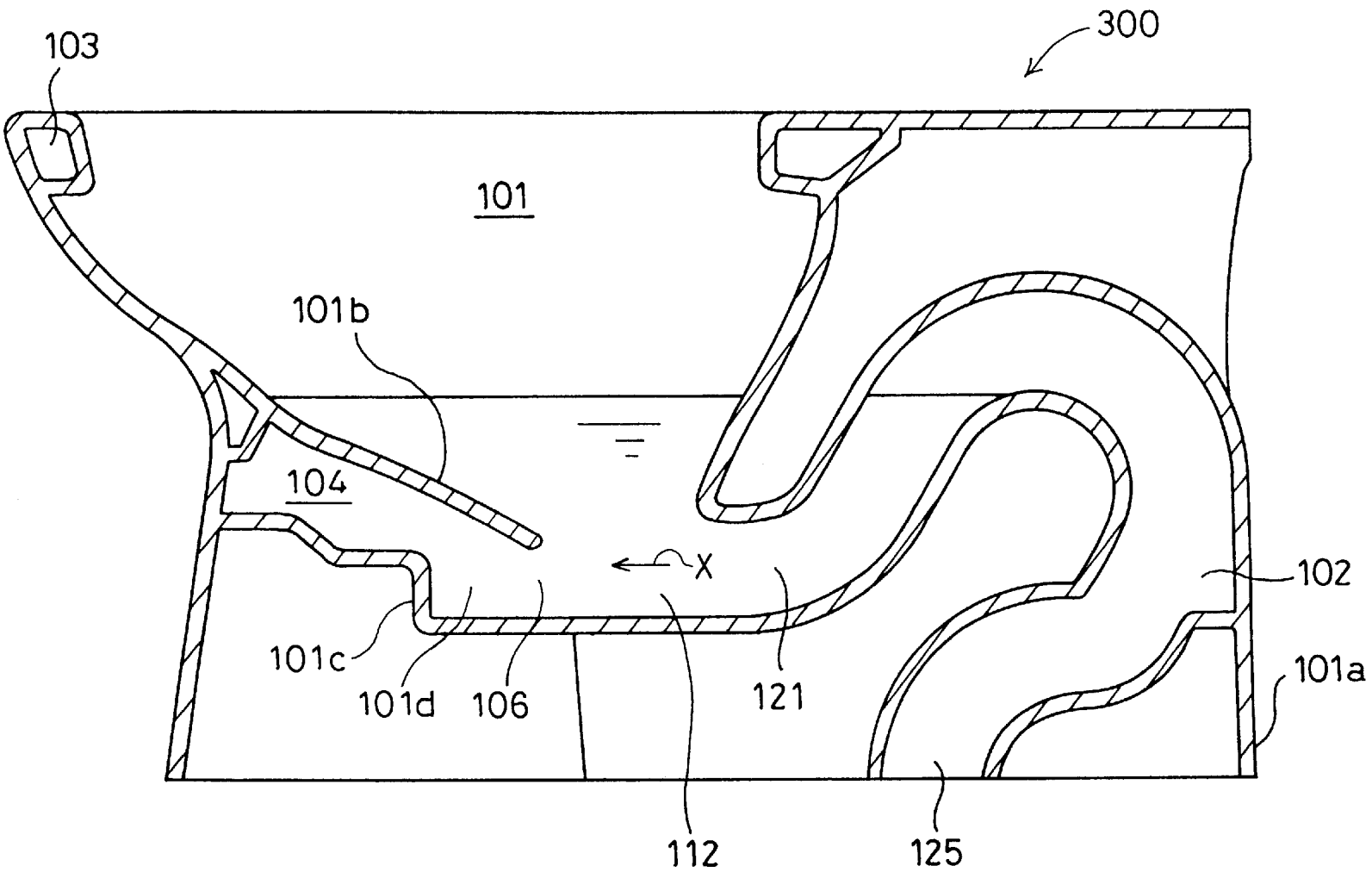
FIG. 41 is a simplified cross-sectional view of a toilet 300 according to the tenth embodiment.
Figure 42:
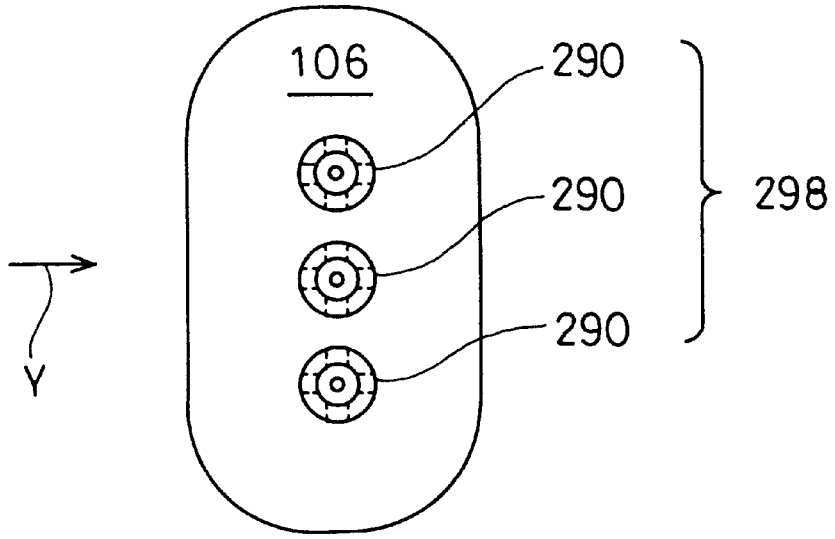
FIG. 42 illustrates the array of jet pumps 290, as viewed in the direction indicated by X in FIG. 41.
Figure 43:
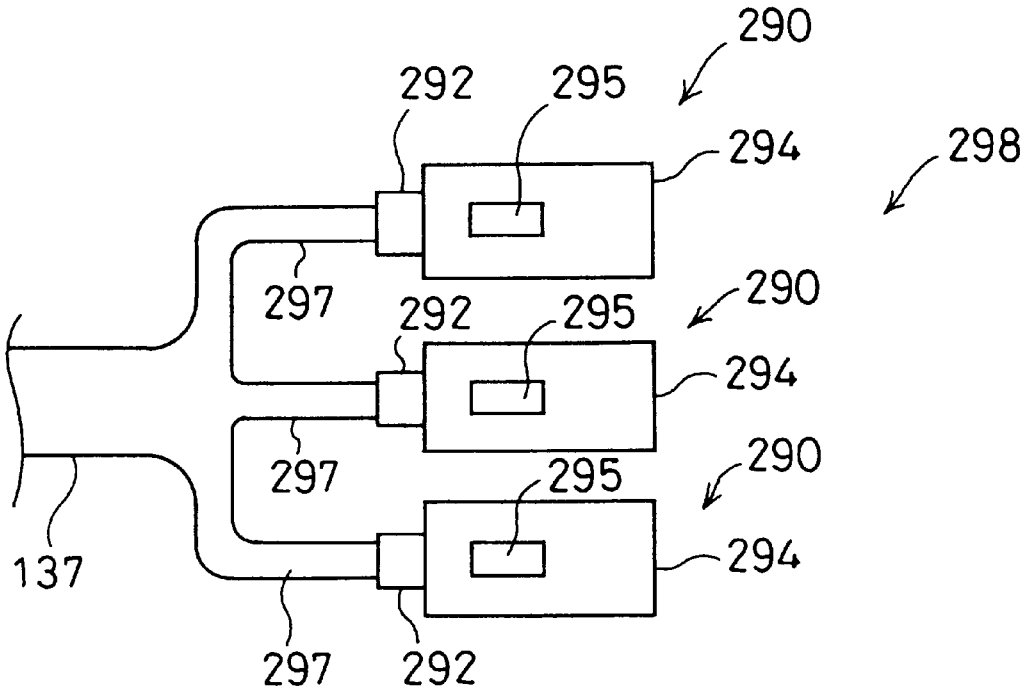
FIG. 43 illustrates the relationship among the jet pumps 290, as viewed in the direction indicated by Y in FIG. 42.

The jet pumps 290 are arranged according to the configuration of the Z waterspout outlet 106 and inlet 121. FIG. 41 is a simplified cross-sectional view of a toilet 300 according to the tenth embodiment, FIG. 42 is a view along direction X of FIG. 41, and FIG. 43 is a view of principal parts along direction Y of FIG. 41. As in the case of the toilet 220 of the fourth embodiment shown in FIG. 26, and the toilet 230 of the fifth embodiment shown in FIG. 29, the toilet 300 has a flushing water reservoir 104 formed to be separated from the bowl part 101, as shown in FIG. 41. What characterizes the toilet 300 is that the lower end of the flushing water reservoir 104 opens out into a large port and that a jet pump is disposed in a lower area 101*d* lower than the opening in such a manner as described below.

Owing to constraints on installation location and other such factors, the toilet 300 has a Z waterspout outlet 106 with an elongated shape, as shown in FIG. 42. The three jet pumps 290 are arrayed vertically in a line to conform to the shape of the Z waterspout outlet 106. These three jet pumps 290 comprise a jet pump cluster 298. The jet pumps 290 are attached to branch pipes 297 that branch out from the connection tube 137, as shown in FIG. 43. The jet pump cluster 298 is disposed in the lower area 101*d* with the connection tube 137 attached to the toilet bowl wall surface 101*c*.

In the toilet 300 according to the tenth embodiment, when water is supplied from a water supply source to the connection tube 137, the flushing water is jetted out from each the spout nozzles 292 of the jet pumps 290 in unison. So that, a flow-rate-amplified flushing water is jetted out toward the inlet 121 from each of the jet pumps 290. This flow-rate-amplified flushing water from a plurality of points of flows into the inlet 121 of the waste trap 102, filling the entire inlet 121 and generating high cleaning performance. In addition, water economy is obtained through the flow rate amplification and the instantaneous flow rate increment, like as in above-mentioned embodiments.

The jet pump cluster 298 is configured to conform to the shape of the Z waterspout outlet 106, so there are no extreme differences in the involvement of flushing water involved via the side ports 295. Thus, this arrangement is advantageous as it provides a more or less uniform flow-rate-amplified flushing water from each of the jet pumps 290.

Figure 44:
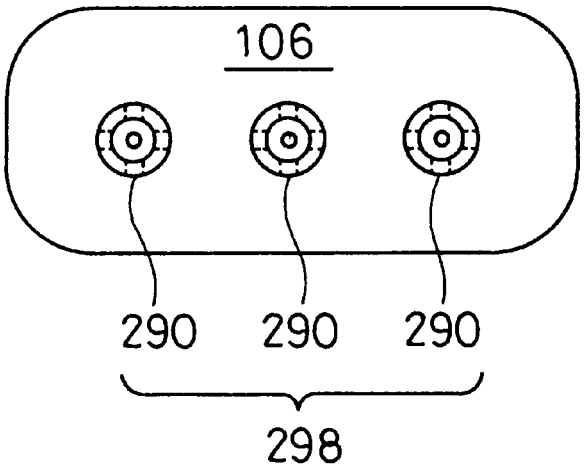
FIG. 44 illustrates an array of jet pumps 290 when the Z waterspout outlet 106 has a shape of horizontally elongated rectangle.
Figure 45:
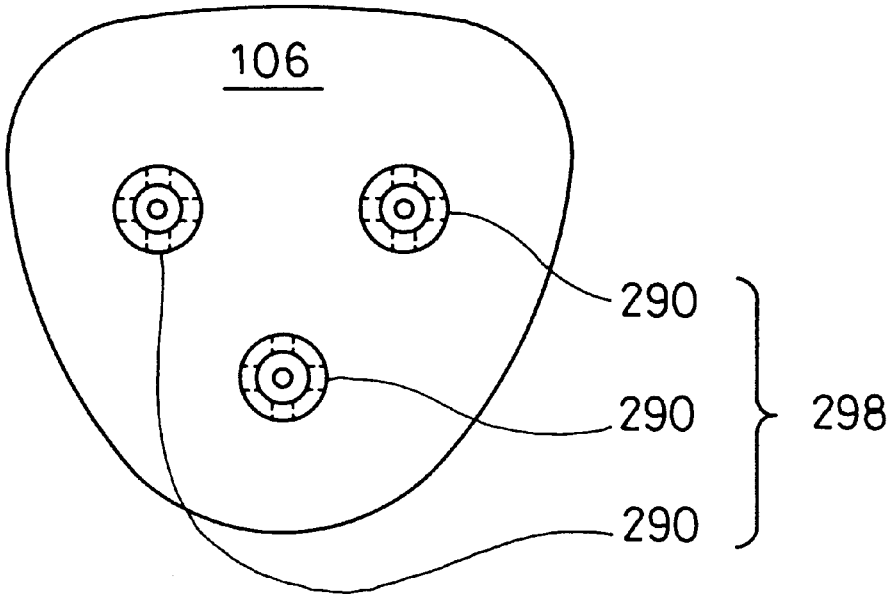
FIG. 45 illustrates an array of jet pumps 290 when the Z waterspout outlet 106 has a shape of quasi-triangle.

The jet pump cluster 298 can be configured to match different configurations of the Z waterspout outlet 106. As shown in FIG. 44, for example, for a horizontally elongated Z waterspout outlet 106 the jet pumps 290 could arranged in a horizontal line, or in a triangular arranged for a triangular Z waterspout outlet 106, as shown in FIG. 45.

Figure 46:
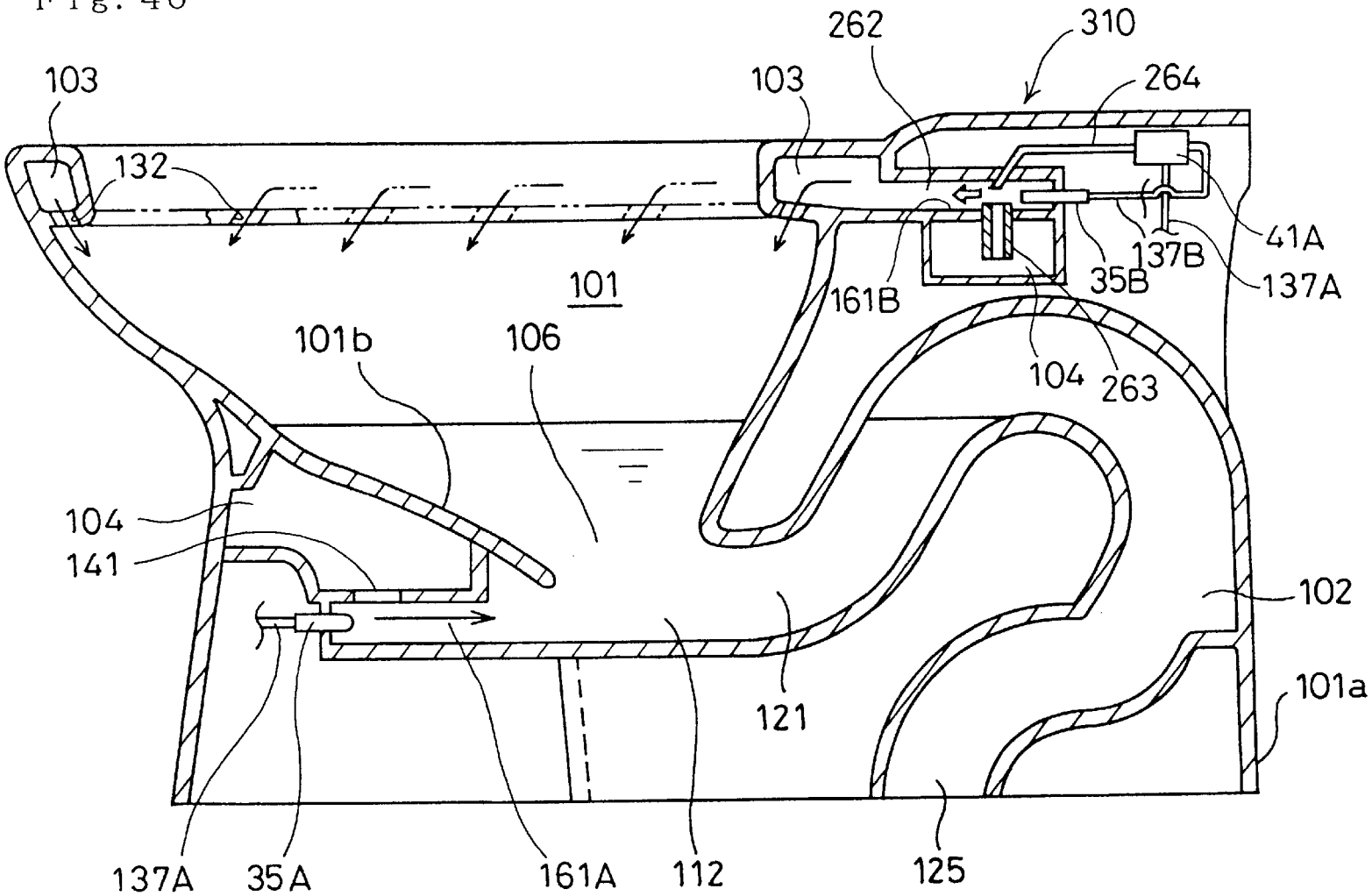
FIG. 46 is a simplified cross-sectional view of a toilet 310 according to an eleventh embodiment.

An eleventh embodiment will now be described. While in the preceding embodiments a flow of water having a flow rate amplified by jet pump is jetted out from one point on the bowl part main body 110*a*, the eleventh embodiment is characterized in that the flow of flushing water is jetted out from a plurality of points on the bowl part main body 110*a*. FIG. 46 shows the configuration of a toilet 310 according to the eleventh embodiment. In the case of the toilet 310, separate jet pumps are used to amplify the flow to be jetted directly into the bowl part 101 and the flow to be jetted out to the rim channel 103. More specifically, the toilet 310 uses a cleaning configuration that is of the same type as that of the toilet 100A of the second embodiment shown in FIG. 14, and also a cleaning configuration that is of the same type as that of the toilet 260 of the seventh embodiment shown in FIGS. 32 and 33.

With reference to FIG. 46, to jet out the flow-rate-amplified flushing water from the Z waterspout outlet 106, like in the toilet 100A, the toilet 310 has a flushing water reservoir 104 in the bowl part 101 part and a spout nozzle 35A at the back (on the left, in the drawing) of a Z water conduit 161A. When flushing water is supplied to the spout nozzle 35A via the connection tube 137A, a flow of the flow-rate-amplified flushing water in which flushing water from the flushing water reservoir 104 is involved via communicating hole 141 at the lower end is jetted out from the Z waterspout outlet 106 toward the inlet 121.

Also, like in the toilet 260, the toilet 310 has a channel part 262 with a Z water conduit 161B, a flushing water reservoir 104 by the rim below, and a spout nozzle 35B at the rear of the Z water conduit 161B (on the right, in the drawing) for jetting out the flow-rate-amplified flushing water from the rim channel 103. Thus, when flushing water is supplied to the spout nozzle 35B via the connection tube 137B, a flow of flow-rate-amplified flushing water in which flushing water from the flushing water reservoir 104 is involved via the water supply conduit 263 is flowed out to the bowl part 101 via the rim water outlet 132.

Figure 47:
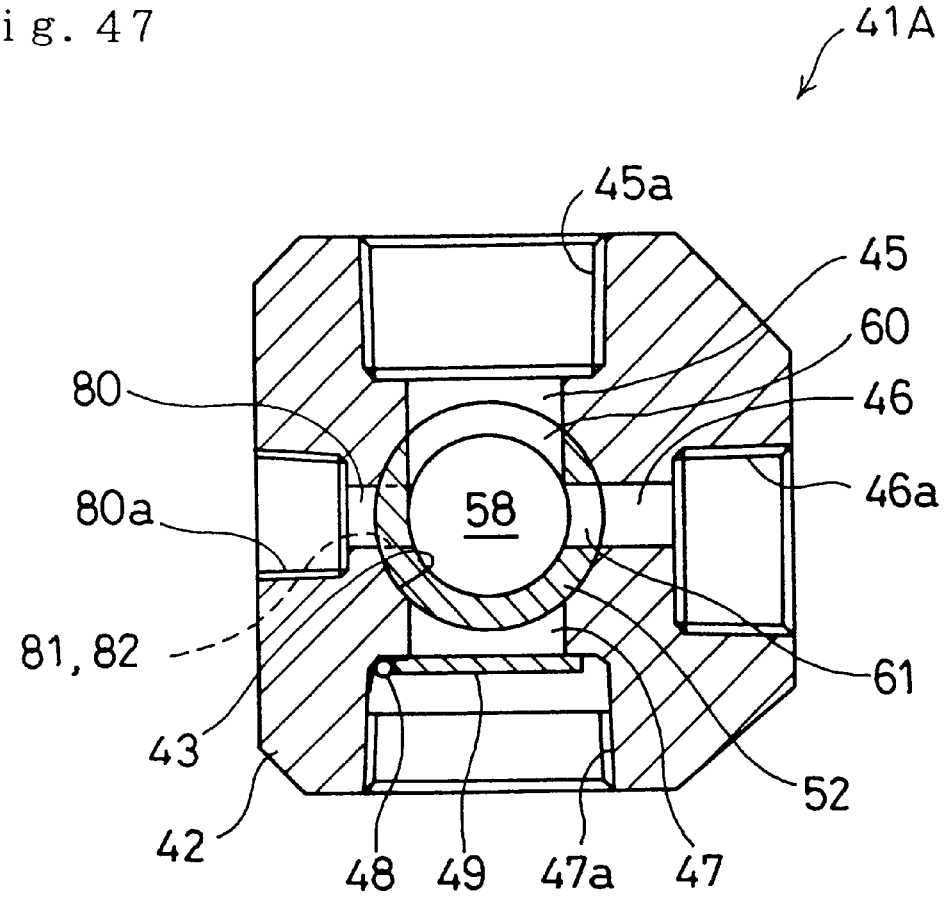
FIG. 47 is a cross-sectional view showing the principal parts of the switching valve 41A used in the toilet 310.
Figure 48:
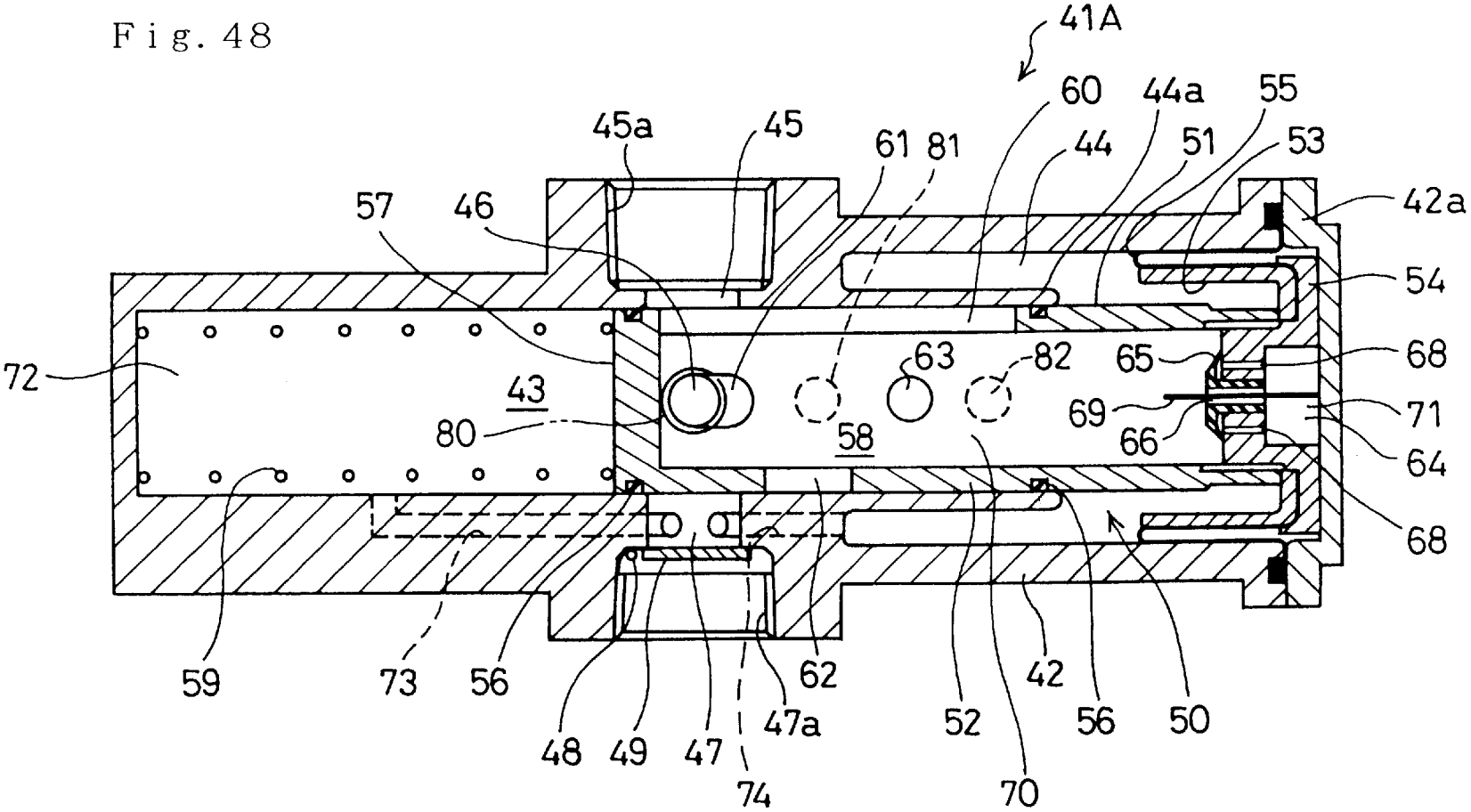
FIG. 48 is a simplified longitudinal cross-sectional view of the switching valve 41A.

As in the first embodiment, the cleaning sequence of the toilet 310 is rim/jet/rim water cleaning. Each rim water cleaning, the flushing water reservoir 104 is replenished. The toilet 310 has a switching valve 41A. FIG. 47 is a transverse cross-sectional view of principal parts of the switching valve 41A, and FIG. 48 is a simplified longitudinal cross-sectional view of the switching valve 41A.

As in the switching valve 41 of the first embodiment, the switching valve 41A switches rim/jet/rim water cleaning sequentially. The switching valve 41A has a valve casing 42 with an inflow port 45, rim port 46 and jet port 47. The outer wall 52 of the valve element 50 has a first communicating hole 60 that is always in communication with the inflow port 45, a second communicating hole 61 that is initially in communication with the rim port 46, a third communicating hole 62 that secondarily communicates with the jet port 47, and a fourth communicating hole 63 that subsequently communicates with the rim port 46. As in the switching valve 41, the rim/jet/rim water cleaning sequence of the switching valve 41A is effected by the sequence of communication between these communicating holes and the ports concerned. The connection tube 137B is connected to the rim port 46 and the connection tube 137A to the jet port 47.

With reference to FIG. 47, the switching valve 41A also has a replenishment port 80 disposed in opposition to the rim port 46 at the valve casing 42. A supplementary feed pipe 264 is connected to the replenishment port 80 by means of tapered thread 80*a* at the outer wall 52, as shown in FIG. 48. The switching valve 41A also has fifth and sixth communicating holes 81 and 82 that can overlap with the replenishment port 80. The fifth and sixth communicating holes 81 and 82 are formed at the front side with reference to the plane of the FIG. 48 drawing sheet. The fifth communicating hole 81 is arranged so as to overlap the replenishment port 80 when the valve element 50 is moved to the left to a first position at which the jet port 47 and the third communicating hole 62 overlap. And the sixth communicating hole 82 is arranged so as to overlap the replenishment port 80 when the valve element 50 is moved further leftward beyond a second position at which the rim port 46 and the fourth communicating hole 63 overlap.

Jetting and replenishment of flushing water are effected by the switching valve 41A as follows. Valve operation for cleaning by jetting water directly into the bowl part is the same as that of the switching valve 41, so is only briefly described.

When the cleaning button is pressed the valve element 50 is in the initial position, so the supply of water flows via the rim port 46 and the connection tube 137B to be jetted out to the rim channel 103 from the spout nozzle 35B. The flow to the rim channel 103 is the flow of the flow-rate-amplified flushing water by a jet pump constituted by the spout nozzle 35B and the Z water conduit 161B. So that, the rim water cleaning is achieved with the flow-rate-amplified flushing water jetted out from the rim water outlets 132 to the bowl part 101. The flow-rate-amplified flushing water sets up a powerful vortex flow in the pooled water, efficiently producing siphon effect that results in the early start of the ensured filth conveyance and the toilet bowl cleaning, as described before.

As the flushing water continues to flow into the flushing water inflow chamber 58, the valve element 50 is moved leftward from the initial position to a first transition position, so water from the water supply source passes through the jet port 47 and the connection tube 137A to the spout nozzle 35A and is jetted out toward the Z waterspout outlet 106. The flow from the Z waterspout outlet 106 is the flow of the flow-rate-amplified flushing water by the jet pump comprised of the spout nozzle 35A and the Z water conduit 161A. So that, the jet water cleaning is achieved with the flow-rate-amplified flushing water jetted out from the Z waterspout outlet 106 toward the inlet 121. The ensured filth conveyance and the toilet bowl cleaning are achieved by the jet water cleaning with the flow-rate-amplified flushing water, as described before.

At this point the fifth communicating hole 81 and the replenishment port 80 overlap, so some of the water coming from the water supply source flows into the flushing water reservoir 104 via the replenishment port 80 and the supplementary feed pipe 264. That is, in the preceding rim water cleaning, flushing water from the flushing water reservoir 104 was used, so here this water is replenished to prepare for the next rim water cleaning.

As the flow of flushing water into the flushing water inflow chamber 58 continues, the valve element 50 is moved further leftward from the first transition position to a second transition position. So that, water from the water supply source again flows through the rim port 46 and the connection tube 137B to the spout nozzle 35B and is jetted out to the rim channel 103. At this time, the flow-rate-amplified flushing water is jetted to the bowl part 101, this water cleans the bowl part 101 and becomes the pooled water in the bowl part.

In the switching valve 41A, there is room for the valve element 50 to travel beyond the second transition position and the flow of water from the water supply valve 105 (not shown) continues. A further continuing inflow of the flushing water into the flushing water inflow chamber 58 moves the valve element 50 to the left side of the second transition position. This brings, as described above, the sixth communicating hole 82 into overlap with the replenishment port 80, so water from the water supply source is led the into the supplementary feed pipe 264 again via the replenishment port 80 and spouted into the flushing water reservoir 104. That is, although the water is taken from the flushing water reservoir 104 by the rim water cleaning succeeding the jet water cleaning, the flushing water spouted at this time replenished the water stored in the flushing water reservoir 104. This prepares for the next toilet bowl cleaning, or the first rim water cleaning at the time of the toilet bowl cleaning. On completion of the above-described second replenishment of the flushing water, the water supply valve 105 shuts off the supply. Therefore, the valve element 50 returns to the initial position after completion of the second replenishment of the flushing water in the same manner as the switching valve 41.

In accordance with this toilet 310 of the eleventh embodiment, high cleaning performance can be obtained with a small amount of flushing water, carrying out the rim water cleaning by jetting out to the rim channel 103 a flow of flow-rate-amplified flushing water produced by jet pump, which flow imparts a vortex to the pooled water in the bowl part as it descends from the rim, and cleaning by a directly jetted flow of flow-rate-amplified flushing water produced by jet pump, which flow is jetted directly from the Z waterspout outlet 106 toward the inlet 121 of the waste trap 102.

In the toilet 310, since the cleaning is carried out in the sequence of the rim water cleaning/the jet water cleaning/the rim water through utilization of the switching valve 41A, as described above, this ensures the bowl surface purification, the filth conveyance and the toilet bowl cleaning. In addition, after the rim water cleaning, the flushing water reservoir 104 is kept replenished with the flushing water jetted from the supplementary feed pipe 264, ensuring that rim water cleaning with the flow-rate-amplified flushing water is reliably accomplished each time.

Although in the toilet 310 according to the above described eleventh embodiment, the rim water cleaning with the flow-rate-amplified flushing water and the jet water cleaning wherein the flow-rate-amplified flushing water is spouted toward the inlet 121 of the waste trap 102, this may be embodied in the following variations.

In a first variation, the toilet 310 is configured to provide vortex-flow cleaning, namely, cleaning by the flow-rate-amplified flushing water that also sets up a vortex flow in the bowl part 101, as in FIG. 35. In a second variation an arrangement is used comprising rim water cleaning by the flow-rate-amplified flushing water and jet water cleaning by the flow-rate-amplified flushing water jetted out along the path of the upstream tube 122, as in FIG. 25. These variations also provide high cleaning performance and water economy.

Figure 49:
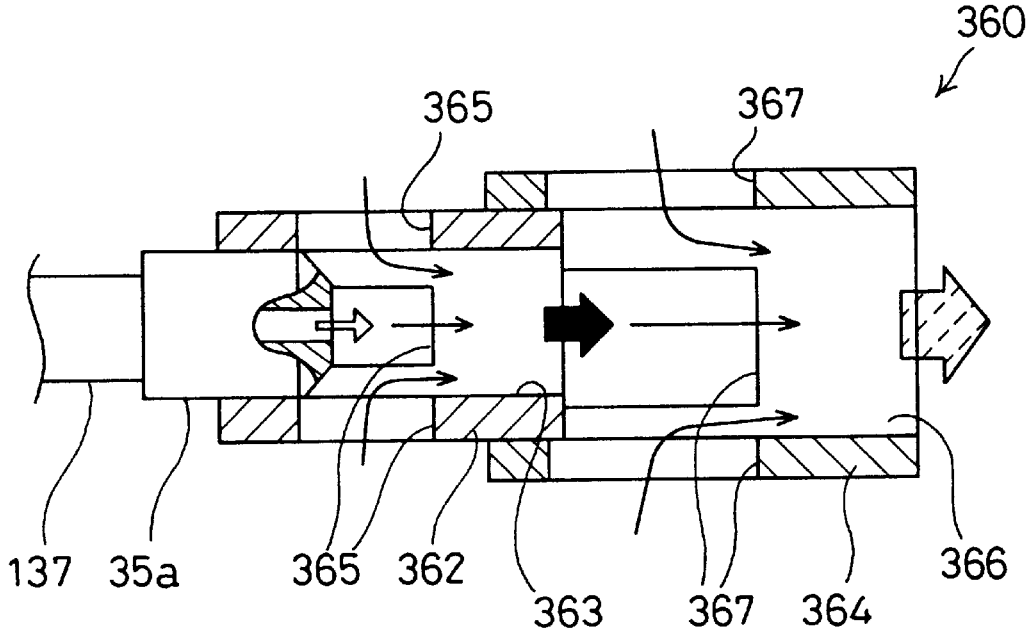
FIG. 49 is a simplified cross-sectional view of the jet pump 360 of a twelfth embodiment.

A twelfth embodiment will now be described. This embodiment is characterized by a multi-stage amplification of the flow rate of the flushing water. FIG. 49 is a schematic diagram of a jet pump 360 used in the toilet of the twelfth embodiment. This jet pump 360 takes the place of the spout nozzle 35 used in other embodiments.

The jet pump 360 has a spout nozzle 35*a* corresponding to the spout nozzle 35 of the preceding embodiments, a first tubular body 362 and a second tubular body 364. The first tubular body 362 is attached with the tip of the spout nozzle 35*a* inside, and has side ports 365 formed at equal intervals around the peripheral surface thereof for leading water into the through hole 363 of the first tubular body 362. The second tubular body 364 is attached with the tip of the first tubular body 362 inside, and has side ports 367 formed at equal intervals around the peripheral surface thereof for leading water into the through hole 366 of the second tubular body 364.

Water from a water supply source is supplied to the spout nozzle 35*a* via the connection tube 137. As the water jetted out from the spout nozzle 35*a* passes through the through hole 363, it involves surrounding through the side ports 365. As a result, a flow-rate-amplified flushing water after the first-stage flow rate amplification and instantaneous flow rate increment is spouted from the through hole 363 in the direction indicated by the solid black arrow. As the water passes through the through hole 366, this flow-rate-amplified flushing water involves surrounding water through the side ports 367. As the result, a flow-rate-amplified flushing water after the second-stage flow rate amplification and instantaneous flow rate increment is spouted from the through hole 366, as indicated by the shaded arrow. Thus, the flow jetted out form the jet pomp 360 is one subjected to multi-stage flow rate amplification and instantaneous flow rate increment. Using this jet pump 360 instead of the spout nozzle 35 used in the arrangements shown in FIGS. 14 and 21, and positioning it at the rising point of the upstream tube 122 as shown in FIG. 25, results in a flow of flushing water with multi-stage flow rate amplification and instantaneous flow rate increment that provides high cleaning performance. With the jet pump 360, water economy is also served since only the water supplied from the water supply source to the spout nozzle 35*a* is needed.

Moreover, in the jet pomp 360 accordance to the twelfth embodiment, the spout nozzle 35*a,* first tubular body 362 and second tubular body 364 can be handled as a single device, which simplifies the task of fitting these parts to the toilet.

While in the jet pump 360 the spout nozzle 35*a* and the tubular bodies are integrated, they may instead be arranged separately. For example, the first tubular body 362 may be disposed separately from the front of the spout nozzle 35*a,* and the second tubular body 364 from the front of the first tubular body 362. Flushing water could then be involved through the spaces between the first tubular body 362 and the spout nozzle 35*a* and between the first tubular body 362 and the second tubular body 364. The multi-stage flow rate amplification and instantaneous flow rate increment is still attained even when the spout nozzle 35*a* is separated from the tubular bodies. Such an arrangement would also eliminate the need to provide side ports respectively in the tubular bodies.

Figure 50:
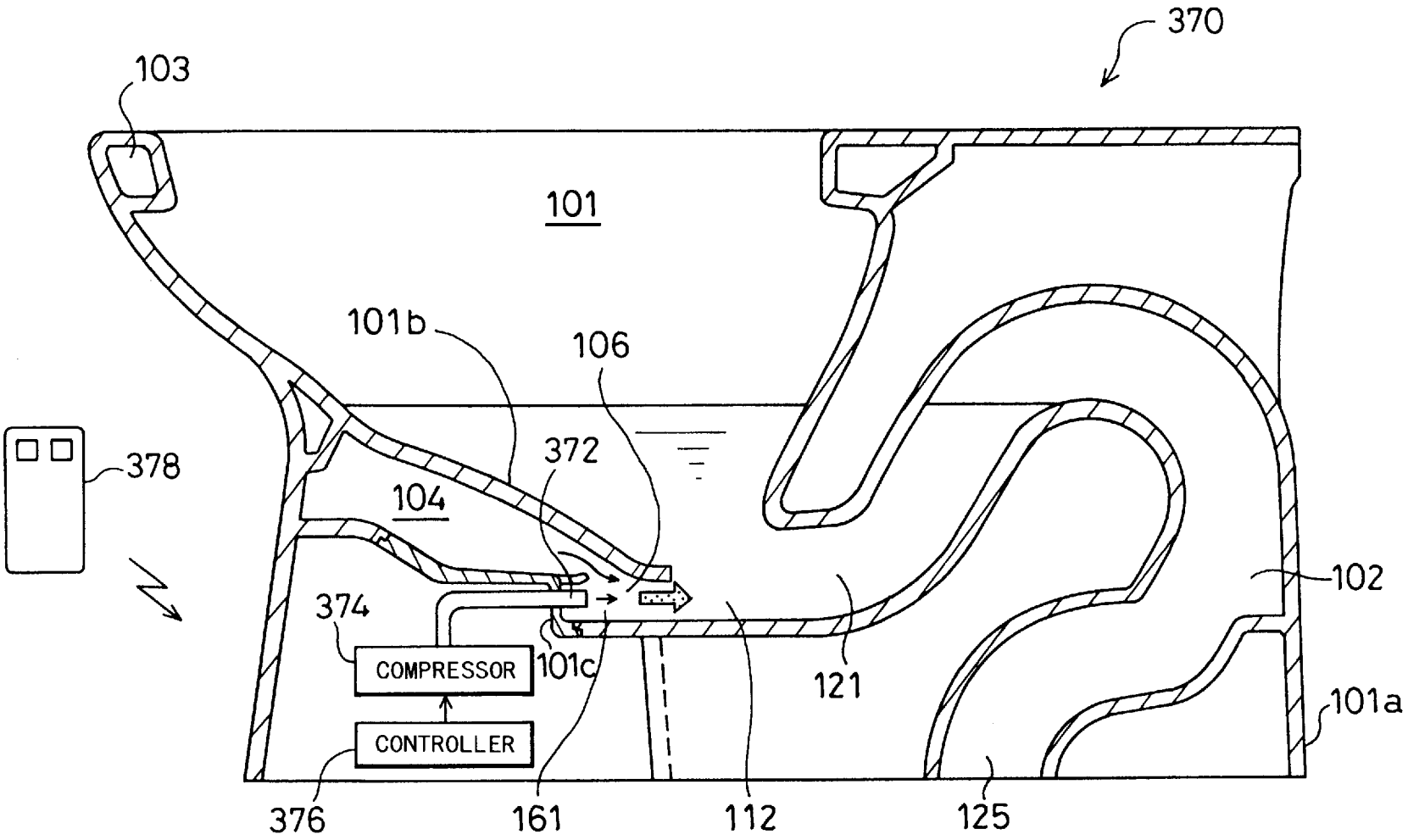
FIG. 50 is a simplified cross-sectional view of the toilet 370 of a thirteenth embodiment.

A thirteenth embodiment will now be described. The toilet of the thirteenth embodiment is characterized in that the flushing water in the flushing water reservoir 104 is involved in a flow of compressed air from the nozzle, in contrast to the other embodiments that use a flow water from a spout nozzle 35 to involve the flushing water. FIG. 50 is a schematic diagram of a toilet 370 according to the thirteenth embodiment. The toilet 370 has a water supply mechanism (not shown) just for supplying the water to be pooled in the bowl part 101. For this, after the bowl part has been cleaned the water supply mechanism opens the path from the water supply source for a prescribed time only, and leads a prescribed amount of flushing water as the water to be pooled in the bowl part 101, and the flushing water in the flushing water reservoir 104 is replenished at the same time.

The toilet 370 has an air nozzle 372 at the rear (on the left side, in the drawing) of the Z water conduit 161 formed below the flushing water reservoir 104. The air nozzle 372 is fastened watertightly to the toilet bowl wall 101*c* with the tip of the nozzle located slightly back from a lower end port of the flushing water reservoir 104, and is connected to a compressed air source comprised by a compressor 374. Thus, the air nozzle 372 and the Z water conduit 161 form a jet pump. The air nozzle 372 is controlled by a controller 376. In response to optical signals from a control panel 378, the controller 376 starts and stops the delivery of compressed air from the compressor 374.

Thus, when a cleaning signal is sent from the control panel 378 to the controller 376 and the compressor 374 sends the compressed air, the air nozzle 372 jets out the compressed air at a high-velocity, high-pressure to the Z water conduit 161. The passage of this compressed air through the Z water conduit 161 generates an ejector effect that involves flushing water from the flushing water reservoir 104.

As a result, a flow of spouted air (compressed air) in the state of the flow rate amplification and the instantaneous flow rate increment by the involvement of flushing water from the flushing water reservoir 104 jets out along the Z water conduit 161 and from the Z waterspout outlet 106 toward the inlet 121. The mixture of air and flushing water flushes in the state of the flow rate amplification and the instantaneous flow rate increment and cleans the bowl part. This enables high cleaning performance to be maintained. Also, there is no need to jet out flushing water from the water supply source, so the small amount of water in the flushing water reservoir 104 is enough for flushing out filth. Specifically, 0.5 to 2.0 liters water is needed only. Water economy is therefore enhanced.

Moreover, only water enough to comprise the water to be pooled in the bowl part 101 needs to be supplied from the water supply source. Water does not need to be supplied from the water supply source for the purpose of being jetted out. In addition, regardless of the pressure of water supplied from the water supply source, compressed air can be delivered at a constant pressure by the compressor 374. As such, high cleaning performance and water economy can be realized even where the available service water supply pressure is as low as around 0.3 kgf/cm$^2$, and even when the water supply pressure becomes lower as around 0.3 kgf/cm$^2$ regularly or seasonally. This therefore enables low-silhouette type toilets to be installed in a broader range of areas.

It is advantageous to continue to jet out compressed air from the air nozzle 372 even after siphon effect formed in the waste trap 102 is no more. If siphon effect should collapse for whatever reason, allowing filth to flow back out of the upstream tube 122, the jet of compressed air can blow the filth in the filth hopper part 112 back into the upstream tube 122 and out the through the downstream tube 123.

Figure 51:
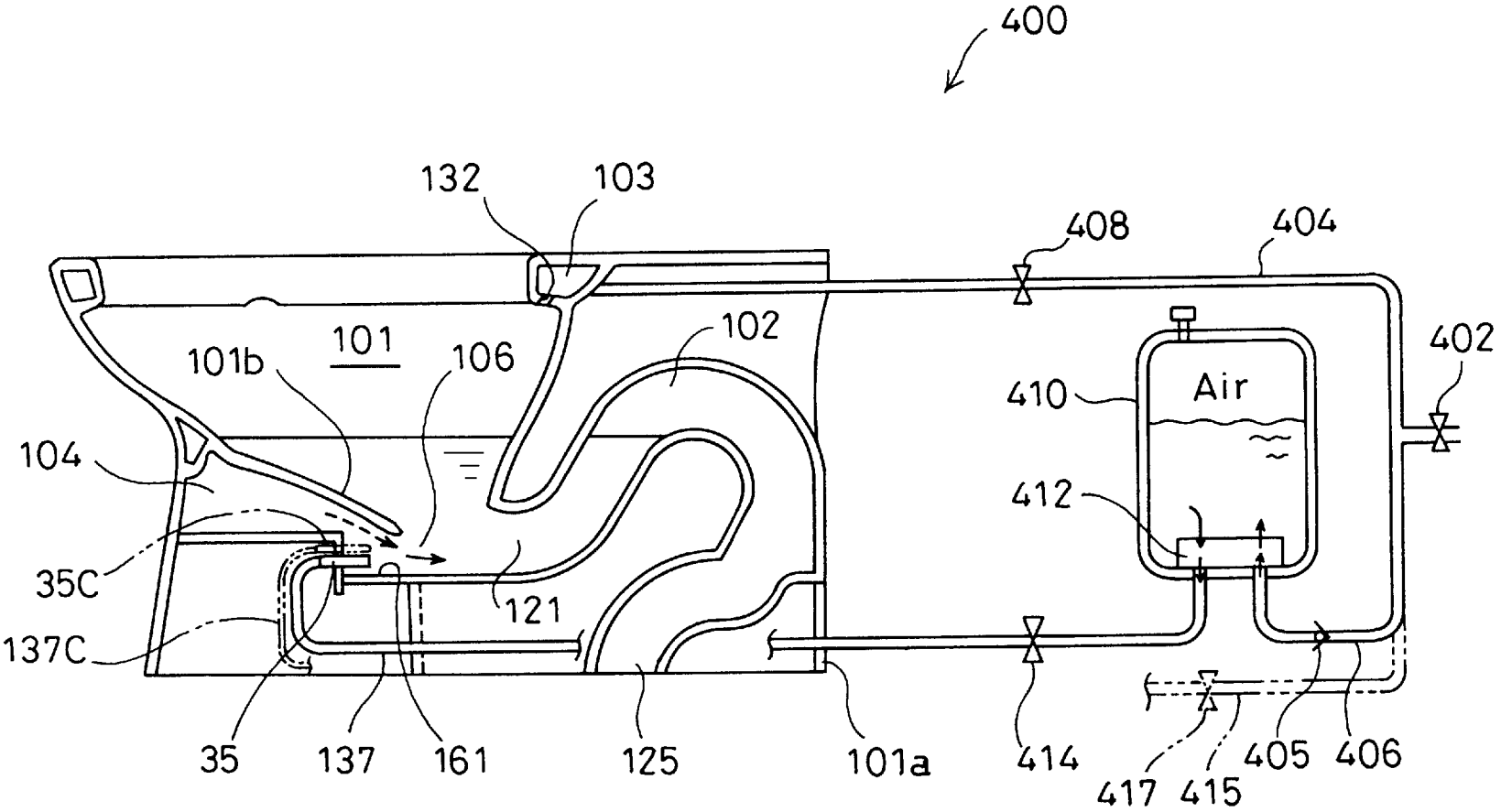
FIG. 51 is a simplified cross-sectional view of the toilet 400 of a fourteenth embodiment.

A fourteenth embodiment will now be described. The fourteenth embodiment is characterized in that it envisages the toilet being used in areas where the water supply source has a low supply pressure, including on a seasonal basis. FIG. 51 is a schematic drawing of toilet 400 according to the fourteenth embodiment. While the toilet 400 uses the same cleaning sequence of rim water cleaning/jet water cleaning/rim water cleaning as the foregoing embodiments, it has separate flushing water supply systems for the rim water cleaning and the jet water cleaning using flushing water jetted into the bowl part 101.

With reference to FIG. 51, the toilet 400 has a stopcock 402 that is connected to a water supply source and is normally open. The downstream side of the stopcock 402 divides into a rim feed channel 404 and a jet feed channel 406. The rim feed channel 404 has a rim valve 408 controlled by a controller (not shown). When the rim valve 408 is open, flushing water from the water supply source is supplied directly to the rim channel 103. That is, flushing water at the rim feed channel 404 feed pressure (flow pressure Fp) is supplied to the rim channel 103 and down into the bowl part 101 via the rim water outlets 132. The initial rim supply feed is for cleaning the bowl part, while the final rim supply feed is to provide the water to be pooled in the bowl part 101 and to replenish the flushing water reservoir 104.

The jet feed channel 406 is connected to the in port of a control valve 412 of a pressurization tank 410, and supplies flushing water from the pressurization tank 410. The jet feed channel 406 also has a non-return valve 405 to stop flushing water flowing from the pressurization tank 410.

The out port of the control valve 412 is connected to a connection tube 137 that has a jet valve 414 at an intermediate part thereof. Flushing water in the pressurization tank 410 is supplied to the spout nozzle 35 through the connection tube 137. As in the above embodiments, especially the toilet 100A of the second embodiment shown in FIG. 14, the spout nozzle 35 is disposed at the back of a Z water conduit 161 and oriented toward the inlet 121 via the Z waterspout outlet 106. The flow of flushing water from this spout nozzle 35, which forms a jet pomp with the Z water conduit 161, is jetted toward the inlet 121 as a jet of a flow-rate-amplified flushing water. Therefore, the jet water cleaning starts, and the filth conveyance and the toilet bowl cleaning is achieved with the flow-rate-amplified flushing water. The jet valve 414 is also operated by a controller.

By means of the control valve 412, the flushing water in the pressurization tank 410 is maintained at a prescribed pressure whereby the spout nozzle 35 is provided with a constant supply of flushing water, via the connection tube 137. This has the following advantages.

The flow pressure Fp in the jet feed channel 406 varies depending on the status of other valves and the like, and may decrease to as low as around one-fifth of the feed water stop pressure Sp that is the primary pressure setting. The control valve 412 allows flushing water supplied via the jet feed channel 406 at this flow pressure Fp to enter the pressurization tank 410. Flushing water which is pressed up at feed water stop pressure Sp in the pressurization tank 410 is supplied to the connection tube 137 at that pressure, so even if the flow pressure Fp should drop, flushing water supplied to the spout nozzle 35 is always at this feed water stop pressure Sp.

The quantity of flow Q of flushing water that can be supplied at the pressure Sp and tank volume V was calculated, as follows.

In the state in which the pressurization tank 410 can feed quantity Q of water to the spout nozzle 35 at the feed water stop pressure Sp, assuming the air in the pressurization tank 410 is at feed water stop pressure Sp and the volume of air is V1, from state equation (PV=nRT), the following relational expression obtains.

$$(1+Sp)V1=nRT$$

After the water has been supplied out, the pressurization tank 410 will be filled completely with air. As the pressure of the air is the flow pressure Fp, in accordance with the relational expression, $$(1+Fp)V=nRT$$

As tank volume V equals the sum of the air volume V1 and quantity of water flow Q, the above equation becomes $$(1+Fp)(V1+Q)=nRT$$

In these two states, the mol number and temperature of the air in the tank are equal, so $$(1+Sp)V1=(1+Fp)(V1+Q)$$

$$Q=((1+Fp)V1)/(Sp-Fp)$$

Since the toilet of this embodiment is cleaned using the flow-rate-amplified flushing water by jet pump, quantity Q was set at approximately 1.2 liters. The feed water stop pressure Sp was set at 1.5 kgf/cm$^2$ and flow pressure Fp at 0.5 kgf/cm$^2$, so air volume V1 is 1.8 liters. Namely, tank volume V is 3.0 liters. Since a small tank volume of 3 liters is sufficient, the pressurization tank 410 can be made small enough to fit in the bowl part main body 101*c*.

A jet pump is also provided for the rim water cleaning. When flushing water is supplied from the pressurization tank 410 to the nozzle of that jet pump at feed water stop pressure Sp, the pressurization tank 410 only needs a large enough volume V for that purpose.

The cleaning process of the toilet 400 will now be described. Prior to the cleaning process the rim valve 408 and the jet valve 414 are closed and the stopcock 402 is open, so water flows into the pressurization tank 410 from the jet feed channel 406. In addition, the pressure of cleaning water in the tank is increased to the feed water stop pressure Sp before the cleaning process.

When a cleaning button on a control panel (not shown) is pressed, the rim valve 408 opens. So that, flushing water is supplied to the rim channel 103 from the water supply source, the rim water cleaning is achieved for cleaning the surface of the bowl part 101, as described above. Then, simultaneously, the rim valve 408 closes and the jet valve 414 opens, and the pressurized flushing water is supplied to the spout nozzle 35 via the connection tube 137. The flushing water is spouted out with high speed at the feed water stop pressure Sp. Therefore, even if the flow pressure Fp is low, the flushing water can be jetted out from the spout nozzle 35 at the above feed water stop pressure Sp, which is always high. Even when the total amount of water from the water supply source is small, the amount of water than can be supplied from the pressurization tank 410 (the above quantity Q) is supplied to the spout nozzle 35 at the feed water stop pressure Sp. The spouted water flow, which involves flushing water from the flushing water reservoir 104, amplifies the flow rate and increases the instantaneous flow rate, thereby becoming a jet of flow-rate-amplified flushing water that flushes away filth and cleans the bowl part.

Thus, as in the above embodiments, the flow-rate-amplified flushing water spouted from jet pump provides high cleaning performance and water economy in the toilet 400. Moreover, this cleaning performance and water economy are realized regardless of the flow pressure Fp and therefore can be attained even in areas that have a low feed water stop pressure Sp or at a time when the feed water pressure is low for some reason, including small water supply to the toilet 400 owing to heavy use at other traps or a local reason. The toilet 400 therefore enables low-silhouette type to be used in a broader range of areas including low water supply pressure areas and low flow rate areas.

When the jet water cleaning described above is completed, the rim valve 408 opens simultaneously with the closing of the jet valve 414, and the rim water cleaning starts again to pool water in the bowl part 101 and to replenish the flushing water in the flushing water reservoir 104.

A fifteenth embodiment will now be described. Although like the fourteenth embodiment this is designed for areas where the water supply source has a low supply pressure, including on a seasonal basis, the fifteenth embodiment is characterized in that the flushing water is only pressurized and spouted when the supply pressure is low. For this, the toilet of this fifteenth embodiment comprises the toilet 400 with the following additions. The toilet of this fifteenth embodiment has a spout nozzle 35C disposed by the spout nozzle 35, as indicated in FIG. 51 by the double-dots-and-dashed lines. By means of a bypass path 415 that branches off from the jet feed channel 406 and bypasses the pressurization tank 410, and a connection tube 137C, flushing water can be supplied at the water supply source pressure directly to the spout nozzle 35C, bypassing the pressurization tank 410. The bypass path 415 is provided with a jet valve 417 for opening and closing the bypass path. For the purposes of this explanation, the jet valve 414 will be referred to as "first jet valve 414" and the jet valve 417 as "second jet valve 417" to distinguish between the valves. Similarly, the spout nozzle 35 will be referred to as "first spout nozzle 35" and the spout nozzle 35C as "second spout nozzle 35C."

Figure 52:
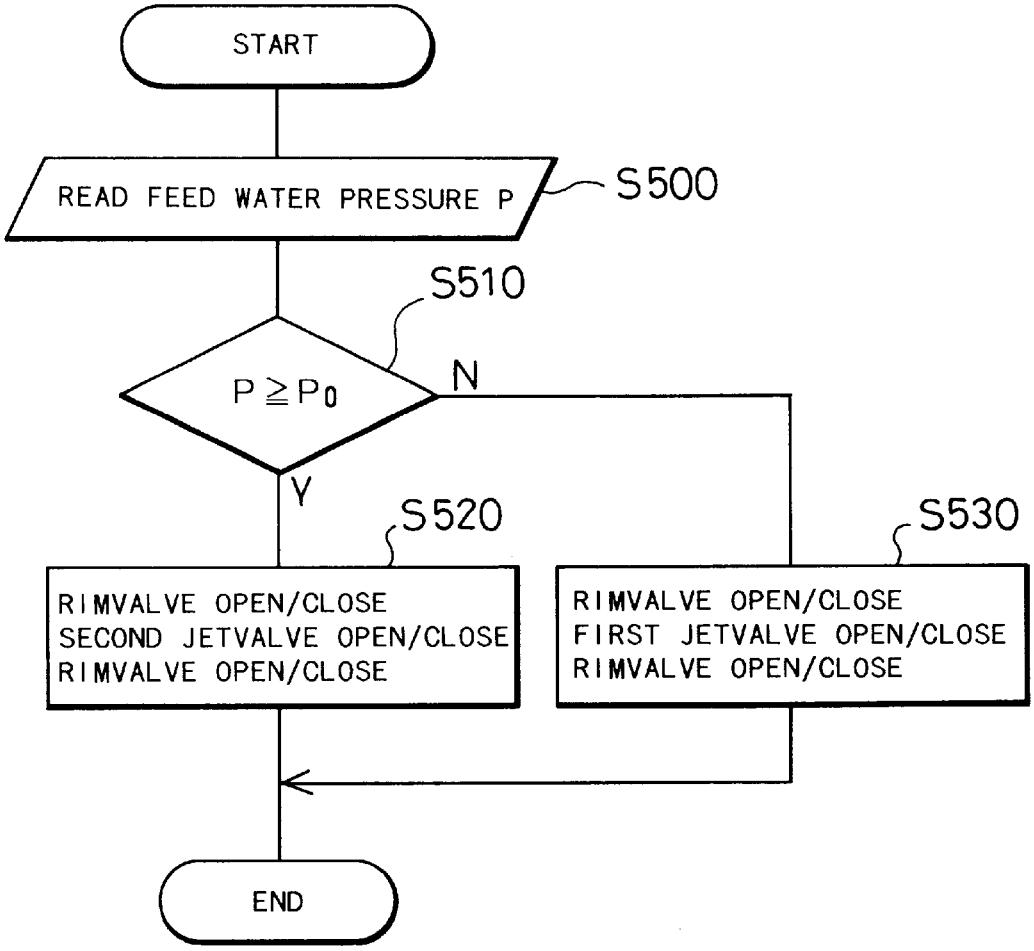
FIG. 52 is a flow chart of the toilet bowl cleaning procedure in a fifteenth embodiment.

Thus, in the fifteenth embodiment, use of the first and second nozzles 35 and 35C can be differentiated, and either can be used for cleaning by the flow-rate-amplified flushing water. In the fifteenth embodiment, use of the nozzles is differentiated as follows. FIG. 52 is a flow chart of the cleaning process in the toilet of this embodiment.

The process shown in FIG. 52 is effected by the control means of the toilet in fifteenth embodiment at the each time when a cleaning button is pressed. When the process is started, total water pressure P (flow pressure Fp) obtained from a pressure sensor (not shown) provided on the downstream side of the stopcock 402 is read (step S500). It is then determined whether or not the pressure P is equal to greater than a prescribed pressure PO (step S510). The pressure PO is set to be at about 80% of the feed water stop pressure Sp. As the pressure PO, a pressure is specified that when used to jet out water directly from the water supply source from the spout nozzle, provides a suitably high-velocity, high-pressure flow for amplification to flow rate and for increment to instantaneous flow rate for flushing and cleaning the bowl part.

When the determination in step S510 is affirmative, it means that the supply pressure at that time is high, so in step S520 the following valve control is performed to effect the cleaning sequence of the rim water cleaning/the jet water cleaning/the rim water cleaning. Specifically, the rim valve 408 opens and the rim water cleaning starts, the surface of the bowl part is cleaned by water from the rim. Next, the rim valve 408 closes and the second jet valve 417 opens. As a result, water from the water supply source is supplied directly to the second spout nozzle 35C and is spouted out as a high-velocity, high-pressure jet, and the jet water cleaning starts with the second spout nozzle 35C. The result is reliable the filth conveyance and the toilet bowl cleaning with high cleaning performance and water economy. The second jet valve 417 then closes and the rim valve 408 opens again to effect the final rim water cleaning to pool water in the bowl and replenish the flushing water.

If the determination in step S510 is negative, it means that the supply pressure at that time is too low to spout out the water as a high-velocity, high-pressure jet. So that, in step S530 the following valve control is performed to effect the cleaning sequence of the rim water cleaning/the jet water cleaning/the rim water cleaning. First, as in step S520, the rim valve 408 is operated to perform the first rim water cleaning. The first jet valve 414 is then operated to feed the flushing water in the pressurization tank 410 pressurized at a feed water stop pressure Sp to the first spout nozzle 35 and is spouted out as a high-velocity, high-pressure cleaning jet. So that, the result is reliable the filth conveyance and the toilet bowl cleaning with high cleaning performance and water economy by the jet water cleaning with the first spout nozzle 35. Finally, as in step S520, the rim valve 408 is again operated for the final rim water cleaning.

With respect to cleaning by a jet of flow-rate-amplified flushing water produced by jet pump, when the water supply pressure is low, the above-described toilet according to the fifteenth embodiment uses flushing water stored under pressure in the pressurization tank 410 to enable the first spout nozzle 35 to jet out as a high-pressure and a high-pressure, the flow-rate-amplified flushing water runs into the inlet 121 (step S530). When the supply water pressure is high enough, flushing water is supplied directly from the water supply source to the second spout nozzle 35C with the high supply water pressure to be jetted out and form a flow-rate-amplified flushing water into the inlet 121 (step S520). Thus, whatever the supply water pressure is, the toilet according to the fifteenth embodiment provides reliable the filth conveyance and the toilet bowl cleaning with high cleaning performance and water economy.

Figure 53:
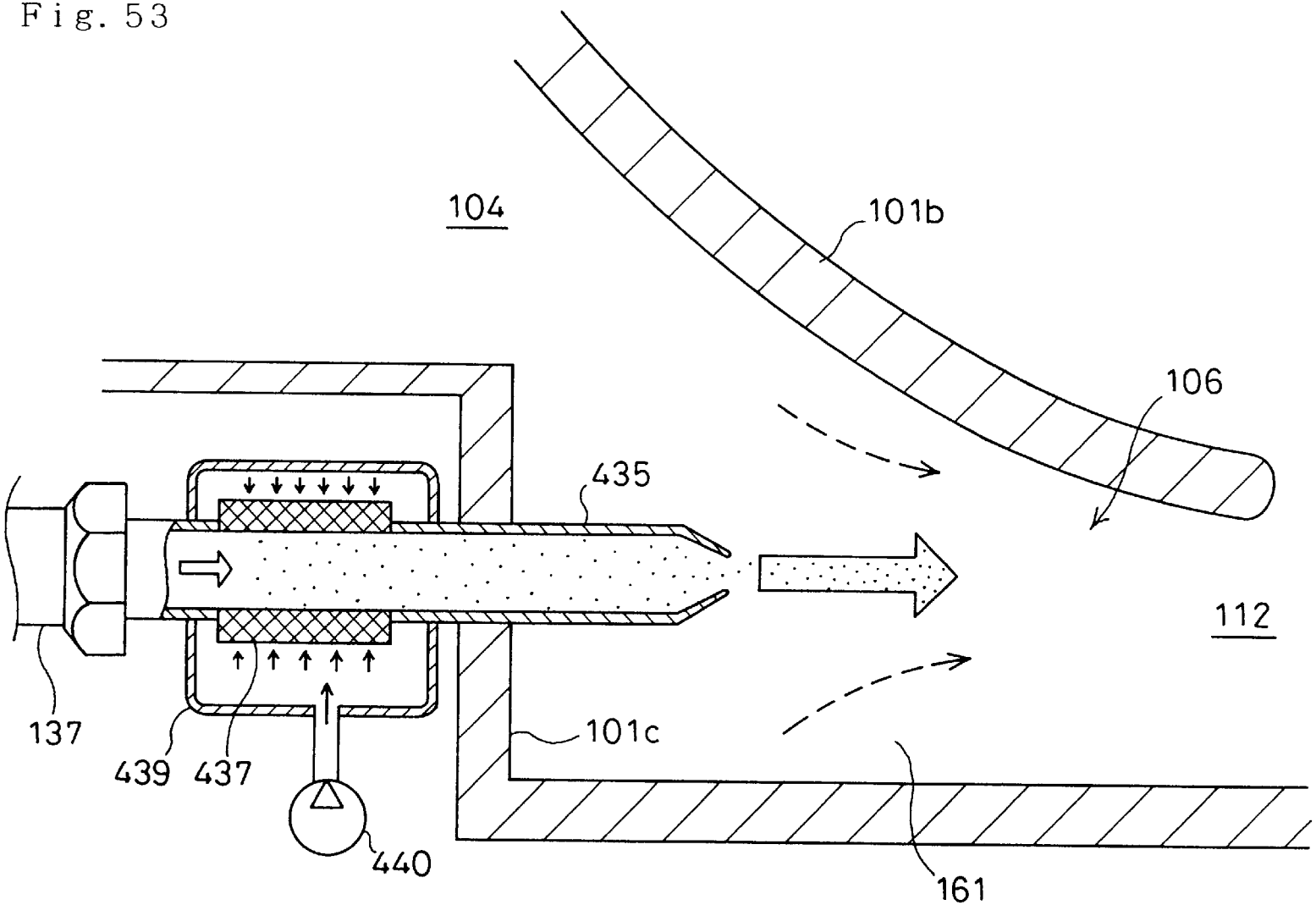
FIG. 53 is a magnified cross-sectional view of the principal parts according to a sixteenth embodiment.

A sixteenth embodiment will now be described, which is characterized by spouting out a mixture of pressurized air and flushing water from the spout nozzle. FIG. 53 is a magnified cross-sectional view of principal parts of the toilet of this embodiment. As shown in FIG. 53, in the toilet of the sixteenth embodiment, a spout nozzle 435 is used instead of the spout nozzle 35, which is used in the above-described embodiments. This spout nozzle 435 is watertightly attached to the toilet bowl wall surface 101*c*, and has the same orientation as the spout nozzle 35.

The spout nozzle 435 has a mixing member 437 near the junction with the connection tube 137, for mixing water with air. The mixing member 437 has a porosity that is permeable to air but not to liquids. The spout nozzle 435 has a hermetically-sealed chamber 439 in which the mixing member 437 is enclosed; pressurized air is supplied to the hermetically-sealed chamber 439 from a pressure pump 440. Flushing water flowing through the connection tube 137 to the spout nozzle 435 is mixed with pressurized air on the downstream side of the mixing member 437. So that, flushing water mixed with pressurized air is spouted out from the spout nozzle 435 toward a waste trap inlet 121 as a flow of flow-rate-amplified flushing water by the jet pump formed with the spout nozzle 435 and the Z water conduit 161.

The degree of flow rate amplification provided by the mixture of compressed air and water, that is, the energy (jet energy) of the flushing water, will now be discussed.

The Z energy E of the water flowing from the Z water-spout outlet 106 is obtained from the following equation in which ρw is water density, S is the area of the opening of the Z waterspout outlet 106, and V is Z flow velocity.

$$E=(1/2)\rho w\cdot S\cdot V^3$$

The Z energy E of this equation is when there is no air-water mixture.

If η is the mixing ratio of the air in the water, Qa is the air quantity of air flow and Qw the quantity of water flow, then mixing ratio η is Qa/Qw. Also, if ρa is air density, then the density ρ' of the water in the air-water mixture in which air is mixed in at a mixing ratio η can be found from the following, using water density ρw, quantity of air flow Qa, quantity of water flow Qw, and air density ρa.

$$\begin{aligned}\rho' &= (\rho w\cdot Qw+\rho a\cdot Qa)/(Qw+Qa)\\ &\approx(\rho w\cdot Qw)(Qw+Qa)\\ &=(\rho w\cdot Qw)/Qw\cdot(1+\eta)\\ &=\rho w/(1+\eta)\end{aligned}$$

The Z energy E' of water containing that mixing ratio of air is $$E'=(1/2)\rho'\cdot S\cdot V^3$$

By substituting ρ' and replacing V by (Qw+Qa)/S, the Z energy E' can be expressed as follows.

$$\begin{aligned}E' &= (1/2)\rho w\cdot S\cdot V^3\cdot(1+\eta)^2\\ &=E(1+\eta)^2\end{aligned}$$

Therefore, in the case of the toilet according to the sixteenth embodiment, mixing air with the flushing water flowing through the spout nozzle 435 enables the Z energy E to be increased $(1+\eta)^2$ times. This means that even when the pressure of water supplied to the spout nozzle 435 is low, a jet of the flow-rate-amplified flushing water can still be realized. So that, the flow-rate-amplified flushing water is spouted from the Z waterspout outlet 106 to the inlet 121 in the state of the flow rate amplification and the instantaneous flow rate increment. Thus, whatever the supply water pressure is, the toilet provides reliable the filth conveyance and the toilet bowl cleaning with high cleaning performance and water economy.

In a variation of the sixteenth embodiment, a pressure sensor is used to detect the supply pressure of water supplied to the spout nozzle 435, like as the above fifteenth embodiment. If the detected pressure is too low to provide a high-velocity, high-pressure jet of flushing water, that is, if the pressure is less than the above pressure PO, air is mixed into the flow. With this variation, the use of the pump 440 to produce a high-energy jet of flushing water by mixing in air can be limited to just when the supply pressure is low. As such, the pump 440 only needs to be driven intermittently or temporarily, which helps to save energy.

In the foregoing, the present invention has been described with reference to the above embodiments. It should be understood, however, that the invention is not limited to the embodiments and arrangements described and but can also be constituted in various other configurations so long as these do not depart from the defined scope of the invention.

Industrial Applicability

As a toilet that uses flushing water to convey filth in the bowl part and clean the bowl part, the present invention is useful for water economization measures for toilets.

What is claimed is:

1. A toilet wherein filth in a bowl part of a toilet bowl is conveyed to the outside of said toilet bowl by flushing water, said toilet comprises:

a water spout member for spouting flushing water in order to convey said filth; and amplification means for amplifying a flow rate of flushing water utilized for conveyance of said filth and for leading said amplified flow rate of flushing water into said water spout member, in order to convey said filth in said toilet bowl when said flushing water is spouted.

2. A toilet in accordance with claim 1, wherein said amplification means comprises:

a jet pump for jetting out a mixture of both a driving fluid which represents water being supplied from a water supply source and a driven fluid which represents flushing water provided for conveyance of said filth in said bowl part, wherein said jet pump comprises an actuation nozzle for jetting out the water supplied from said water supply source and a throat which defines a flow path of both said fluids in response to said actuation nozzle and which leads both said fluids to said water spout member.

3. A toilet in accordance with claim 2, wherein a ratio of a diameter d of said actuation nozzle to a diameter D of said throat d/D ranges approximately from 0.3 to 0.7.

4. A toilet in accordance with claim 2, wherein said throat has a length L that is approximately two to six times a diameter D of said throat.

5. A toilet in accordance with claim 2, said toilet further comprises:

water reservoir for storing water prior to a start of said filth conveyance and for utilizing said stored water as said provided flushing water; and a passage communicating member for making said water reservoir communicate with said throat.

6. A toilet in accordance with claim 5, wherein said water reservoir is arranged below a toilet bowl rim surface.

7. A toilet in accordance with claim 6, wherein said water reservoir is formed so as to have a structure partly separated from said bowl part.

8. A toilet in accordance with claim 7, wherein said water reservoir has a structure that enables the pooled water pooled in said bowl part to be flown into said water reservoir.

9. A toilet in accordance with claim 5, wherein said water reservoir is detachably attached to the toilet bowl.

10. A toilet in accordance with claim 2, said toilet further comprises:

a waste trap for draining the pooled water pooled in said bowl part to the outside, wherein said jet pump is disposed at a rising point of an upstream tube of said waste trap and oriented toward a flow path of said upstream tube.

11. A toilet in accordance with claim 10, wherein a ratio of a diameter D of said throat to a diameter K of said upstream tube D/K ranges approximately from 0.3 to 0.6.

12. A toilet in accordance with claim 5, wherein said passage communicating member comprises switching means for switching the communication state of said water reservoir and said throat between communicating and non-communicating.

13. A toilet in accordance with claim 12, wherein said switching means comprises means for selectively switching between the communication states, communicating and non-communicating.

14. A toilet in accordance with claim 12, wherein said switching means switches said passage communication state to a non-communicating state when no water exists in said water reservoir.

15. A toilet in accordance with claim 1, wherein said amplification means comprises:

a jet pump for jetting out a mixture of both a driving fluid which represents water being supplied from a water supply source and a driven fluid which represents the air, wherein said jet pump comprises an actuation nozzle for jetting out the water supplied from said water supply source and a throat which defines a flow path of both said fluids in relation to said actuation nozzle and which leads both said fluids to said water spout member.

16. A toilet in accordance with claim 15, wherein said throat comprises air intake shut-off means for allowing the air intake while said actuation nozzle is supplied with water and for shutting off the air intake while not supplied with water.

17. A toilet in accordance with claim 2, wherein said jet pump is arranged so as to allow a jet fluid mixture to flow into the bowl part.

18. A toilet in accordance with claim 17, wherein said jet pump is arranged so as to jet out the fluid mixture to a rim channel, which is disposed around an upper edge of said bowl part and flushes down the flushing water to said bowl part.

19. A toilet in accordance with claim 18, wherein said jet pump is arranged so as to jet out the fluid mixture in an oblique direction with respect to said rim channel.

20. A toilet in accordance with claim 17, wherein said jet pump is arranged so as to jet out the fluid mixture directly into said bowl part.

21. A toilet in accordance with claim 20, wherein said jet pump is arranged so as to jet out the fluid mixture in a specific direction that causes a vortex flow of the pooled water pooled in said bowl part.

22. A toilet in accordance with claim 21, wherein said jet pump is arranged so as to jet out the fluid mixture from a place above a liquid surface of said pooled water to cause a vortex flow in said pooled water.

23. A toilet in accordance with claim 17, said toilet further comprises:

a waste trap for draining the pooled water pooled in said bowl part to the outside, wherein said jet pump is arranged so as to orient toward an inlet of said waste trap via said bowl part.

24. A toilet in accordance with claim 23, said toilet further comprises:

water reservoir which is formed so as to have a structure partly separated from said bowl part for storing water prior to a start of said filth conveyance and for utilizing said stored water as said provided flushing water, wherein said water reservoir has a structure that enables the pooled water pooled in said bowl part to be flown into said water reservoir.

25. A toilet in accordance with claim 23, said toilet further comprises:

water reservoir which is formed so as to have a structure partly separated from said bowl part for storing water prior to a start of said filth conveyance and for utilizing said stored water as said provided flushing water; and a water conduit for making said bowl part communicating with said water reservoir, in order to allow a flow of the pooled water pooled in said bowl part, said water conduit comprising a spout that faces said inlet of said waste trap on the side of said bowl part, wherein said jet pump comprises said water conduit as said throat, and said actuation nozzle is disposed in said water conduit.

26. A toilet in accordance with claim 23, wherein said water reservoir comprises:

an opening which is formed so as to face said inlet of said waste trap in said bowl part and which defines a flow path of a fluid, wherein said actuation nozzle of said jet pump is arranged in said water reservoir so as to be oriented toward said inlet of said waste trap via said opening of said water reservoir.

27. A toilet in accordance with claim 26, wherein said water reservoir is arranged below said bowl part across a wall member which constitutes said bowl part.

28. A toilet in accordance with claim 27, wherein an inner wall surface of said water reservoir forms a slope inclined toward said actuation nozzle.

29. A toilet in accordance with claim 26, said toilet further comprising:

a tubular body arranged to open to said opening of said water reservoir and face said actuation nozzle, in order to enable the water jetted out of said actuation nozzle to flow in and pass through said tubular body, said tubular body having an opening that joins the flushing water existing in the water reservoir with the water jetted out of said actuation nozzle.

30. A toilet in accordance with claim 29, wherein said actuation nozzle and said tubular body are integrated with each other and fixed to said water reservoir.

31. A toilet in accordance with claim 23, wherein a plurality of said jet pumps are arranged to be oriented toward said inlet of said waste trap.

32. A toilet in accordance with claim 23, wherein said jet pump comprises a water supply conduit for supplying water from said water supply source, a plurality of actuation nozzles branched out from said water supply conduit, and a plurality of throats respectively corresponding to the plurality of said actuation nozzles.

33. A toilet in accordance with claim 17, wherein at least two of said jet pumps are arranged so as to enable a spout of the fluid mixture to be flown into said bowl part.

34. A toilet in accordance with claim 33, wherein one of said jet pumps is arranged so as to jet out the fluid mixture to a rim channel, which is disposed around an upper edge of said bowl part and flushes down the flushing water to said bowl part, and the other of said jet pumps is arranged so as to jet out the fluid mixture directly into the bowl part.

35. A toilet in accordance with claim 34, said toilet further comprises:

a waste trap for draining the pooled water pooled in said bowl part to the outside, wherein said other jet pump is arranged so as to be oriented toward an inlet of said waste trap.

36. A toilet in accordance with claim 35, said toilet further comprises supply switching means for consecutively switching the destination of water supply from said water supply source, from said one jet pump to said other jet pump.

37. A toilet in accordance with claim 36, wherein said supply switching means comprises means for switching the destination of water supply from said water supply source, from said other jet pump to said one jet pump again, after having switched to the other jet pump.

38. A toilet in accordance with claim 1, wherein said amplification means comprises multi-stage amplification means for amplifying the flow rate of the flushing water in a multi-stage manner.

39. A toilet in accordance with claim 38, wherein said multi-stage amplification means comprises:

a jet pump for jetting out a mixture of both a driving fluid which represents water being supplied from a water supply source and a driven fluid which represents flushing water provided for conveyance of said filth in said bowl part, wherein said jet pump comprises an actuation nozzle for jetting out the water supplied from said water supply source, a first throat arranged so as to correspond to said actuation nozzle for defining a flow path of both said fluids, and a second throat arranged so as to face said first throat for leading said provided flushing water to said water spout member with involvement into the fluid mixture which has passed through said first throat.

40. A toilet in accordance with claim 1, wherein said amplification means comprises:

a jet pump for jetting out a mixture of both a driving fluid which represents the air being supplied from an air source and a driven fluid which represents flushing water provided for conveyance of said filth in said bowl part, wherein said jet pump comprises an actuation nozzle for jetting out the air supplied from said air source and a throat which defines a flow path of both said fluids in response to said actuation nozzle and which leads both said fluids to said water spout member.

41. A toilet in accordance with claim 2, said toilet further comprises:

pressurizing means for pressuring the water supplied from the water supply source, wherein said jet pump comprises an actuation nozzle for jetting out the water pressurized by said pressurizing means.

42. A toilet in accordance with claim 2, said toilet further comprises:

pressurizing means for pressuring the water supplied from the water supply source when the supply source has a low supply pressure, wherein said jet pump comprises:

a first actuation nozzle for directly jetting out the water supplied from said water supply source;

a second actuation nozzle for jetting out the water pressurized by said pressurizing means; and selection means for selecting one of said first and second actuation nozzles according to the supply pressure of said water supply source.

43. A toilet in accordance with claim 2, said toilet further comprises:

mixing means for mixing the water supplied from the water supply source with pressurized air, wherein said jet pump comprises an actuation nozzle for jetting out water mixed with the pressurized air by said mixing means.

44. A toilet in accordance with claim 43, wherein said mixing means comprises means for mixing said supplied water with said pressurized air when said water supply source has a low supply pressure.

45. A toilet in accordance with claim 2, said toilet further comprises:

water reservoir for storing water prior to a start of said filth conveyance and for utilizing said stored water as said provided flushing water, wherein a ratio of an amount TW of water stored in said water reservoir to an amount BW of water existing in said bowl part TW/BW ranges approximately from 0.25 to 0.35.

* * * * *